US009454976B2

(12) United States Patent
Newman

(10) Patent No.: US 9,454,976 B2
(45) Date of Patent: Sep. 27, 2016

(54) EFFICIENT DISCRIMINATION OF VOICED AND UNVOICED SOUNDS

(71) Applicant: Zanavox, Temecula, CA (US)

(72) Inventor: David Edward Newman, Temecula, CA (US)

( * ) Notice: Subject to any disclaimer, the term of this patent is extended or adjusted under 35 U.S.C. 154(b) by 180 days.

(21) Appl. No.: 14/253,120

(22) Filed: Apr. 15, 2014

(65) Prior Publication Data

US 2015/0106087 A1 Apr. 16, 2015

Related U.S. Application Data

(60) Provisional application No. 61/890,428, filed on Oct. 14, 2013.

(51) Int. Cl.
*G10L 25/78* (2013.01)

(52) U.S. Cl.
CPC ..... *G10L 25/78* (2013.01)

(58) Field of Classification Search
CPC .... G10L 25/78; G10L 25/932; G10L 25/935
See application file for complete search history.

(56) References Cited

U.S. PATENT DOCUMENTS 4,357,488 A 11/1982 Knighton
4,589,131 A 5/1986 Horvah
4,637,046 A 1/1987 Sluijter
4,720,862 A 1/1988 Nakata
5,101,434 A * 3/1992 King ..... G10L 15/00 704/241
5,809,455 A 9/1998 Nishiguchi
6,023,671 A 2/2000 Iijima
6,249,758 B1 6/2001 Mermelstein
6,285,979 B1 9/2001 Ginzburg
6,640,208 B1 10/2003 Zhang
6,915,256 B2 7/2005 Ramabadran
6,915,257 B2 7/2005 Heikkinen
7,246,058 B2 7/2007 Burnett
7,523,038 B2 4/2009 Ariav
7,921,364 B2 4/2011 Ramirez
8,219,391 B2 7/2012 Preuss
8,583,425 B2 11/2013 Thepie Fapi
2003/0055646 A1* 3/2003 Yoshioka ..... G10L 13/033 704/258
2008/0103765 A1* 5/2008 Lakaniemi ..... G10L 19/22 704/222
2009/0271196 A1* 10/2009 Nyquist ..... G10L 25/93 704/246
2012/0154191 A1* 6/2012 Knapp ..... H03M 3/462 341/143
2013/0054246 A1 2/2013 Newman
2013/0093445 A1 4/2013 Newman
2013/0282373 A1 10/2013 Visser
2013/0290000 A1 10/2013 Newman
2014/0074481 A1 3/2014 Newman

* cited by examiner

*Primary Examiner* — Mohammad Ghayour
*Assistant Examiner* — Lennin Rodriguezgonzale

(57) ABSTRACT

A method is disclosed for discriminating voiced and unvoiced sounds in speech. The method detects characteristic waveform features of voiced and unvoiced sounds, by applying integral and differential functions to the digitized sound signal in the time domain. Laboratory tests demonstrate extremely high reliability in separating voiced and unvoiced sounds. The method is very fast and computationally efficient. The method enables voice activation in resource-limited and battery-limited devices, including mobile devices, wearable devices, and embedded controllers. The method also enables reliable command identification in applications that recognize only predetermined commands. The method is suitable as a pre-processor for natural language speech interpretation, improving recognition and responsiveness. The method enables realtime coding or compression of speech according to the sound type, improving transmission efficiency.

3 Claims, 27 Drawing Sheets

Fig. 1b. Unvoiced "S" sound. Fig. 1c. Voiced "O" sound.

Fig. 2
Fig. 2a
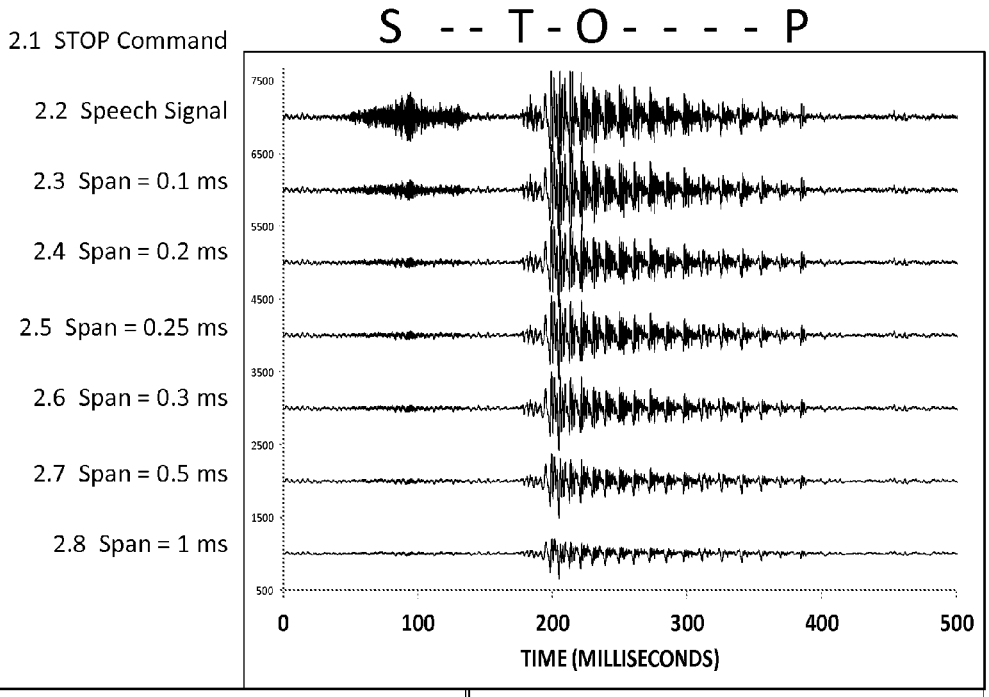
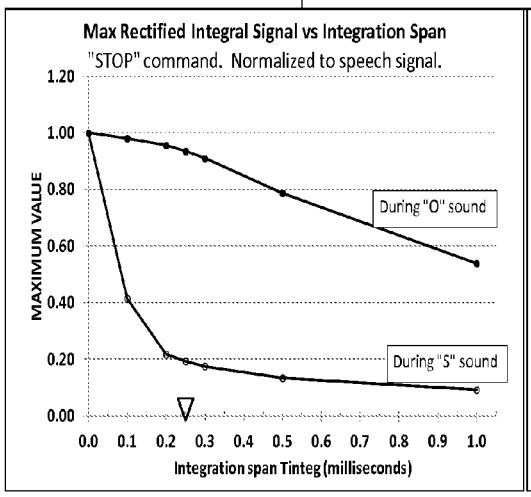
Fig. 2b. Maximum value of the rectified integral signal during voiced "O" and unvoiced "S", vs. integration span.
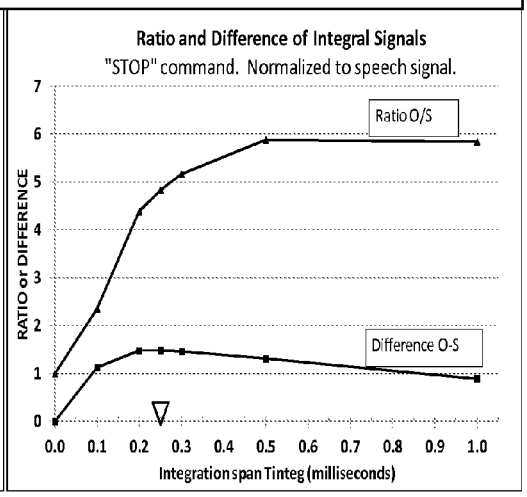
Fig. 2c. Ratio (upper curve) and difference (lower) of normalized "O" and "S", vs. integration span.

Fig. 3b. Maximum Differential Signal during voiced "O" and unvoiced "S", vs. number of values Ndif in differential.

Fig. 3c. Ratio (upper curve) and difference (lower) of normalized "O" and "S", vs. number of values Ndif in differential.

Fig. 7

ADJUSTMENTS TO DIGITIZER OUTPUT TO OBTAIN THE PREFERRED SPEECH SIGNAL DATA PERIOD

| Digitizer-Output Period Milliseconds | Nominal ADC Frequency kHz | Recommended actions | Resulting Tdif Milliseconds |
|---|---|---|---|
| 0.01 | 100 | Skip 4, keep 1 value. | Tdif=0.10 |
| 0.02 | 50 | Skip 2, keep 1, skip 1, keep 1. | Tdif=0.10 |
| 0.023 | 44 | Skip 1, keep 1. | Tdif=0.090 |
| 0.031 | 32 | Skip 1, keep 2. | Tdif=0.094 |
| 0.04 | 25 | Acceptable. | Tdif=0.080 |
| 0.045 | 22 | Acceptable. | Tdif=0.090 |
| 0.05 | 20 | Ideal. | Tdif=0.10 |
| 0.06 | 16 | Acceptable. | Tdif=0.12 |
| 0.07 | 14 | Acceptable, slight loss. | Tdif=0.14 |
| 0.08 | 12 | Substantial degradation. | Tdif=0.16 |
| 0.09 | 11 | Not recommended. | Tdif=0.18 |
| 0.10 | 10 | Not recommended. | Tdif=0.20 |

Fig. 11

| RESOURCES REQUIRED TO DISCRIMINATE VOICED AND UNVOICED SOUNDS | |
|---|---|
| **DETECTION-OUTPUT PROTOCOL WITH DELAYED-OFFSET OPTION** | **TOGGLE OUTPUT PROTOCOL WITH SMOOTHING OF THE SOUND SIGNALS** |
| Variables: 8<br>Offset signal<br>Speech signal (i)<br>Speech signal (i-1)<br>Speech signal (i-2)<br>Integral signal<br>Differential signal<br>V-detection (output)<br>U-detection (output)<br><br>Computations per data period:<br>2 Additions<br>2 Subtractions<br>3 Multiplications (one by 2)<br>1 Division (by 4)<br>2 Absolute values<br>2 Comparisons<br><br>= 12 operations<br>(6 trivial, 6 nontrivial) | Variables: 9<br>Offset signal<br>Speech signal (i)<br>Speech signal (i-1)<br>Speech signal (i-2)<br>Integral signal<br>Differential signal<br>V-detection<br>U-detection<br>Toggle signal (output)<br><br>Computations per data period:<br>3 Additions<br>2 Subtractions<br>5 Multiplications (one by 2)<br>1 Division (by 4)<br>2 Absolute values<br>4 Comparisons<br><br>= 17 operations<br>(8 trivial, 11 nontrivial) |

Fig. 27

RESOURCES REQUIRED TO DISCRIMINATE VOICED AND UNVOICED SOUNDS

| TALLY PROTOCOL WITH HYSTERESIS | DELAYED TALLY PROTOCOL WITH DELAYED OFFSET OPTION |
|---|---|
| Variables: 10<br>Offset signal<br>Speech signal (i)<br>Speech signal (i-1)<br>Speech signal (i-2)<br>Integral signal<br>Differential signal<br>Voiced tally counter<br>Unvoiced tally counter<br>Voiced time-interval (output)<br>Unvoiced time-interval (output)<br><br>Computations per data period:<br>5 Additions<br>2 Subtractions<br>7 Multiplications<br>1 Division<br>2 Absolute values<br>6 Threshold comparisons<br><br>=23 operations<br>(10 trivial, 13 nontrivial) | Variables: 13 (3 registers)<br>Offset signal<br>Speech signal (i)<br>Speech signal (i-1)<br>Speech signal (i-2)<br>Integral signal<br>Differential signal<br>Voiced tally counter<br>Unvoiced tally counter<br>Voiced time interval (output)<br>Unvoiced time interval (output)<br>V-counter (register)<br>U-counter (register)<br>cycle counter (register)<br><br>Computations per data period:<br>2 Additions<br>2 Subtractions<br>3 Multiplications<br>1 Division<br>2 Absolute values<br>5 Comparisons<br>2 Register increment<br><br>=17 operations<br>(11 trivial, 6 nontrivial) |

EFFICIENT DISCRIMINATION OF VOICED AND UNVOICED SOUNDS

RELATED APPLICATIONS

This application claims the benefit of U.S. Provisional Application No. 61/890,428 titled "Efficient Voice Command Recognition" filed 2013 Oct. 14, the entirety of which is hereby incorporated by reference.

BACKGROUND OF THE INVENTION

The invention relates to speech analysis, and particularly to means for discriminating voiced and unvoiced sounds in speech, while using minimal computational resources.

Automatic speech processing is an important and growing field. Many applications require an especially rapid means for discriminating voiced and unvoiced sounds, so that they can respond to different commands without perceptible delay. Emerging applications include single-purpose devices that recognize just a few predetermined commands, based on the order of the voiced and unvoiced intervals spoken, and applications requiring a fast response, such as a voice-activated stopwatch or camera. Such applications are often highly constrained in computational resources, battery power, and cost. In addition, many applications detect voiced and unvoiced sounds separately and process them differently, including applications that interpret natural language—such as speech-to-text dictation, spoken commands for browsing and searches, and voice-activated controls—which often use a pre-processor to discriminate voiced and unvoiced sounds, thereby simplifying word identification and reducing latency. Other applications perform speech compression or coding to improve the efficiency of wireless transmission of speech, using different compression routines for voiced and unvoiced sounds due to the different properties of those sounds. All of these applications would benefit from a computationally efficient, fast routine that reliably discriminates voiced and unvoiced sounds as soon as they are spoken.

As used herein, "discriminating" voiced and unvoiced sounds means separately detecting voiced and unvoiced sounds, and identifying them as such. "Voiced" sounds are sounds generated by vocal cord vibration, and "unvoiced" sounds are generated by the turbulence of air passing through an obstruction in the air passage but without vocal cord involvement. A method is "computationally efficient" if it requires few processor operations and few memory locations to obtain the intended result. For brevity, voiced and unvoiced may be abbreviated as V and U respectively.

Prior art includes many strategies for discriminating V and U sound types. Some prior art involves a simple frequency threshold, exploiting the tendency of voiced sounds to have a lower primary frequency than unvoiced sounds. U.S. Pat. No. 7,523,038 teaches two analog bandpass filters to separate high and low frequencies, U.S. Pat. No. 4,357,488 teaches high-pass and low-pass analog filters, and U.S. Pat. No. 6,285,979 teaches a single bandpass filter with gated counters to separate voiced and unvoiced sounds. U.S. application Ser. No. 13/220,317 teaches a filter to select lower-frequency sounds and reject high-frequency sounds, while U.S. application Ser. Nos. 13/274,322 and 13/459,584 carry this further by detailing implementation methods and unique applications of such filtered signals. A simple frequency cut lacks reliability because real speech includes complex sound modulation due to vocal cord flutter as well as effects from the fluids that normally coat the vocal tract surfaces, complicating the frequency spectrum for both sound types. Strong modulation, overtones, and interference between frequency components further complicate the V-U discrimination. In some cases, both voiced and unvoiced sounds are produced simultaneously. Unless the speech is carefully spoken to avoid these problems, a simple frequency threshold is insufficient for applications that must detect, and respond differently to, voiced and unvoiced sounds.

Many prior methods calculate the frequency spectrum digitally, for example using FFT (fast Fourier transformation). Examples are U.S. Pat. No. 4,637,046 which analyzes digitally filtered data to detect increasing or decreasing trends that correlate with sound type, and U.S. Pat. No. 7,921,364 which defines multiple digital frequency bands for the same purpose but without the trending parameter. Spectral analysis, by FFT or otherwise, requires a fast processor and ample memory to store a large number of digitized values of the sound waveform. Transformation into the frequency domain takes substantial time, even with a powerful processor. These computational requirements are difficult for many low-cost, resource-limited systems such as wearable devices and embedded controllers. Also, extensive computation consumes power and depletes the battery, a critical issue with many portable/wearable devices. Also, as mentioned, simple frequency is a poor V-U discriminator because in actual speech the waveform is often overmodulated. In addition, speech often exhibits rapid, nearly discontinuous changes in spectrum, further complicating the standard FFT analyses and resulting in misidentification of sound type. For these reasons and others, the digitally derived spectral information is well correlated with sound type only for idealized cases. In real speech, reliance on spectral bands for V-U discrimination results in mis-identified sounds, despite using extra computational resources to transform time-domain waveforms into frequency-domain spectra.

Prior art includes many attempts to overcome these limitations of spectral analysis. Often prior methods divide the sound signal into "frames" which are brief (10-30 milliseconds, typically) portions of sound, with separate analysis of the sound in each frame. Frames may be overlapped for enhanced resolution, but this doubles the computational load. Many methods include autocorrelation or other frame-by-frame comparisons. U.S. Pat. No. 6,640,208 B1 employs autocorrelation with an adaptable threshold criterion. U.S. Pat. No. 6,915,256 B2 uses this technique to detect voiced sounds and to quantify the pitch of the fundamental. U.S. Pat. No. 6,915,257 B2 teaches autocorrelation with an adaptable frame size adjusted by feedback, resulting in different frame sizes for voiced and unvoiced sounds. U.S. Pat. No. 7,246,058 B2 extends the autocorrelation to include two separate sound signals, such as using two microphones. U.S. application Ser. No. 13/828,415 teaches autocorrelation to measure harmonicity, which tends to be higher for voiced sounds. However, strong modulation is often present in the voiced intervals with a rough voice, which complicates the autocorrelation and reduces the harmonicity in voiced sounds. The same speaker speaking the same commands may exhibit very different autocorrelation parameters if tired, or ill, or after smoking to name a few examples. Another problem is that unvoiced sounds, particularly sibilants, often have strong temporary autocorrelation and significant harmonicity, particularly if the speaker has a lisp; dental issues can cause this also. Autocorrelation is said to discriminate U and V sounds with less computational demands than spectral analysis, but in practice autocorrelation requires a large number of frames and lag parameters, which generally takes at least as much computational resources as a spectral analysis of equivalent quality. And, as mentioned, many prior art methods employ both spectral analysis and frame-by-frame autocorrelation analysis, further burdening resource-constrained systems.

Some prior methods combine multiple different analyses to improve the V-U discrimination. Each analysis typically involves multiple complex calculations and thresholds, digital filtering, autocorrelation, harmonicity, bandwidth cuts, frame-by-frame trending, and other criteria. In some cases the various criteria are applied sequentially, and in other cases the parameters are combined as a least-squares or other global fit. Examples are: U.S. Pat. No. 5,809,455 which detects peak-value changes and statistical changes in successive frames; U.S. Pat. No. 8,219,391 B2 with separate codebooks for V and U frames; U.S. Pat. No. 4,720,862 which compares the autocorrelation power with the residual power outside the autocorrelation; and U.S. Pat. No. 8,583,425 B2 which detects voiced sound as a narrowband signal, but detects unvoiced sound separately using a high frequency threshold. Reliability improvements are indeed obtained when multiple test criteria are analyzed and combined, if they have been carefully calibrated, but the computational overload is increased with each additional analysis technique, further stressing small systems. Each additional analysis also causes an additional processing delay, which becomes quite annoying when numerous criteria must be calculated using multiple software routines. And, as mentioned, each computation draws power for processor operations and memory writing, which results in reduced battery life.

A potentially important advancement is disclosed in U.S. application Ser. No. 13/610,858 which detects voiced and unvoiced sounds by applying formulas to select characteristic waveform features. Although this reference is useful as a starting point, further detail is needed showing how those formulas can be adjusted to optimize the discrimination. Also, experimental demonstration that the method has high reliability in V-U discrimination is needed.

Many prior methods employ a probabilistic model (such as HMM) or a signal-generation process (such as CELP) to model the signal, usually guided by an error-feedback algorithm to continuously adjust a model of the sound signal. U.S. Pat. No. 6,249,758 B1 is an example of signal analysis by synthesis, in this case using two generators aligned with the voiced and unvoiced components separately. In practice, however, only the voiced component can be reproduced by synthesis because the unvoiced component is too fast and too dynamic to be synthesized, at least in a practical system for a reasonable cost. And, the computational requirements of both the signal generation software and the adaptive model software greatly exceed most low-end embedded system capabilities, while the computational delays retard even the most capable processors.

Some prior methods characterize the sound with zero-crossing detection, such as U.S. Pat. Nos. 6,023,671 and 4,589,131. Zero-crossing detection is a big step in the right direction, since it works entirely in the time domain, is fast, and extracts sound information from specific waveform features directly. However, zero-crossing schemes produce insufficient waveform information, particularly when multiple frequency components interfere or when a high-frequency component rides on a lower-frequency component, which is often the case in real speech. The resulting sound signal doesn't cross zero very often. The zero-crossing distribution discards all information occurring between the zero crossings of the signal, thereby losing information that is crucial for V-U discrimination in all but the most idealized sounds.

All of the prior art methods that reliably discriminate voiced and unvoiced sounds employ either cumbersome analog electronic filters, or extensive digital processing, or large data arrays, or all three. It takes an advanced multi-core processor with a gigabyte memory, plus a radio link to a remote supercomputer, just to handle the computational demands of the prior art methods, and still there is that annoying delay. Low-cost voice-activated systems such as wearable devices and embedded controllers are usually unable to implement any of the reliable prior-art methods for discriminating voiced and unvoiced sounds. This limitation retards innovation and product development into the important nano-device market. What is needed is a method to discriminate voiced and unvoiced speech rapidly and reliably, while using extremely minimal processing and memory resources.

BRIEF SUMMARY OF THE INVENTION

The invention is a method for discriminating voiced and unvoiced sounds in speech. The inventive method comprises the following steps:

(A) Converting the speech sounds to a speech signal comprising sequential digitized values representing the sounds. Preferably the speech signal has zero DC offset. Preferably the time separation between values of the speech signal is short enough that unvoiced sounds are adequately sampled, but not so short that excessive data is produced;

(B) Integrating the speech signal to produce an integral signal. Preferably the integration step comprises additively combining sequential values of the speech signal that span a time sufficient to exclude unvoiced sounds from the integral signal;

(C) Differentiating the speech signal to produce a differential signal. Preferably the differentiation step comprises additively and subtractively combining sequential values of the speech signal that span a time sufficient to include unvoiced sounds while substantially excluding voiced sounds from the differential signal;

(D) Detecting voiced and unvoiced sounds by comparing the integral and differential signals to thresholds. Optionally the integral and differential signal may be rectified or smoothed to suppress noise and modulation. Optionally the detection of one sound type may be suppressed while the other sound type is present;

(E) And producing output signals that identify each sound interval and its sound type. Optionally the output signals may indicate the beginning or ending or duration of each sound interval. Optionally a threshold value may be varied, according to the presence or absence of sound.

Each of these process steps is explained in more detail with examples in the Detailed Description section. Computationally efficient functions are provided for each step. The results of experiments are displayed that demonstrate extremely high discrimination of voiced and unvoiced sounds. The inventive method operates entirely in the time domain. It is deterministic, speaker-independent, user-transparent, and fast. The inventive method involves no complex computations, no models, no fitting, no transformations, no synthesis, no correlations, no feedback, no frames, no data arrays, and no phase.

An object of the invention is to provide V-U information in real time, so that speech interpretation routines can identify words as they are spoken, thereby reducing processing delays. A second object of the invention is to assist in speech compression, enabling separate coding routines for voiced and unvoiced sounds, with no perceptible lag. A further object of the invention is to enable resource-constrained systems, such as wearable devices or embedded processors, to identify the sound type of a spoken command using minimal computation and memory. A further object is to support applications that recognize certain predetermined commands by evaluating the order of voiced and unvoiced intervals in the spoken command. A further object is to enable applications that require an extremely fast response to voiced and unvoiced sounds, including voice-activated timers and cameras. Further objects are to minimize processor and memory costs, minimize battery usage, and minimize peripheral electronics costs, while maintaining reliable sound-type discrimination and responsiveness.

BRIEF DESCRIPTION OF THE FIGURES

FIG. 2 is a set of graphs showing how the inventive integration is adjusted so that the integral signal includes voiced sounds while excluding unvoiced sounds.

FIG. 7 is a table listing the preferred choices for correcting the digitization period to minimize unnecessary computations.

FIG. 11 is a set of tables showing the computational resources needed to implement the inventive method, according to the detection-output protocol with the delayed-offset option, and the toggle output protocol with signal smoothing.

FIG. 27 is a table listing the computational resources needed to implement the inventive tally protocol with hysteresis, and the delayed-tally protocol with the delayed-offset option.

DETAILED DESCRIPTION OF INVENTION

Figures 1, 1A:
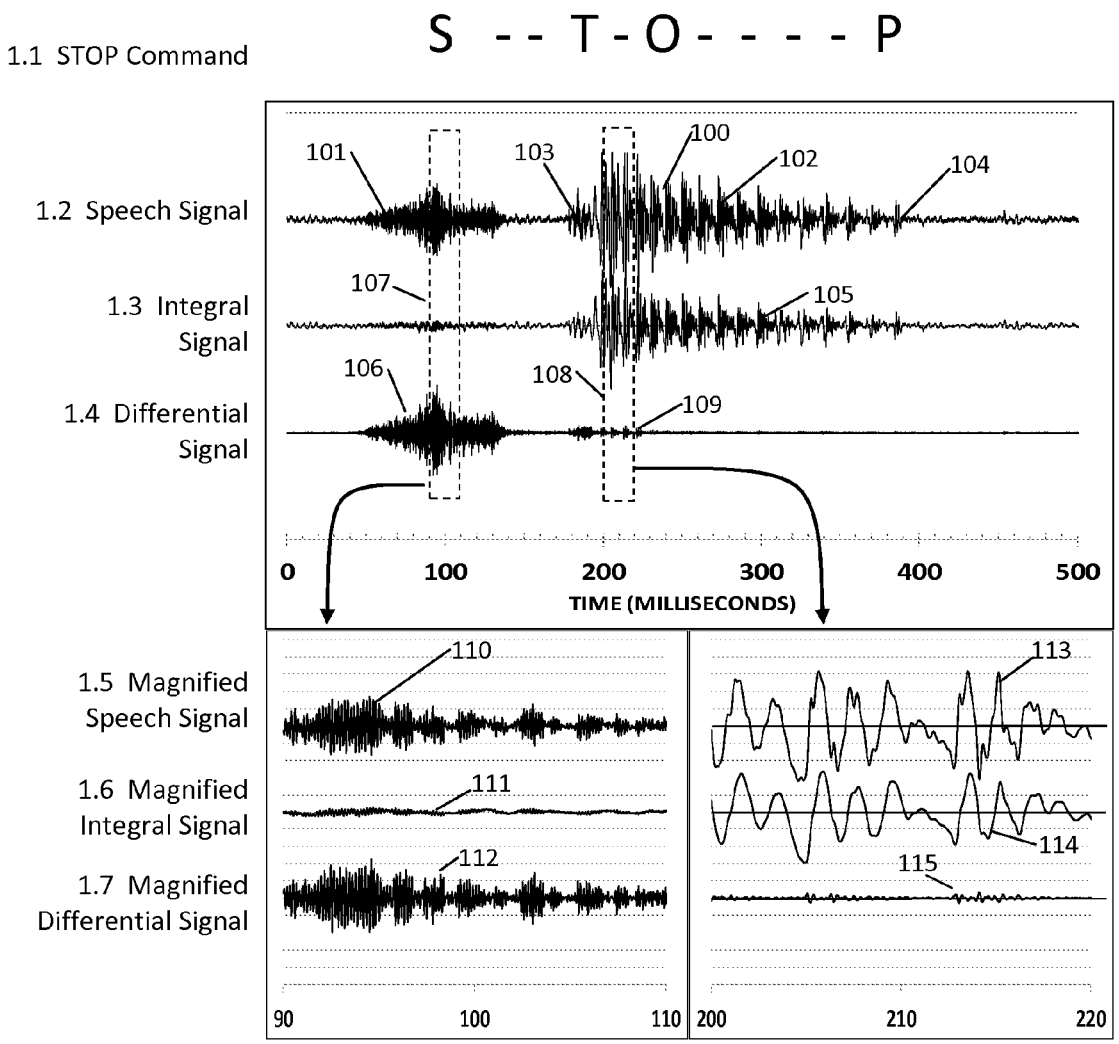
FIG. 1 is a series of graphs, similar to oscilloscope traces, showing how voiced and unvoiced sounds in the command "STOP" are discriminated using the inventive integral and differential signals.

In this section, the physics basis of the invention is explained first, including sound wavelets that comprise all speech sounds. Then, the method is illustrated using a single command and a particular digitization rate. Then, a more general optimization is presented, in which the digitization rate and the processing parameters are both varied, leading to global formulas that optimize the V-U discrimination regardless of system details or noise. Then, various means for detecting the processed sound with minimal lag, maximum sensitivity, or maximum discrimination are shown, followed by examples of output signals that demark useful features of the sound such as the starting time and ending time of each sound interval.

The Wavelet Model

The inventive method is based on the properties of wavelets that comprise all voiced and unvoiced sound. A wavelet is a single monopolar variation or excursion in a signal or waveform representing the sound. Typically a wavelet appears as a rounded pulse-like or peak-like shape in the speech signal. In a pure tone, a wavelet is a half-period (not a full cycle) of oscillation. Speech is far more complicated than a tone, but can always be decomposed into wavelets with various amplitudes and durations. Typically the speech signal includes wavelets with durations spanning a range of 0.05 to 5 milliseconds. Wavelets are often decorated with smaller wavelets having lower amplitudes and/or shorter durations. Some speech produces a pseudo-sinusoidal waveform, while other sounds consist entirely of solo wavelets occurring separately, positive and negative wavelets seemingly at random, and not part of a sinusoidal oscillation in the sound waveform.

The wavelets of voiced sound are quite distinct from those of unvoiced sound. Wavelets of voiced sound have a duration of 0.25 to 5 milliseconds typically, and are termed "slow" wavelets herein. Wavelets of unvoiced sound have a duration of typically 0.05 to 0.15 milliseconds and are termed "rapid" wavelets. The correlation between the wavelet duration and the V-U sound type is independent of the speaker, the command, the sound amplitude, any backgrounds or noise or interference. Unlike the prior-art zero-crossing analysis, the inventive wavelet analysis does not require that the sound waveform cross zero or any other particular level. Unlike prior-art FFT and other spectral analysis methods, the inventive method does not require long-term coherency or even sinusoidal components in the sound. With a simple pure tone, the wavelet analysis provides the same discrimination result as spectral analysis, but faster. Unlike prior-art model-fitting and synthesis routines, the invention provides reliable voiced and unvoiced output signals upon detecting the first few wavelets of each sound interval.

Converting Sound to a Speech Signal

The first step in the inventive method (Step A) is converting sound into a speech signal. The speech signal is a series of digital values representing the sound, preferably having zero DC offset, and preferably having a temporal spacing between values that allows both voiced and unvoiced wavelets to be adequately detected. Usually, the sound is converted to an analog electrical signal using a microphone or other transducer. Then the analog signal is amplified and optionally filtered. If filtering is done, the filter should pass a band that extends from about 100 Hz to 10 kHz, or more preferably from 85 Hz to 16 kHz, while excluding noise outside that band. If amplifying is done, a gain of 20 to 60 dB is usually sufficient, depending on the sensitivity of the microphone and the properties of the digitizer.

The analog signal is then digitized, or converted to a digital signal termed the digitizer-output signal. Normally the digitizer is an ADC (analog-to-digital converter) operating at a particular digitization rate. The temporal spacing between digitizer-output values, termed the digitizer-output period or Tdigitizer, is the inverse of the digitization rate. For most mobile phones, the digitization rate is 22 to 44 kHz roughly, corresponding to Tdigitizer=0.023 to 0.045 milliseconds. Here, and throughout this document, time periods and frequencies are rounded for convenience; hence 0.045 is not exactly equal to twice 0.023.

The speech signal is then derived from the digitizer-output signal, by subtracting any DC offset and adjusting the temporal spacing of the values. Preferably the temporal spacing between the speech signal values, termed the data period or Tdata, is in a preferred range that provides sufficient sampling of the rapid wavelets. A fast digitization rate may generate unnecessary measurement data, in which case some values of the digitizer-output signal may be discarded or averaged, so as to produce a speech signal with Tdata in the preferred range. In some applications the speech signal values are not periodically spaced, in which case the terms Tdata and data period refer to the average temporal spacing between values of the speech signal.

The digitizer-output signal often includes a DC or slowly-varying offset, due to analog electronics offsets or the function of the digitizer itself. Therefore the inventive method includes means for calculating and subtracting an offset signal. Normally the offset signal is calculated as a running average of the digitizer-output signal. A running average of a data stream is an average obtained by additively combining sequential values of the data stream, and then updating the average value when each new element of the data stream arrives. Thus to calculate the offset signal, sequential values of the digitizer-output signal are averaged or otherwise additively combined, and the running average is updated according to each averaging result. The values contributing to the running average span a particular time range termed the offset span or simply Toffset. The running average may be a rectangular or "box-car" average of the most recent values, in which case the offset span equals (N−1) times the digitizer period, or $$Toffset=(N-1)*Tdigitizer \quad \text{Eq. 1}$$

where N is the number of values averaged, and Tdigitizer is the temporal separation between values of the digitizer-output signal. The running average could alternatively be a weighted average, or some other combination of the digitizer-output values. If the running average is an exponentially-weighted average, Toffset is the exponential time constant of the weighting function. Many examples of running averaging techniques appear in the prior art.

The most preferable running average protocol is "incremental" averaging, which is an extremely compact and effective integration protocol that generates an exponentially-weighted running average of a data stream, while using minimal system resources. In incremental averaging, an updated average is calculated by adding a small fraction of each new value of the data stream to the prior average, and then preferably normalizing so that the scale of the average is the same as the scale of the data stream. For example, the offset signal Offset(i) can be calculated using the following equation:

$$\text{Offset}(i)=\text{Offset}(i-1)*(1-F\text{offset})+v(i)*F\text{offset} \quad \text{Eq. 2}$$

where i is an index, Offset(i) is the updated value of the offset signal, Offset(i−1) is the previous value of the offset signal before it is updated, v(i) is the most recent value of the speech signal. Foffset is a number, greater than 0 and less than or equal to 0.5, that determines the span of the incremental average. Normally Foffset is set equal to the temporal spacing of the digitizer-output values (Tdigitizer) divided by the desired averaging span (Toffset), as shown in Eq. 3:

$$F\text{offset}=T\text{digitizer}/T\text{offset} \quad \text{Eq. 3}$$

Normally the temporal spacing is much smaller than the averaging span, in which case the multiplier Foffset is small (Foffset<<1). A small value for F implies that a large number of the data values will contribute to the running average. When Foffset is small, each value of the updated average is derived primarily from the previous average, but with a small shift equal to Foffset times the most recent data value. If Foffset is as large as 0.5, then Eq. 3 implies that the averaging span includes only two values of the data stream, in which case it is usually simpler to combine the most recent two values directly, rather than performing the incremental averaging. If Foffset is greater than 0.5, the formula loses utility because little or no averaging is performed.

The invention includes all mathematically equivalent variations of the equations provided herein. For example, a variation of Eq. 2 could involve division by a number X instead of multiplication. The incremental averaging formula then becomes as Eq. 4:

$$\text{Offset}(i)=(\text{Offset}(i-1)+v(i)/X)/(1+1/X) \quad \text{Eq. 4}$$

Eq. 4 appears to be quite different from Eq. 2 since each new data value is divided by X. However, the offset signal obtained with Eq. 4 is identical to that produced with Eq. 2 if X=(1−Foffset)/Foffset. Therefore Eq. 4 is equivalent to Eq. 2. As another example, all of the terms in Eq. 2 or Eq. 3 could be doubled, or scaled by some other factor, without substantially changing the resulting average. Such immaterial modifications of the formulas do not affect their performance in discriminating voiced and unvoiced sounds, and therefore all such modifications are included in the inventive method along with the formulas explicitly displayed.

Incremental averaging provides many advantages over prior art methods for calculating a running average. Incremental averaging generates an exponentially weighted average and has the desired time distribution in which the most recent data is emphasized over the older data values, and with the desired span provided that Foffset is chosen according to Eq. 3. Also the coefficients sum to unity, which ensures that the scale of the resulting average is the same as the scale of the input data. Prior-art averaging strategies carry huge amounts of data, whereas the incremental averaging method carries only a single variable (the updated average) and two constants (Foffset and the value of 1−Foffset, which is calculated only once). The constants could be kept in system ROM (read-only memory) while only the updated average value needs to be kept in system RAM (random-access memory) or processor cache, which saves in expense (ROM is cheaper) and in power (ROM uses essentially no power). The inventive incremental averaging method also saves processor time since the incremental average uses only two multiplications and one addition for each update, whereas prior-art methods for calculating a running average of N values typically involve at least N operations per update, and often much more, to produce a result with no greater validity.

It is not necessary to calculate the offset signal with each new value of the digitizer-output signal. Since the offset signal varies slowly, or not at all, the offset signal may be calculated less often, for example just once in a time termed Tupdate. The option to calculate the offset signal less often than Tdata is termed the delayed-offset option. The advantage of the delayed-offset option is that it reduces the computation demands. Tupdate is preferably not so long that electronic or thermal drifts are missed. Typically Tupdate is in the range of 1 to 10 milliseconds, although in stable systems it could safely be made much longer such as 1 to 10 seconds. With the delayed-offset option, only a small fraction of the digitizer-output values are used to calculate the offset signal, but the offset signal is nevertheless precisely determined by those contributing values.

FIG. 1 illustrates the speech signal, the integral signal, and the differential signal for the command word "STOP". FIG. 1 comprises three portions, FIGS. 1*a*, 1*b*, and 1*c*, each showing various sound signals associated with the inventive analysis. FIG. 1*a* is a series of traces similar to oscilloscope traces, with the signal voltage or digital value on the vertical axis and time proceeding to the right. The traces were recorded using an LG Optimus G mobile phone with a data period of about 0.045 milliseconds (digitization frequency of 22050 Hz), but most mobile devices would show substantially the same signals.

First, in Trace 1.1, the command "STOP" is spelled out, but with the letters spread out so that they correspond horizontally to the other traces. Trace 1.2 shows the speech signal 100, recorded while the "STOP" command was spoken by a male speaker. The speech signal 100 includes the rapid wavelets 101 of the unvoiced "S" sound, followed by a variety of low-amplitude wavelets 103 during the very faint "T" sound, followed by slow wavelets 102 of the voiced "O" sound. There is no discernible sound where the terminal "P" 104 would occur. It is common for a closing unvoiced plosive such as the "P" to produce little or no sound, particularly if it occurs at the end of a word. It is also common for an unvoiced "T" to produce little sound if it occurs before a voiced sound such as "O". One could, with some effort, say the command so as to generate sound in every letter, for example by aspirating all the plosives explicitly, however this would sound harsh and questionably sane.

Trace 1.3 shows the integral signal 105, obtained by applying the inventive integration procedure. In the integral signal 105, the rapid wavelets 101 of the unvoiced "S" are almost completely excluded, while the slow wavelets 102 of the voiced "O" sounds are present with only a slight reduction due to the integration. Thus the integral signal 105 includes the voiced sounds while excluding unvoiced speech.

Trace 1.4 shows the differential signal 106 obtained by applying the inventive differentiation procedure. The unvoiced "S" sound appears in the differential signal 106, while the voiced "O" sound is excluded. Hence the differential signal 106 includes the rapid wavelets of unvoiced sound while excluding the slow wavelets of voiced sound. A very small amount of wavelets 109 remain in the differential signal 106 during the "O" sound, due to turbulence continuing after the opening "T" sound, or possibly to high overtones above the voiced wavelets 102.

FIG. 1*a* also includes a dashed rectangle 107 demarking a 20 millisecond portion during the unvoiced "S" sound, and another dashed rectangle 108 demarking a 20 millisecond portion during the voiced "O" sound. The traces in these rectangles are reproduced in FIGS. 1*b* and 1*c*, but magnified in time.

FIG. 1*b* shows the same signals as FIG. 1*a*, but with the time scale magnified and shifted to show only the 90-110 millisecond region of rectangle 107, which is during the "S" sound. Trace 1.5 in FIG. 1*b* shows the magnified speech signal 110 during the "S" sound, which exhibits rapid wavelets as expected for an unvoiced sound. Trace 1.6 in FIG. 1*b* shows the integral signal 111 during the "S" sound, which has almost no activity since the integration step effectively averages over and excludes the rapid wavelets of unvoiced sound. Trace 1.7 in FIG. 1*b* is a magnified view of the differential signal 112 during the "S" sound, which exhibits rapid wavelets substantially unchanged from those of the speech signal 110, thereby demonstrating that the rapid wavelets of the "S" sound are included in the differential signal 112.

FIG. 1*c* shows the same signals as FIG. 1*a* and FIG. 1*b*, but with the time scale shifted to the 200-220 millisecond region of the rectangle 108, which is during the "O" sound. Trace 1.5 in FIG. 1*c* shows the speech signal 113 which includes large, slow wavelets of the voiced "O" sound. Trace 1.6 in FIG. 1*c* shows the integral signal 114 comprising slow wavelets with nearly the same amplitude as the original speech signal 113, and excluding rapid wavelets. Trace 1.7 in FIG. 1*c* shows the differential signal 115 during the "O" sound, showing very little activity since the differentiation step nearly cancels the slow wavelets of voiced sound. The traces of FIGS. 1*b* and 1*c* demonstrate that the inventive integration step selectively includes voiced sounds, and that the inventive differentiation step selectively includes unvoiced sounds.

Optimization of Integration Step

The second step of the inventive method (Step B), after calculating the speech signal, is integrating the speech signal to derive an integral signal that includes the slow wavelets of voiced sound while excluding the rapid wavelets of unvoiced sound. Integrating the sound signal comprises additively combining sequential values of the speech signal that span a time termed the integration span or Tinteg. Preferably the integration comprises a running average, and preferably the integration span is adjusted to include the slow wavelets while excluding the rapid wavelets from the integral signal. The integration can be carried out as a rectangular or weighted average or any other averaging or integrating protocol. For example the integral signal could be a rectangular average of the speech signal values, using formulas such as Eq. 5 and 6:

$$\text{Integral}(i)=\Sigma v(j)/Nav \text{ [for } j=i,i-1, \ldots i-Nav+1] \quad \text{Eq. 5}$$

$$Nav=(T\text{integ}/T\text{data})+1 \quad \text{Eq. 6}$$

where Integral(i) is the updated value of the integral signal comprising a running average of the speech signal, v(j) represents the speech signal value with index j, Nav is the number of samples that are averaged to produce the integral signal, i is an index for the current value of the sound signal, and j is an index of Nav sequential values running from i to (i−Nav+1) inclusive.

Alternatively, the integral signal can be obtained by incremental averaging, as shown in Eq. 7 and 8:

$$\text{Integral}(i)=v(i)*F\text{integ}+\text{Integral}(i-1)*(1-F\text{integ}) \quad \text{Eq. 7}$$

$$F\text{integ}=T\text{data}/T\text{integ} \quad \text{Eq. 8}$$

where Integral(i) is the updated value of the integral signal, Integral(i−1) is the previous value of the integral signal, and Finteg sets the integration averaging time. Finteg should be adjusted so that the integral signal includes the slow wavelets and excludes the rapid wavelets.

FIG. 2 shows how to set the integration span for optimal discrimination. The integral signal in this example was obtained by averaging sequential values of the speech signal using the incremental averaging formula of Eq. 7, but using various different values for the integration span Tinteg in Eq. 8. FIG. 2*a* again shows the command word "STOP" in Trace 2.1 with the letters spread out, and the corresponding speech signal is shown in Trace 2.2.

Traces 2.3 through 2.8 show the integral signal obtained by integrating the speech signal using integration spans ranging from 0.1 millisecond in Trace 2.3, to 1 millisecond in Trace 2.8. The traces show how the integration span affects the unvoiced "S" sound and the voiced "O" sound. The "S" sound is suppressed in Trace 2.3, and increasingly so in the other traces where longer integration spans are used. The voiced "O" sound, however, is substantially unchanged by the integration, showing only a partial attenuation at the very largest span values. This chart demonstrates that the integration step includes the slow wavelets of voiced sound while substantially excluding the rapid wavelets of unvoiced sound, if the integration span is long enough.

FIG. 2*b* shows how the maximum amplitude of the integral signal varies for voiced and unvoiced sounds, versus the integration span. The curves in FIG. 2*b* show the maximum value of the rectified integral signal for the "O" (upper curve) and "S" (lower curve) sounds, versus the integration span. The curves are normalized to (that is, divided by) the maximum rectified speech signal in the same regions. The data for each curve in FIG. 2*b* were obtained by integrating the speech signal using a particular value for the integration span in the range of 0.1 to 1 milliseconds, then rectifying, then finding the maximum value within the "S" or "O" sound intervals, and then dividing by the maximum of the unprocessed speech signal in the same region.

The upper curve in FIG. 2*b*, labeled "During O sound", shows the maximum rectified integral signal during the "O" sound, versus the integration span. The voiced sound amplitude declines slowly as the integration span is increased because the slow wavelets have a duration greater than the integration span, up to a span of about 0.5 milliseconds. Then at the highest value, 1 millisecond, the amplitude of the "O" sound is reduced by about half. This suggests that an integration span of 1 millisecond is too long for many of the voiced-sound wavelets.

The lower curve in FIG. 2*b*, labeled "During S sound", shows the integral signal of the "S" sound versus integration span. Since the "S" is unvoiced, its integral signal is expected to be very low or zero. The chart shows that the integration step reduces the "S" sound by a factor of 5 to 10, for integration spans of 0.2 millisecond or greater. With an integration span of only 0.1 millisecond, however, the unvoiced amplitude is only partially attenuated, which suggests that an integration span of 0.1 millisecond is too short to exclude the rapid wavelets.

FIG. 2*c* shows the same data as FIG. 2*b*, but processed to show a ratio and a signal difference. The upper curve in FIG. 2*c*, labeled "Ratio O/S", shows the ratio of the integral signal maxima during the "O" and "S" sounds. For optimal contrast between the V and U sound types, that ratio should be high. The chart shows that the ratio of the normalized voiced to unvoiced sound, increases from 1 (for unprocessed speech sound), up to about 6 for the longest integration spans.

The second curve in FIG. 2*c*, labeled "Difference O−S", shows the difference between the voiced and unvoiced sounds, obtained by subtracting the rectified and normalized maximum during the "O" sound minus that of the "S" sound. (For graphical clarity, this difference is multiplied by 2 in FIG. 2*c*.) The optimal SNR (signal-to-noise ratio) is obtained when this difference is as large as possible. The difference between the signals increases to about 1.5 on the normalized scale, and then declines for higher span values, due to the attenuation of the voiced wavelets when the integration span is too large.

The curves of FIG. 2 indicate that an integration span in the range of 0.2 to 0.3 milliseconds would optimize the exclusion of unvoiced sounds while including voiced sounds. The attenuation of unvoiced sounds is nearly complete within that range, but the loss of voiced sounds is minimal. Combined with many other examples, and with experience using other speakers and command sounds, the most preferred value of the integration span is selected as 0.25 milliseconds, which is shown by a small triangle in each chart. Interestingly, this is the lower bound on the range of durations of the slow wavelets of voiced sound. The longer wavelets, up to 5 milliseconds duration, are also passed efficiently by an integration with Tinteg=0.25 milliseconds; hence the entire range of voiced wavelets is included in the integral signal, as desired. Other integration methods, such as rectangular averaging, lead to similar values for the preferred integration span in the range of 0.2 to 0.3 milliseconds.

FIG. 2 demonstrates that the inventive method successfully excludes unvoiced sound while including voiced sound in the integral signal, so long as the integration span is in the range of 0.2 to 0.3 milliseconds. Preparation of the integral signal completes Step B of the inventive method.

Differentiation to Exclude Voiced Sound

The next step of the inventive method (Step C) is to differentiate the speech signal, thereby producing a differential signal that includes the rapid wavelets but excludes the slow wavelets. Differentiation comprises additively and subtractively combining a number Ndif of sequential values of the speech signal. Those Ndif values span a time termed the differential width or Tdif, equal to the time difference between the first and last value in the differential. The inventive method provides a computationally efficient means for differentiating a signal, by use of a discrete differential formula. A discrete differential formula specifies how to additively and subtractively combine sequential values of a data stream, to produce a differential signal that emphasizes the most rapidly-changing variations of the input data. Numerous discrete differential formulas exist, differing by order (first-order, second-order and so forth), the number of values participating in the differential formula (Ndif), and the differential width of those values (Tdif). A first-order discrete differential is equivalent to a first derivative, which gives the slope of the data. A second-order discrete differential emphasizes the second derivative or curvature of the data, and so forth for higher orders. The number of values participating in the discrete differential, Ndif, is usually between 2 and 6. Ndif=1 is simply the unprocessed speech signal, and Ndif>6 becomes cumbersome. The differential width, Tdif, is the time between the first and last values in the formula, which is equal to the temporal separation Tdata between values of the speech signal, times the number of spaces between those Ndif values:

$$Tdif=Tdata*(Ndif-1) \quad \text{Eq. 9}$$

The following equations show five low-order discrete differentials D(Ndif), with Ndif ranging from 2 to 6. These differential formulas all select the most rapidly varying wavelets in the sound, and thus are candidates for differentiating the sound signals to identify rapid wavelets of unvoiced sound. The discrete differential formulas are:

$$D(2)=[v(i)-v(i-1)]/2 \quad \text{Eq. 10}$$

$$D(3)=[v(i)-2*v(i-1)+v(i-2)]/4 \quad \text{Eq. 11}$$

$$D(4)=[v(i)-v(i-1)-v(i-2)+v(i-3)]/4 \quad \text{Eq. 12}$$

$$D(5)=[2*v(i)-v(i-1)-2*v(i-2)-v(i-3)+2*v(i-4)]/8 \quad \text{Eq. 13}$$

$$D(6)=[2*v(i)-v(i-1)-v(i-2)-v(i-3)-v(i-4)+2*v(i-5)]/8 \quad \text{Eq. 14}$$

where the v(i) and so forth are sequential values of the speech signal, and each D(Ndif) stands for a discrete differential that includes Ndif data values. As an alternative, Eq. 13 and 14 can be rewritten as follows:

$$D(5')=[2*[v(i)-v(i-2)+v(i-4)]-v(i-1)-v(i-3)]/8 \quad \text{Eq. 15}$$

$$D(6')=[2*[v(i)+v(i-5)]-v(i-1)-v(i-2)-v(i-3)-v(i-4)]/8 \quad \text{Eq. 16}$$

The alternate forms Eq. 15 and 16 provide the same outputs as Eq. 13 and 14 but require fewer arithmetic operations.

In each differential formula, the signed coefficients of the various terms conveniently sum to zero, thereby avoiding any unwanted amplitude-dependent offset in the result. Also, the unsigned coefficients sum to 1, which ensures that the scale of the discrete differential output is the same as that of the data stream. Also, every multiplication and division involves an exact power of 2 (that is, 2, 4, 8, etc). It is trivial for processors to perform such multiplications and divisions, by simply shifting the binary operand left or right, as is well known in the computational arts.

Figure 3:
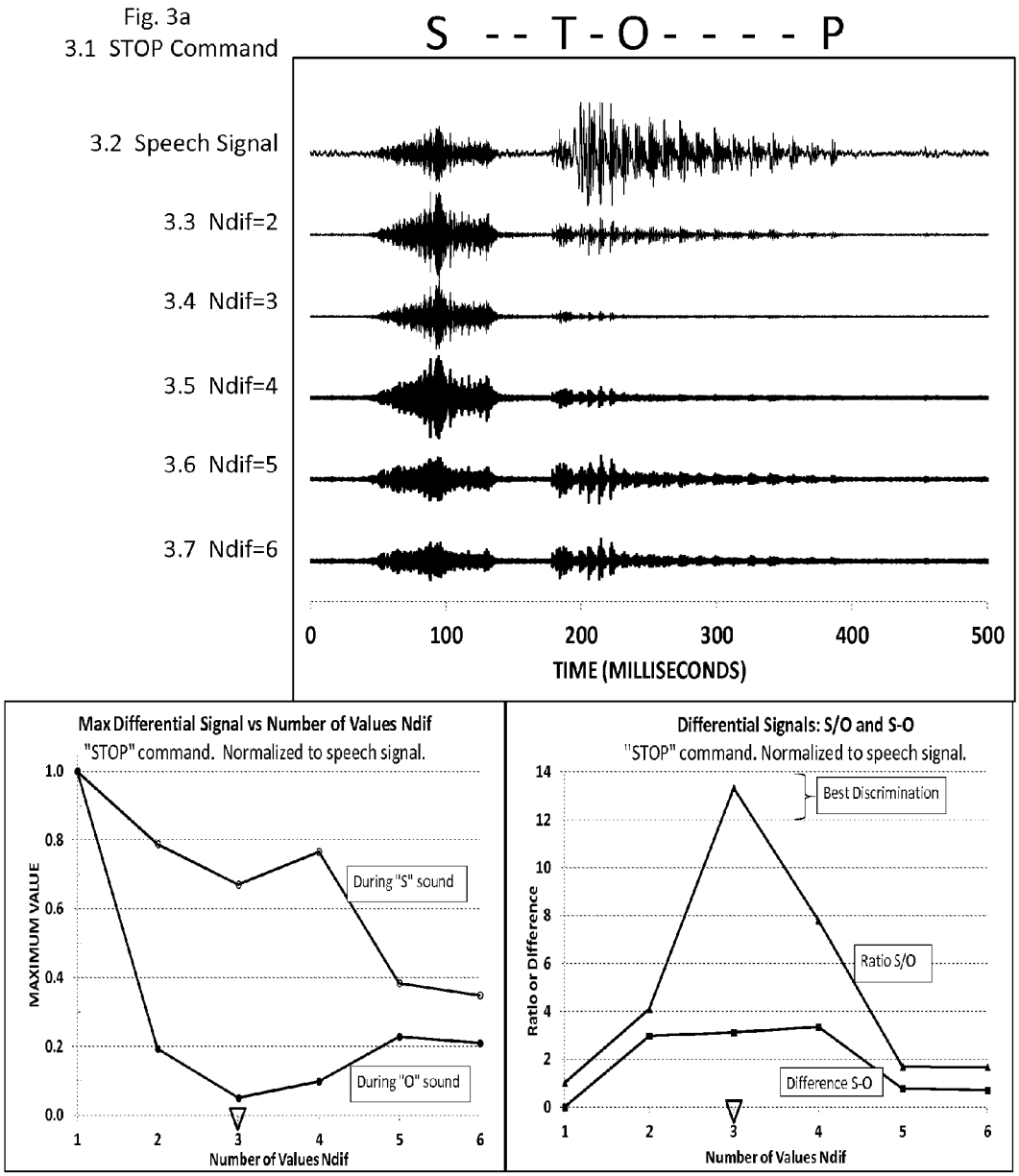
FIG. 3 is a set of graphs showing how the inventive differentiation is adjusted so that the differential signal includes unvoiced sounds while excluding voiced sounds, at a particular digitization rate.

FIG. 3 shows how the differentiation step may be optimized for a particular value of Tdata, in this case being 0.045 milliseconds. (Other digitization rates are explored in subsequent examples.) The command "STOP" was analyzed according to each of the discrete differential formulas in Eq. 10 through 14, and the discrimination effectiveness of each formula was tested by taking the ratio of the unvoiced to voiced sounds. In FIG. 3*a*, Trace 3.1 shows the STOP command, and Trace 3.2 shows the speech signal, same as in FIG. 2. Traces 3.3 through 3.7 show the differential signals obtained using the formulas of Eq. 10 through 14. These formulas include Ndif values of the speech signal, with Ndif=2 to 6 for traces 3.3 to 3.7 respectively. (Also, Traces 3.3 through 3.7 are expanded vertically by a factor of 2, relative to the speech signal, for graphical clarity.)

In Trace 3.3, the sound signal is differentiated with the simplest 2-point slope function of Eq. 10, which is a first-order function with only two values of the speech signal, or Ndif=2. This differential formula rejects some of the voiced sound of the "O", although a substantial amount of the slow wavelets still get through. This indicates that a first-order differential is not sufficient to cleanly exclude voiced sounds from the differential signal. The unvoiced "S" sound in Trace 3.3 is hardly changed relative to the unprocessed speech signal, which is expected since the differentiation largely passes the rapid wavelets.

In Trace 3.4, the differential function is Eq. 11 (second-order, with Ndif=3) and clearly is much more effective. The voiced sound is reduced to nearly background level, while the "S" sound remains unchanged. Then, in Traces 3.5-3.7 (Ndif=4, 5, 6 respectively, all second-order), the "O" sound again breaks through, which indicates that the higher values of the differential width are too long to exclude the slow wavelets. Also the "S" sound becomes substantially attenuated for Ndif=5 and 6, further indicating that these long differential functions are not suitable for optimal discrimination, at least with a data period Tdata of 0.045 milliseconds.

FIG. 3*b* shows the maximum rectified differential signal during the "S" and "O" sounds, normalized to the unprocessed speech signal, versus the number of speech signal values Ndif in the discrete differential. On the horizontal axis, "1" represents the unprocessed speech signal, "2" indicates the Ndif=2 differential function, and so forth, as given in Eq. 10-14. The vertical axis shows the maximum of the rectified differential signal within the "S" or the "O" sound, divided by that of the unprocessed speech signal in the same region. The upper curve in FIG. 3*b*, labeled "During S sound", shows that the amplitude of unvoiced sound is roughly constant up to Ndif=4 differentiation, but then drops substantially for Ndif=5 and higher. This suggests that the optimal form of differentiation to preserve the rapid wavelets should be in the range of Ndif=2-4.

The lower curve of FIG. 3*b*, labeled "During O sound", shows the partial attenuation of voiced sound by the Ndif=2 differentiation, and nearly complete attenuation of the "O" sound by Ndif=3, but then a return of the "O" sound for Ndif=4-6. This suggests that Ndif=3 differential would be best, to exclude voiced sounds.

FIG. 3*c* shows the ratio of the differential signal maximum with voiced and unvoiced sound, and the difference between the two signals. The horizontal axis is again Ndif, the number of speech signal values in the formula. All values are again normalized to the speech signal. The upper curve in FIG. 3*c*, labeled "Ratio S/O", shows the ratio of the unvoiced to voiced sound amplitude in the differentiated signal obtained with each value of Ndif. The ratio rises to a maximum with Ndif=3 and then declines for higher values of Ndif, due to the penetration of the voiced wavelets with the higher-Ndif formulas.

The lower curve in FIG. 3*c*, labeled "Difference S−O", shows the difference between the normalized differential signal values of the "S" minus the "O" sounds (times 2, for graphical clarity). The difference between the "S" and "O" signals rises and remains roughly constant for the Ndif=2-4 formulas, but falls for the higher Ndif values, thus indicating that Ndif>4 would be too wide to admit the rapid wavelets. The curves clearly indicate that the optimal differential function, for a data period of 0.045 milliseconds, is the Ndif=3 formula of Eq. 11, since it excludes the voiced sound while only minimally attenuating the unvoiced sound. A small triangle indicates this choice in both charts.

The example of FIG. 3 shows how the differentiation can be optimized for a particular value of the data period. However, the digitization rate of embedded devices varies widely, at least over the range of Tdata=0.023 to 0.113 milliseconds (corresponding to about 44 to 9 kHz digitization rate). Therefore the analysis of FIG. 3 was repeated for six different values of Tdata. First, the "STOP" command was recorded using the fastest common mobile phone digitization rate, thereby producing a digitizer-output signal with Tdigitizer=0.023 milliseconds. Then, a first speech signal was obtained from the digitizer-output signal (after subtracting the offset signal), thereby generating a first speech signal with Tdata=0.023 milliseconds. Then, a second speech signal was prepared by averaging and discarding selected values of the digitizer-output signal, thereby generating a second speech signal with Tdata=0.034 milliseconds. Then a third speech signal was prepared by discarding more of the original values, thereby obtaining a speech signal with Tdata=0.045 milliseconds. Continuing in this fashion, six speech signals were derived from the same command and the same digitizer-output signal, by discarding some of the values, thereby obtaining speech signals with Tdata values of 0.113, 0.091, 0.068, 0.045, 0.034, and 0.023 milliseconds (corresponding to about 9, 11, 15, 22, 29, and 44 kHz digitization rates respectively). Then, each of these sound signals was differentiated, using each of the differential functions of Eq. 10-14, to determine how each function performed at discriminating voiced and unvoiced sound. It was expected that the optimal function would depend on the Tdata period of the speech signal. However, faster digitization does not necessarily lead to better V-U discrimination, and it tends to overload the processor. Ideally, the speech signal would include just enough measurements of the rapid wavelets to register the unvoiced sound reliably. There is no need to oversample the rapid wavelets. Also, a slower ADC (but still sufficient to detect rapid wavelets) would consume less battery power, and usually cost less, than a faster ADC.

Figure 4:
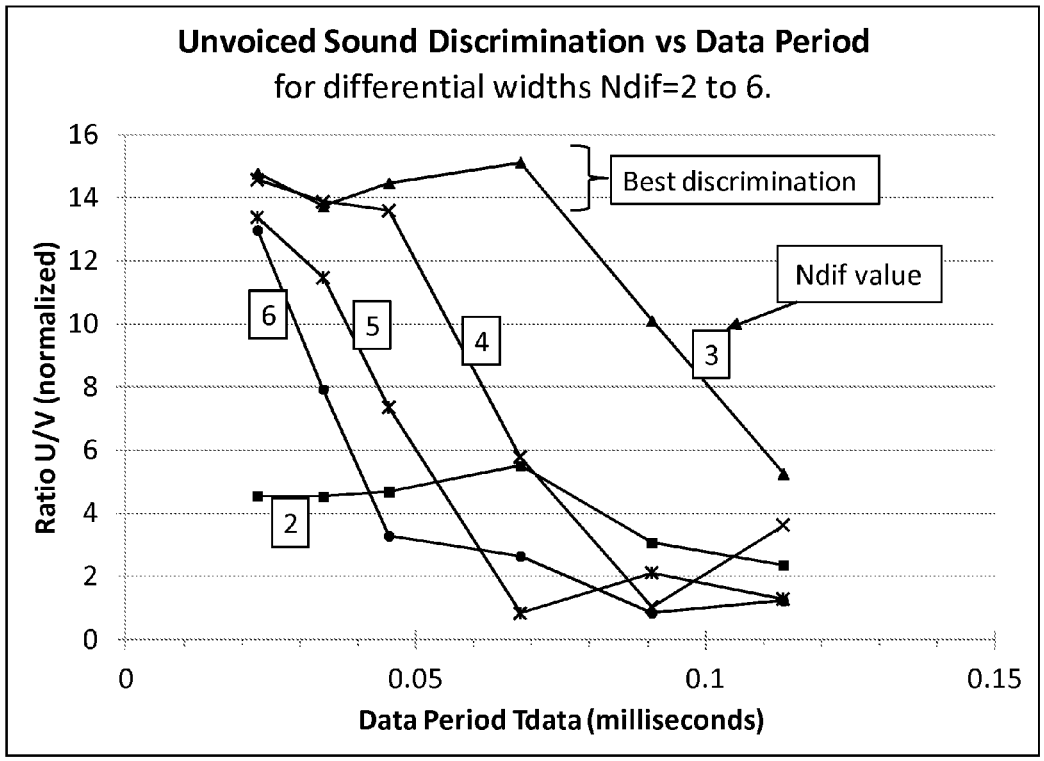
FIG. 4 is a graph showing how the inventive differentiation depends on the sound digitization rate.
Figure 5:
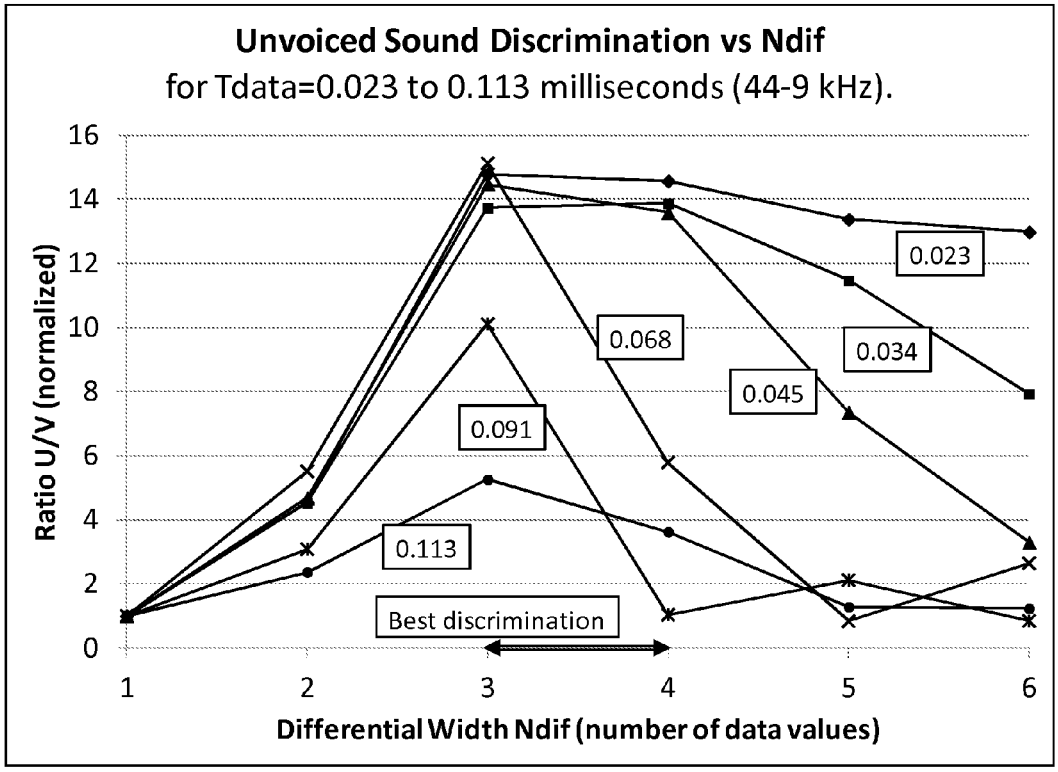
FIG. 5 is a graph showing how the inventive differentiation depends on the number of digital values in the differential function.
Figure 6:
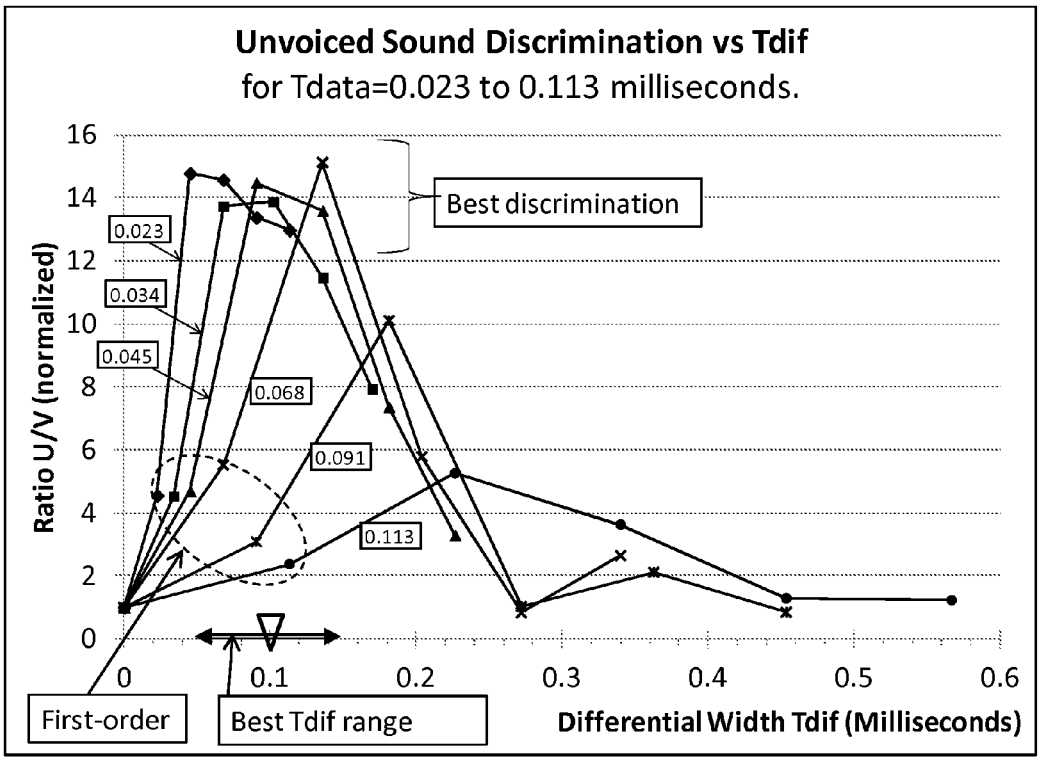
FIG. 6 is a graph showing how the inventive differentiation depends on the temporal width of the differential function.

FIGS. 4, 5, and 6 show the results of this test, to compare each of the differential formulas with Ndif=2-6, using the different speech signals with Tdata of 0.113-0.023 milliseconds. In FIG. 4, the ratio of the unvoiced to voiced amplitudes U/V is shown as a function of the data period Tdata of the speech signal. The voiced and unvoiced amplitudes are the maximum rectified differential signals during the "S" and "O" sounds respectively, as described with FIG. 3. The ratio is plotted versus Tdata, with Tdata ranging from 0.023 to 0.113 milliseconds. Each curve corresponds to one of the differential functions, labeled according to their Ndif values (Ndif=2 through 6). A high value of the ratio indicates good discrimination, while a low value indicates little or no discrimination. The desired range of performance is indicated at the top by "Best discrimination".

The Ndif=2 curve of FIG. 4 barely exceeds a ratio of 5, regardless of the Tdata range. This shows that the first-order differential is not able to separate voiced and unvoiced wavelets effectively at any of the digitization rates tested.

The Ndif=3 curve does quite well, rising to the "Best discrimination" range for all the Tdata values from 0.068 to 0.023 milliseconds, and only falling with the longest Tdata values of 0.091 and 0.113 milliseconds.

The Ndif=4, 5, and 6 curves also reach, or nearly reach, satisfactory performance, however they reach that performance only for the fastest ADC rates (that is, the smallest Tdata values). This is because the width of a differential function is proportional to the number of spaces between the points, so a higher value of Ndif leads to a wider differential span. If the differential is stretched across a wide span, it becomes too wide to detect the most rapid wavelets.

Turning to FIG. 5, the data of FIG. 4 are analyzed from a different perspective, now with the number of values Ndif on the horizontal axis. The "1" on the horizontal axis corresponds to the unprocessed speech signal, the "2" is for Ndif=2, and so forth up to Ndif=6.

Each curve in FIG. 5 shows the U/V ratio obtained with one of the Tdata values, and each curve is so labeled, with the Tdata of that speech signal (in milliseconds). The lowest curve in FIG. 5, for Tdata=0.113 milliseconds, remains low regardless of Ndif; therefore the slowest ADC (9 kHz) is barely able to discriminate U and V sounds by this method regardless of the differential formula used.

The highest curve, for Tdata=0.023 milliseconds remains quite high for all of the differential formulas other than Ndif=2. Thus the high speed ADC is quite versatile and can accommodate any of the second-order formulas, although the Ndif=3 results seems to be best.

The other curves, obtained with Tdata of 0.034, 0.045, 0.068, and 0.091 milliseconds, all exhibit their best performance with Ndif=3 (that is, Eq. 11). This indicates that Ndif=3 is the best formula overall. In addition, and surprisingly, the discrimination ratio is high and virtually identical for all four Tdata cases from 0.068 to 0.023. Indeed, the data points nearly overlap for Ndif=3 for all those Tdata cases. This strongly indicates that there is no need to use a high frequency ADC for voiced-unvoiced discrimination, since a lower-speed ADC provides the same V-U discrimination performance.

The second interesting result revealed in FIG. 5 is that the Ndif=3 formula is optimal for every curve, regardless of the Tdata of the speech signal. Even the slow 0.091 and 0.113 millisecond signals exhibit their best performance with the Ndif=3 formula. This strongly indicates that just one differential formula (Eq. 11) is optimal for all devices regardless of their digitization rates; therefore there is no need to adapt the differential function to different digitization rates. The same universal function can be used for all devices to derive a differential signal with high discrimination capability.

In summary, FIG. 5 indicates two surprising facts: First, that there is no need for a fast ADC since the same level of discrimination is obtained with a moderate data rate; and second, that there is no advantage in using higher-Ndif differential formulas, since the best performance is obtained in every case with Eq. 11, for all of the Tdata values tested.

FIG. 6 shows the explanation for these counter-intuitive results. Here the same data is plotted, but now with the differential width Tdif on the horizontal axis instead of Ndif. Tdif, the time between the first and last speech signal values in the differential, determines which wavelets are included in the resulting differential signal. Each curve in FIG. 6 corresponds to a single value of Tdata, and is labeled as Tdata in milliseconds, similar to the curves of FIG. 5. Each point on the curve corresponds to a different formula, starting with Ndif=1 (that is, no differentiation), then the Ndif=2 point, then Ndif=3, and so forth up to Ndif=6 for the rightmost point of each curve. The advantage of plotting the data with Tdif on the horizontal axis, is that it clarifies the range of wavelet durations that matches each particular Ndif formula, and thus which wavelets are included in the resulting differential signal.

Four of the curves in FIG. 6 reach into the best discrimination zone. This indicates that all of these systems are able to provide discrimination at the highest level obtainable. Only the two curves with the longest Tdata 0.091 and 0.113 milliseconds) fail to reach the best discrimination zone. This indicates that systems with a digitization rate of 11 kHz digitization rate will provide V-U discrimination with some degradation, while systems with 9 kHz or less provide very poor discrimination of voiced and unvoiced sounds. Also, the points in the dashed oval are all due to the first-order Ndif=2 formula, and can be discounted since FIG. 5 showed that a second-order function is necessary to obtain efficient rapid-wavelet detection. Then, after eliminating the Ndif=2 points and the long-Tdata points, all of the remaining points that reach the best discrimination zone have a differential width Tdif in the same narrow range, which is 0.05 to 0.15 milliseconds. This Tdif range is indicated by a double-arrow. Interestingly, and importantly, this is exactly the same range as the durations of the rapid wavelets. In other words, FIG. 6 shows that the optimal range of the differential width is the same as the range of rapid wavelet durations. Only those differential formulas with Tdif values in this range can provide optimal V-U discrimination. Combinations outside that range, such as the Ndif=3 point of the Tdata=0.091 curve, and all the points of the Tdata=0.133 curve, fall well outside the range of rapid wavelet durations, resulting in poor U/V ratio and poor overall discrimination. In other words, if the temporal width of the differential function is in the same range as the durations of rapid wavelets, the unvoiced sounds will be selectively included in the differential signal; and if the differential function is too wide or too narrow, many of those rapid wavelets will be lost. The most-preferred Tdif is 0.1 milliseconds, in the center of the best-performance range, which is indicated by a small triangle in FIG. 6.

Not shown in these figures are numerous other tests using third-order and higher differential functions (they all provided inadequate), and numerical variations on the formulas of Eq. 10-14 (numerical variations had negligible effect). Also not shown are studies that checked the effect of Tdata on the integral signal (Tdata has no effect on the integral signal).

To summarize the results of the entire study of FIGS. 1-6: The preferred parameters for optimal V-U discrimination include a speech signal with Tdata in the range of 0.04-0.06 milliseconds, integration with Tinteg in the range of 0.2 to 0.3 milliseconds, and differentiation using a second-order differential function with Ndif=3 and Tdif=0.05-0.15 milliseconds.

To obtain the high level of discrimination of FIG. 6, it may be necessary to adjust the data period of the speech signal, so that Tdata is in the preferred range of 0.04-0.06 milliseconds. Most mobile phones provide digitizer-output signals in this range, but many emerging applications aim for higher or lower digitization rates. If the digitization rate is higher than the preferred range (Tdata too short), then the digitization rate could be reduced with no loss in V-U discrimination. But if for some reason the digitization rate cannot be lowered to the preferred range, then some of the digitizer-output values should be discarded or averaged together, so that the resulting speech signal has a temporal spacing of 0.04-0.06 milliseconds. This saves computational resources and battery power.

FIG. 7 shows how the digitizer-output signal may be adjusted to obtain a speech signal having Tdata in the preferred range. The procedure for adjusting the digitizer-output signal depends on the digitization rate. If the digitization rate is in the preferred range, the speech signal values are simply the digitizer-output values (minus the offset signal) with no further changes. But if the digitizer is too fast, some values of the digitizer-output signal may be discarded or averaged.

In the table of FIG. 7, the digitizer-output period Tdigitizer is shown in the first column, followed by the nominal digitization rate in kHz, and the recommended procedure for converting the digitizer-output values to the speech signal having Tdata in the preferred range. In the last column is the resulting Tdif, the width of the differential function in milliseconds. For example, if Tdigitizer=0.01 milliseconds (a digitization rate of 100 kHz), then the rapid wavelets are extremely oversampled. In that case, four out of five values of the digitizer-output signal may be discarded or skipped, with the fifth value being kept as one value of the speech signal (after subtracting the offset signal). The resulting Tdata, with four out of five digitizer-output values skipped, is 0.05 milliseconds which is the most preferred value for Tdata. Alternatively, all five values of the digitizer-output signal could be averaged, to produce one value of the speech signal. However, averaging takes more work than discarding values, and provides little or no additional V-U discrimination.

In the second line of the table, the digitizer-output period is 0.02 milliseconds. In that case, the speech signal could be obtained at Tdata=0.05 as follows: skip two values of the digitizer-output signal, then keep the third value, skip the fourth, and keep the fifth, and continue in this pattern. The resulting speech signal values would not be strictly periodic, but the average data period would be 0.05 milliseconds. Alternatively, the values could be averaged together as follows: average the first 3 values of the digitizer-output signal, forming the first speech signal value. Then average the next two values of the digitizer-output signal, which becomes the second value of the speech signal. Then continue repeating this pattern. This produces a speech signal with an average Tdata of 0.05 milliseconds.

Continuing with the same line (Tdigitizer=0.02) of FIG. 7, an acceptable Tdata=0.06 milliseconds could be obtained by skipping two values and keeping the third value rather than alternating 2-3-2-3. Or, each value of the speech signal could be obtained by averaging three sequential values of the digitizer-output signal, which also results in Tdata=0.06 milliseconds. All of these variations, whether by averaging or discarding digitizer-output values, would provide substantially the same V-U discrimination performance.

If the digitizer-output period is 0.023 milliseconds, corresponding to about 44 kHz digitization rate, the adjustment would consist of simply discarding every-other value of the digitizer-output signal, thereby obtaining Tdata=0.045 which is acceptable. Alternatively, the two values of the digitizer-output signal could be averaged.

If the digitizer-output period is about 0.031 milliseconds, one out of three values can be skipped, resulting in Tdata=0.047 milliseconds, which is in the preferred range.

If the digitizer-output period is between 0.04 and 0.06 milliseconds (about 16 to 25 kHz) then no change is needed. The Tdigitizer values are in the preferred range, so the speech signal values are simply equal to the digitizer-output values, minus the offset.

If the digitizer-output period is longer than 0.06 milliseconds, the V-U discrimination will be degraded, and increasingly so for longer Tdata. There is no way to recover the lost data. In FIG. 7, the longer Tdif values become grossly mismatched to the rapid wavelet durations in unvoiced speech. The inventive method is not recommended when Tdata is greater than about 0.08 milliseconds.

First Discrimination Experiment

An experiment was performed to check that the integral and differential signals correctly select the voiced and unvoiced sounds. Certain test commands were spoken into a mobile phone, which was programmed to use the inventive method to identify the voiced and unvoiced sounds. The mobile phone was an LG Optimus G with Tdata=0.045 milliseconds. This is in the preferred range of Tdata according to FIG. 7, hence no further adjustment of the data rate was needed. The phone was programmed to derive the integral signal as specified in FIG. 2, and the differential signal as described in FIG. 3, and then to determine the maximum values of the integral and differential signals for each command sound. Certain command sounds were then uttered about 100 times. Each command sound was then analyzed to determine the maximum value of the rectified integral signal, and the maximum value of the rectified differential signal. A point was then plotted on the chart, at an X-Y location corresponding to the detected maximum integral and differential amplitudes.

Three commands were used: "GO" representing a purely voiced interval, the sound "SS" for a purely unvoiced interval, and "STOP" for a command with both voiced and unvoiced intervals. Also a fourth condition, termed "Background", consisted of a series of 100 silent sessions, each 10 seconds long with normal background sounds but no spoken commands. The maximum integral signal and differential signal were recorded for each repetition of each of these conditions. The commands were spoken in a normal tone, not loud, not slowly, with the phone on a bench about 50-60 cm from the speaker. During all these runs, a normal background level of noise was maintained in an electronic development laboratory, including one fan running, a ventilator, traffic outside a closed window, occasional speech in a different room but no speech close to the system under test, and music playing softly (Joseph Haydn, Harpsichord Concerto in D Minor).

Figure 8:
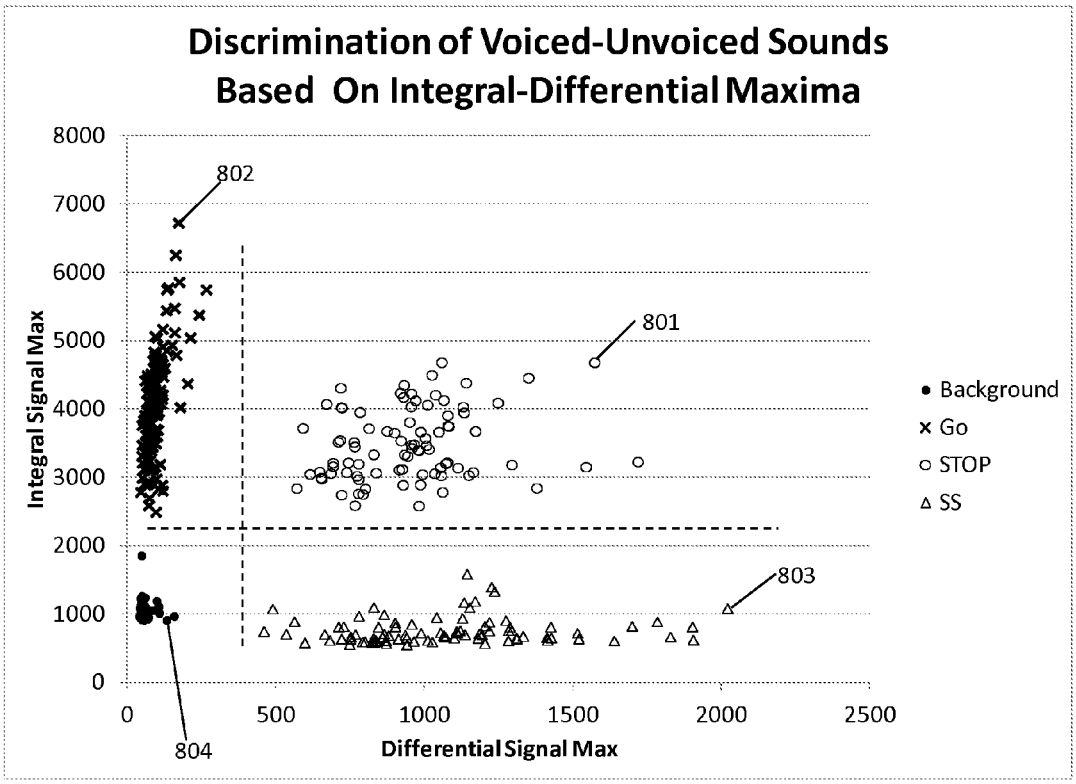
FIG. 8 is a graph showing experimental results that demonstrate good discrimination of voiced and unvoiced command sounds and silence, based on the measured amplitudes of the inventive integral and differential signals.

The results of all 400 trials are shown in the graph of FIG. 8. The horizontal axis is the maximum rectified differential signal, representing unvoiced sound. The vertical axis is the maximum rectified integral signal, representing voiced sound detected for each trial. The overall scale of the axes depends on the gain of the phone amplifier and the bit-length of the digitizer, and other system parameters, but is typical of mobile devices. The plotted open circles 801 indicate the maximum integral and differential signals for "STOP" commands. The "STOP" command has both voiced and unvoiced sounds; accordingly the open circles 801 indicate that substantial amplitudes were detected in both the differential and integral signals.

The X's 802 show the maximum integral and differential values for the "GO" commands. The X's 802 are clustered on the left, with a substantial amplitude in the integral signal but very little in the differential signal, which corresponds to the voiced sound of the "GO" command. The triangles 803 along the bottom are for the "SS" sound, which is unvoiced and thus has a high amplitude in the differential signal but very little in the integral signal. The background-only trials appear as black dots 804 which are tightly clustered at very low values for both integral and differential signals.

As is apparent in FIG. 8, the data points for the four sound conditions are sufficiently separate from each other, that the commands can be distinguished using simple threshold cuts. Dashed lines suggest possible values for threshold values that separate the different sound types. Specifically, voiced sounds have at least 2200 in the integral signal, and unvoiced sounds have at least 450 in the differential signal. Using these threshold settings, the inventive method would correctly identify every sound trial, and would thus get a perfect score of 400 correct detections out of 400 trials. Other mobile devices implementing the inventive methods would obtain similar results.

The results of FIG. 8 demonstrate that the inventive method can separately detect, identify, and discriminate voiced and unvoiced sounds, with high reliability, under realistic test conditions. Furthermore, this high level of discrimination was obtained using the most primitive form of the invention, wherein the discrimination is based solely on the maximum value of the integral and differential signals.

Threshold V-U Detection

The next step of the inventive method (Step D) is to detect voiced sounds by comparing the integral signal to an integral-signal threshold, and to detect unvoiced sounds by comparing the differential signal to a differential-signal threshold. Whenever the integral signal exceeds its threshold, a signal termed the V-detection signal is set high to indicate that a voiced sound is detected. Likewise a U-detection signal is set high responsive to the differential signal exceeding its threshold, indicating that an unvoiced sound is detected. As used herein, an output signal "indicates" that a sound is present when that signal is set to a first output state, and indicates that no sound is present when that signal is set to a second output state.

The V-detection and U-detection signals indicate certain instants in which the voiced or unvoiced wavelets align to generate detected sound of each sound type. Normally the integral signal (or its magnitude) varies chaotically above and below the integral-signal threshold, thus causing the V-detection signals to alternately be set high and low. The resulting V-detection signal comprises a large number of brief pulses separated by gaps. Likewise the U-detection signal is highly pulsatile due to the differential signal oscillating above and below its threshold according to the variable alignment of the rapid wavelets. Each detection signal pulse corresponds to a wavelet or series of wavelets that meet the threshold criteria, interspersed by wavelets that do not. The detection pulses thus reflect the highly modulated structure of speech. Although the V-detection and U-detection signals are highly fragmented, most or all of the V-detection pulses (V-pulses) occur while a voiced sound is being spoken, and most or all of the U-pulses occur while an unvoiced sound is being spoken.

Optionally, the integral and differential signals may be rectified before they are compared to their threshold values. Rectification ensures that negative wavelets are detected as well as the positive wavelets, which improves sensitivity and time resolution. As a further option, the integral and differential signals may be smoothed before they are compared to their respective thresholds. Smoothing enhances sensitivity to weak sounds while rejecting momentary noise. Smoothing comprises calculating a running average of the rectified integral signal or the rectified differential signal, with an averaging span termed the smoothing span. Preferably the smoothing span is long enough to suppress pulsatile noise and enhance sensitivity to faint sounds, but not so long that subsequent command sounds are missed. Typically the smoothing span is in the range of 1 to 30 milliseconds.

For proper smoothing, the rectification step is essential. If the unrectified integral signal were averaged or smoothed without rectifying, then almost all of the sound would be extinguished, because the unrectified integral signal is a bipolar signal, and the positive and negative wavelets would cancel. A running average of a bipolar signal, using an averaging span greater than the duration of the slow wavelets, would extinguish both the slow wavelets and the rapid wavelets, leaving no signal at all. Therefore the signal-smoothing protocol specifies that the integral or differential signal be rectified first, and then a running average of the rectified signal is calculated. Since the rectified integral or differential signal is a monopolar signal, the resulting smoothed signal includes all of the amplitude from the wavelets, while greatly reducing fluctuations.

Optionally, the integral and differential signals may be "refined" to further segregate the wavelets of voiced and unvoiced sounds. A refined differential signal is obtained by first subtracting the integral signal from the speech signal, and then differentiating the remaining sound. The intent is to remove high-amplitude voiced wavelets that might otherwise be interpreted as unvoiced sound. In a similar way, the refined integral signal is obtained by first calculating the differential signal by differentiating the speech signal, then subtracting it from the speech signal, and then integrating the difference. Signal refining can help reduce crosstalk between the sound types, particularly when the ADC is slow. If the ADC is sufficiently fast (Tdata<0.05 milliseconds), signal refining is usually not helpful because the inventive integral and differential functions sufficiently exclude the opposite-type wavelets.

Figure 9:
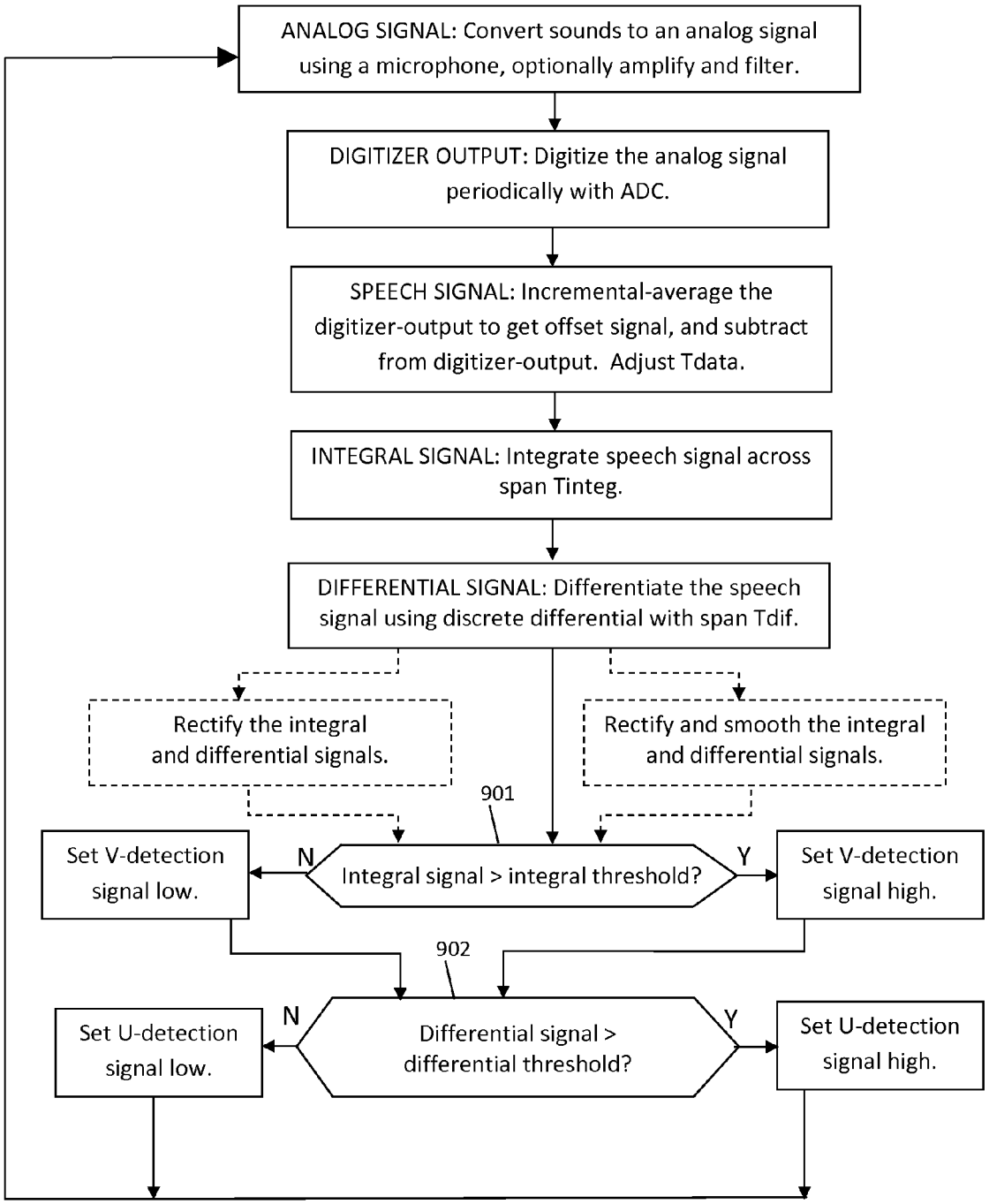
FIG. 9 is a flowchart showing the steps for detecting instantaneous voiced and unvoiced sounds using the inventive integral and differential signals.

Turning now to FIG. 9, a flowchart shows the steps of the inventive method for detecting voiced and unvoiced sounds. First, in the box labeled "ANALOG SIGNAL", the sound of the spoken command is converted to an analog electronic signal, using a microphone for example. The analog signal is then optionally amplified and filtered. The amplification, for example using an operational amplifier, should provide sufficient gain that speech sounds can be detected by a digitizer, even if the sounds are faint. The filtering preferably excludes sounds outside the speech bandwidth.

Then, in the box labeled "DIGITIZER-OUTPUT", the analog electronic signal is digitized repeatedly, using an ADC for example, thereby generating a digitizer-output signal comprising sequential measurements of the sound. Preferably the digitizer performs the measurements periodically, in which case Tdigitizer is the time separation between the digitizer-output values. Preferably Tdigitizer is at most 0.06 milliseconds, so that the rapid wavelets of unvoiced sound may be adequately sampled. The digitizer resolution, expressed as a number of bits, should be at least 8 bits, and more preferably 10 to 12 bits which helps the system to pick up faint sounds. (However, the inventive method has been implemented successfully with an ADC having only 6 bits of resolution, in a quiet environment.)

Then, in the box labeled "SPEECH SIGNAL", the digitizer-output signal is incrementally averaged, using a sufficiently long averaging span (1 to 10 seconds typically) thereby deriving an offset signal that tracks the DC offset plus any electronic drifts. Then the offset signal is subtracted from the digitizer-output signal, thereby producing a speech signal with zero bias. Also, if the digitizer-output signal has a data period less than 0.04 milliseconds, some values of the digitizer-output signal may be discarded or averaged as detailed in FIG. 7, so as to produce a speech signal that has a data period Tdata in the preferred range of 0.04 to 0.06 milliseconds.

Then, in the box labeled "INTEGRAL SIGNAL", the speech signal is integrated, thereby producing the integral signal. The integral signal includes the slow wavelets of voiced speech and substantially excludes the rapid wavelets of unvoiced speech. The integration typically comprises a running average of the speech signal values. The integration may comprise averaging a number of sequential values of the speech signal, using for example a box-car average with a circular buffer, or an incremental average of the speech signal, or any other averaging method. Preferably the averaging span Tinteg is in the range 0.2 to 0.3 milliseconds.

Then, in the box labeled "DIFFERENTIAL SIGNAL", the speech signal is differentiated, thereby producing the differential signal that includes the rapid wavelets of unvoiced sound while excluding the slow wavelets of voiced sound. Preferably the differentiation follows a discrete differentiation formula, preferably of second-order, and preferably with Tdif of 0.05 to 0.15 milliseconds.

Then (ignoring for now the options shown in dashed lines), the integral signal is compared to an integral-signal threshold in the first interrogator 901. If the integral signal exceeds this threshold (the Y branch), a voiced sound is detected and the V-detection signal is set high; and if not, the V-detection signal is set low.

Then, in the second interrogator 902, the differential signal is compared to the differential-signal threshold. If the differential signal exceeds this threshold, the U-detection signal is set high, or is set low otherwise. In all cases the flow returns to the beginning, to convert more sound.

The dashed lines and boxes in FIG. 9 show options. The box labeled "Rectify the integral and differential signals", includes taking the magnitude of those signals before comparing them to their respective thresholds. Rectification is a convenience that makes it easy to detect the negative wavelets using the same threshold as the positive wavelets.

The other optional step, in the box labeled "Smooth the integral and differential signals" includes smoothing or averaging the rectified integral and rectified differential signals to remove vocal fluctuations and pulsatile noise. For example such smoothing suppresses transient noise pulses ("glitches") coming from digital electronics. Usually the smoothing comprises incremental averaging of the rectified integral signal or the rectified differential signal. Preferably the averaging span used in smoothing exceeds the width of pulsatile noise or vocal modulation, but not so long that it suppresses brief sound intervals that are needed for recognition. Typically the smoothing span is in the range of 1 to 30 milliseconds.

Although the flowchart shows the integral signal being calculated first, and then the differential signal, it is immaterial which of these signals is calculated first. Although the flowchart shows the integral signal being compared to the integral-signal threshold before the differential signal is compared to the differential-signal threshold, it is immaterial which signal is compared to its threshold first. Although the flowchart indicates that the V-detection and U-detection signals are set high when the corresponding sound is detected, the signals could equally well be set low upon detection and high upon silence, or to any other two distinct states as desired by the application.

As a further option, the offset signal may be calculated but not subtracted from the digitizer-offset signal. In that case the speech signal and the integral signal would both have the same DC bias as the digitizer-output signal. To account for this, the integral-signal threshold could be adjusted by adding the offset signal to it; and then the voiced sounds would be detected when the speech signal (with its DC bias) exceeds the revised threshold comprising the original threshold plus the offset signal. However, the disadvantage of leaving a bias in the speech signal, is that the bias would prevent the rectification and smoothing of the integral signal. Therefore the preferred method is to subtract the offset signal from the digitizer-output signal, thereby obtaining a speech signal with zero bias.

The flowchart of FIG. 9 demonstrates how the inventive method detects voiced and unvoiced sounds separately, by integrating and differentiating the speech signal. Detection of the voiced and unvoiced sounds completes Step D of the inventive method.

Produce Output Signals

The next step in the inventive method (Step E) is to produce output signals that indicate when voiced and unvoiced sounds occur. Each output signal can be set to at least two distinct states, for example a voiced signal having one state representing that a voiced sound is present, and another state representing that voiced sound is not present; and likewise for the unvoiced output signal. The output signals may comprise just a single brief pulse at the beginning of each sound interval, which pulse indicates that a sound of a particular type has started. Or, the output signals may demark a single continuous time interval that encloses the entire voiced or unvoiced sound, which time interval may be termed a voiced interval or an unvoiced interval depending on the sound type therein. The indicated time interval may enclose only the sound of a command, or it could also include a silent time that follows the sound. As a further option, the method could generate just a single output signal that switches between certain states whenever the sound type switches between voiced and unvoiced sound. The preferred style of output signals will depend on the needs of the application.

In the simplest version, termed the detection-output protocol, the output signals are simply the V-detection and U-detection signals themselves, without further treatment. As mentioned, the V-detection signal is set high whenever the integral signal exceeds the integral-signal threshold, and the U-detection signal is set high whenever the differential signal exceeds the differential-signal threshold. Typically, the V-detection and U-detection signals comprise a large number of brief pulses, continuing as long as the integral or differential signal continues to fluctuate above and below the respective thresholds throughout each sound interval. The V-detection and U-detection signals are suitable inputs for applications that can accept a large number of brief pulses. For example, an interval timer may start measuring a time interval upon receiving the first V-detection pulse, and stop timing upon receiving the first U-detection pulse. The operator could speak a command such as "GO" to start timing, and then "STOP" to stop timing. The first V-detection pulse of the voiced "GO" command would start the timer, and the first U-detection pulse of the unvoiced "S" in "STOP" would stop the timer. All the other pulses would be ignored. Such a timer would measure the time between the two commands with very high precision. (In a practical system, the timer would not begin timing again upon the voiced "O" of "STOP", since this is clearly not the user's intent. Instead, the timer would wait until it is re-armed, for example by a button press or a "RESET" command, before accepting another voiced command.)

As an alternative output, the V-detection and U-detection signals may use inverted logic. The V-detection signal could be set low when the integral signal exceeds its threshold, and high otherwise; and similarly for the U-detection signal. Or, the V-detection signal could be bipolar, being set to a positive voltage when the integral signal exceeds its threshold, and a negative voltage otherwise. It is immaterial which states indicate the presence and absence of each sound type, so long as the states are distinct.

As a further option, the output signal could be a single signal which can be set to three output states, termed positive, negative, and ground. The output signal could be set to the positive state whenever the integral signal exceeds the integral-signal threshold, and to the negative state whenever the differential signal exceeds the differential-signal threshold, and to ground otherwise. Such a composite signal would be useful for those applications that need a single input line conveying information about both the voiced and unvoiced detections. Artisans will devise other signal configurations without departing from the inventive method, which is that the output signals indicate when the integral and differential signals exceed their respective thresholds.

Some applications need to know only when a voiced or unvoiced sound begins. Therefore the invention includes an output option, termed the pulse-at-beginning protocol, wherein the output signals comprise a single tailored pulse emitted at the start of each sound. The starting time of a sound is identified as the time when a sound is first detected, following either a silent period or a period with the opposite-type sound. In an embodiment, an output pulse termed a voiced-beginning pulse is generated when the integral signal first exceeds the integral-signal threshold, following a silent period or an unvoiced sound. Likewise an unvoiced-beginning pulse is generated when the differential signal first exceeds the differential-signal threshold after a silence or a voiced sound. Thus the voiced-beginning pulse and the unvoiced-beginning pulse indicate when each voiced or unvoiced sound begins. Preferably the voiced-beginning pulse and unvoiced-beginning pulse are produced with a predetermined width, such as 1 or 10 milliseconds, or some other width depending on the needs of the application.

The inventive voiced-beginning pulse and unvoiced-beginning pulse would be useful as inputs to applications that need to know when sounds of each sound type begin, such as speech-encoding applications that encode voiced and unvoiced sounds differently. When triggered by the voiced-beginning pulse, the application would begin encoding the sound using a voiced-sound-encoding routine. When triggered by the unvoiced-beginning pulse, the application would then change to the unvoiced-sound-encoding routine. The inventive voiced-beginning and unvoiced-beginning pulses reveal the sound type of each sound very quickly, based on the first few values of the speech signal. Thus the inventive method enables the speech-encoding application to select the correct encoding routine to encode each sound type, in real time while the user speaks naturally.

As an option, a single output signal could carry both the voiced-beginning and unvoiced-beginning pulses. The voiced-beginning pulse could be a positive voltage pulse emitted when the beginning of a voiced sound is recognized, and the unvoiced-beginning pulse could be a negative voltage pulse on the same line, responsive to the beginning of an unvoiced sound. Or other voltages arranged according to the needs of an application.

Figure 10:
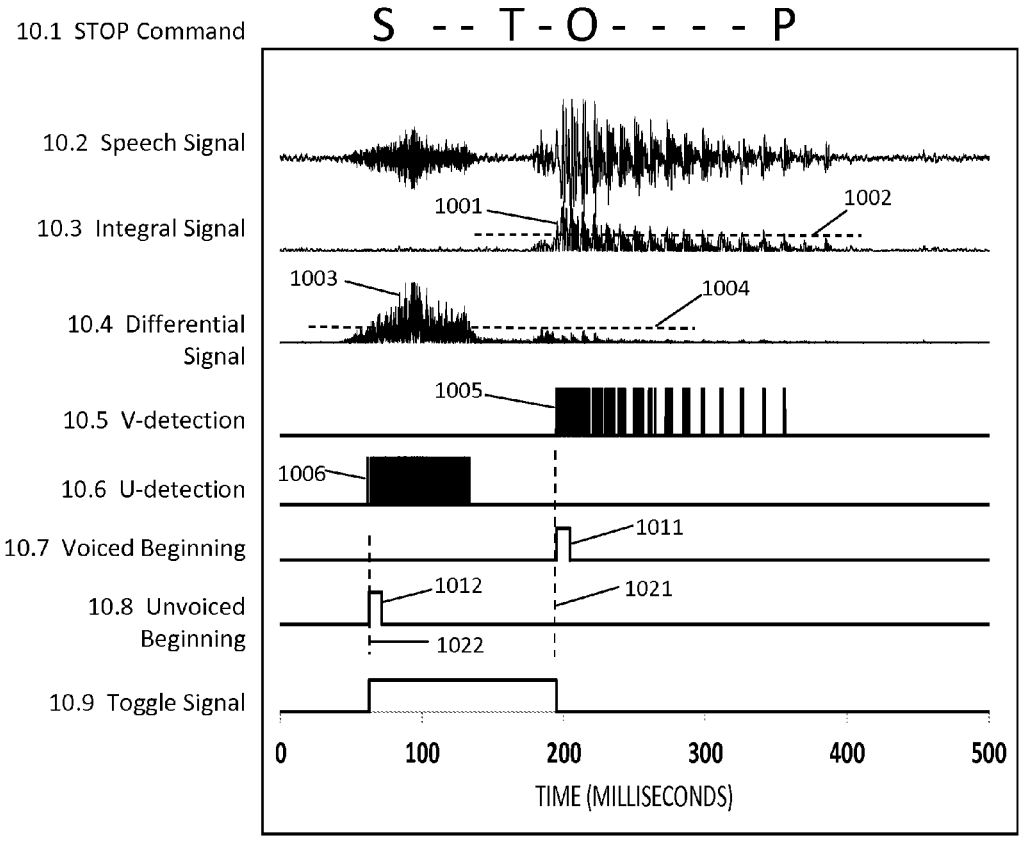
FIG. 10 is a series of graphs showing how the command "STOP" is analyzed and output signals are generated according to the inventive beginning-pulse protocol and the inventive toggle protocol.

FIG. 10 shows how the inventive method can detect voiced and unvoiced sounds, and then produce voiced-beginning pulses and unvoiced-beginning pulses. The figure also shows how a toggle-type output signal is generated. The toggle signal alternates between two states, being set to a first state responsive to some condition (such as detecting a voiced sound), and being set to the second state responsive to another condition (such as detecting an unvoiced sound). After being set to one of the states, the toggle signal remains in that state until the opposite condition occurs.

Trace 10.1 again shows the "STOP" command. The speech signal is shown in Trace 10.2. Trace 10.3 shows the rectified integral signal 1001, obtained by integrating the speech signal using a running average algorithm and rectifying. Trace 10.4 shows the rectified differential signal 1003, obtained by applying a second-order discrete differential function with Ndif=3 to the speech signal and rectifying. An integral-signal threshold 1002 is shown as a dashed line, and a differential-signal threshold 1004 is shown as a dashed line.

Trace 10.5 shows the V-detection signal, which is set high whenever the integral signal 1001 exceeds the integral-signal threshold 1002. The V-detection signal exhibits a large number of rapid transitions or V-pulses 1005 because the integral signal 1001 includes a large number of fluctuations above and below the integral-signal threshold 1002. However, all of the V-pulses 1005 occur during the "O" portion of the command, and thus indicate voiced sound.

In a similar fashion, Trace 10.6 shows the U-detection signal, which is set high when the differential signal 1003 exceeds the differential-signal threshold 1004, and low otherwise. The U-detection signal comprises numerous U-pulses 1006, due to the richly modulated nature of the differential signal 1003, however all of the U-pulses 1006 occur during the unvoiced sound of the "S". Also two particular times are indicated by vertical dashed lines and labeled as 1021 and 1022. Time 1021 indicates when the first V-pulse 1005 occurs, and time 1022 shows when the first U-pulse 1006 occurs.

Trace 10.7 shows an output voiced-beginning signal, with a voiced-beginning pulse 1011 that starts at time 1021 responsive to the first V-detection pulse 1005. The voiced-beginning pulse 1011 is 10 milliseconds long, but could be made any length as required for an application. Trace 10.8 shows the unvoiced-beginning signal, with an unvoiced-beginning pulse 1012 that starts at time 1022 responsive to the first U-detection pulse 1006. The voiced-beginning signal and the unvoiced-beginning signal thus indicate the start of each voiced and unvoiced sound interval respectively. The start of a sound of a particular sound type is determined by the first V-detection or U-detection pulse following a period of silence or of the opposite sound type. These output signals could be used by an application that requires a trigger pulse at the beginning of each sound type. For example, an embedded processor that accepts certain predetermined commands can identify a spoken command according to the sequence of sound types in the command. The processor could receive the voiced-beginning and unvoiced-beginning signals, which indicate the sound type of each sound interval in the command, and then could determine the sequence of sound types in the command, thereby identifying the spoken command using those signals alone.

Trace 10.9 shows an alternative output signal comprising a toggle signal that indicates both voiced and unvoiced sounds on a single line. The toggle signal is set high when an unvoiced sound occurs and is set low when a voiced sound occurs. At time 1022 the first U-pulse 1006 occurs, and so the toggle signal is set high. Then at time 1021 the first V-pulse 1005 occurs, causing the toggle signal to be set low again. In this way the toggle signal indicates the beginning of each sound, and its sound type, according to the toggle signal being high or low.

Alternatively, the high and low states of the toggle signal could be reversed, so that voiced sounds produce a high output and vice-versa; or the output could have any other relationship to the sound type detected, provided that the output signal is set to a first state or a second state according to the sound type detected. Such a toggle signal is suitable for applications that need a single input that indicates which sound type is currently being spoken. For example, an operator could set the toggle signal to the high state by saying "YES" (which ends in an unvoiced sound), and then the operator could set the toggle signal to the low state by saying "NO" (which is voiced). As an application example, the toggle signal could be used by the operator to turn a high voltage power supply on or off remotely and safely, using only spoken commands.

The pulse-at-beginning protocol and the toggle protocol provide very fast indications of detected sound as well as sound type. However, these outputs are susceptible to momentary noise fluctuations or sound fluctuations. If noise causes even a single V-detection or U-detection pulse, a false output signal would be generated. Therefore the inventive method includes an option of generating the voiced-beginning pulse only after some number Nv of V-detection pulses are obtained, where Nv is typically 2 to 50 depending on the data period and system properties. Likewise the unvoiced-beginning pulse could be generated after Nu of the U-detection pulses have been accumulated. A U-counter could count the number of U-detection pulses received until it reaches Nu, and a V-counter would count the V-detection pulses. As a further desirable option, the number of U-pulses accumulated in the U-counter could be set to zero whenever a V-detected pulse occurs, and likewise the count of V-detection pulses would be set to zero if a U-detected pulse occurs. Zeroing each counter when an opposite-type pulse occurs would further reject noise. Furthermore, both counts could be reset to zero if there is a sufficient silent period, such as 10 milliseconds with no V-detection or U-detection pulses, which provides even greater reliability. In this way the number of V-pulses and U-pulses would be zeroed if there is an opposite-type pulse or if there is a period of silence. The resulting output signals would then indicate the beginnings of the voiced and unvoiced sounds with high noise immunity. The output signals would have a slight delay, typically one to a few milliseconds, due to the time required to receive the required number of detection pulses, but the resulting V-U discrimination would have much less sensitivity to any non-command interference, ambiguous command sounds, or electronic noise.

Another advantage of the toggle or pulse-at-beginning protocols is that the output signal continues unchanged even after the main portion of the sound has finished. Therefore the sound type of fading sounds would be correctly indicated by the output signal. Many sounds in speech do not end abruptly, but fade gradually to imperceptibility. An example is the "O" sound in FIG. 10, which decreases in amplitude gradually. With the toggle or pulse-at-beginning protocol, the sound type indication remains correct throughout this fade-out time, even if the sound is too faint to be detected directly. The sound type indication changes only when the next sound of the opposite type is detected. Since the output signal continues to indicate that the sound is voiced, the faint trailing wavelets are correctly encoded as voiced sound, even if they are too faint to be detected directly.

Turning to FIG. 11, a table lists the computational requirements of the inventive method. A major advantage of the inventive method is its extreme computational efficiency. For each version of the invented method, the table lists the number of variables that are maintained in RAM and updated upon each data period, and the number of arithmetic operations needed to update those variables on each data period. On the left side of the figure, the minimum resources are listed for the detection-output protocol with the delayed-offset option. On the right side is shown the resources needed for the toggle-output protocol with rectification and smoothing of the integral and differential signals. In both cases it is assumed that the digitizer-output signal period is in the preferred range of 0.04-0.06 milliseconds, so that there is no need to discard any of the digitizer-output values.

Considering first the detection-output protocol, the output signals are simply the V-detection and U-detection signals. In the delayed-offset option, the offset signal is updated only once per millisecond, rather than every data period, thereby nearly eliminating the computational burden associated with the offset correction. Therefore the offset calculation is not included in the computational burden list for this case. However, the offset signal still must be subtracted from the digitizer-output on every data period, and thus the offset subtraction is counted. With these assumptions, then, the computations needed in each data period for the detection-output case are as follows: First, the already-calculated offset signal is subtracted from the digitizer-output signal to produce the speech signal (one subtraction), then the integral signal is calculated by incremental averaging the speech signal (2 multiplications and 1 addition), then the differential signal is calculated using the second-order Ndif=3 formula of Eq. 11 (1 multiplication, 1 subtraction, 1 addition, and 1 division), and then the magnitude of each value of the integral signal is compared to its threshold, and likewise for the differential signal (2 magnitudes and 2 comparisons) for a grand total of 4 add/subtract, 4 multiply/divide, 2 magnitudes, and 2 comparisons, or 12 operations overall. It may be noted that one multiplication is by 2, and one division is by 4, which are both trivial operations for computers. Also, rectifying involves simply dropping the sign, which is trivial. Threshold comparisons typically take only one or two machine cycles and are trivial for most processors. To implement the inventive method with the detection-output protocol and with the delayed-offset option, then, the total computational burden is only 12 operations, of which at least 6 are trivial operations. Workers with experience in computation optimization will probably be able to shave this further. In contrast, prior sound discrimination methods require massive computational power to invert matrices, derive autocorrelation factors, perform maximum-likelihood analyses, and myriad other calculations on a point-by-point or frame-by-frame basis, while providing a V-U discrimination that is no better than the inventive method.

Also shown in FIG. 11 are the variables that must be carried in RAM memory to implement the detection-output protocol with the delayed-offset option. These variables are: the offset signal, the current and prior two values of the speech signal, the integral signal, the differential signal, and the V-detection and U-detection signals which are the outputs. The Tupdate timer for the delayed-offset option is assumed to be available in hardware; otherwise an additional counter is needed to count data periods. The number of variables needed to carry out the inventive method, and correctly identify voiced and unvoiced sounds, is thus a grand total of 8 variables. In stark contrast, prior-art methods carry huge numbers of variables on a constantly rotating basis, to provide essentially the same output signals.

On the right side of FIG. 11 are listed the computation requirements for the toggle output protocol, assuming that the integral and differential signals are smoothed by incremental averaging, and without assuming the delayed offset option. The steps are: incremental averaging for the offset signal (2 multiplications and 1 add), subtraction of the offset from the digitizer-output (1 subtraction), incremental averaging for the integral signal (2 multiplications and 1 add), differentiation as described (1 subtraction, 1 division, 1 addition, 1 multiplication); rectification of the integral and differential signals (2 magnitudes); two comparison operations for the V-detection and U-detection signals; and two operations to prepare the toggle output signal, counted as 2 comparisons. The total operations, then, are: 5 add/subtract, 6 multiply/divide, 6 comparison/rectification for a total of 17 operations, of which at least 8 are trivial. The number of variables is 9 including the output toggle signal.

The foregoing methods and options provide output signals that indicate when a voiced or unvoiced sound begins, but they do not indicate when the sound ends. Some applications need to distinguish the sound interval from a silent interval that follows the sound. Therefore the invention includes a further option for generating output signals that specifically demark time intervals during which only a voiced sound or an unvoiced sound is spoken. Such output signals are termed a voiced-time-interval signal and an unvoiced-time-interval signal. As used herein, a particular time interval is "demarked" by generating a signal that indicates when that time interval starts and ends, for example a signal that is set to a high state when the interval starts and is set to a low state when the interval ends. In one embodiment, the voiced-time-interval signal is set high and the unvoiced-time-interval is set low to indicate a voiced sound. When the unvoiced-time-interval signal is high and the voiced-time-interval is low, the sound is unvoiced. If both signals are low, it is silence. If both signals are high, it is a mixed sound. In another embodiment, a toggle output signal can be set to a first state or a second state, depending on the sound type detected. In yet another embodiment, a tri-level output signal can be set to a first state or a second state or a third state, depending on whether voiced or unvoiced sound or silence is detected.

The inventive method includes three protocols for generating output signals that demark voiced and unvoiced time intervals. These output protocols are termed the signal-hysteresis protocol with smoothing, the retriggerable-timer protocol, and the tally protocol. The signal-hysteresis protocol will be discussed first.

The Signal-Hysteresis Protocol

In signal processing, hysteresis refers to a method for varying a threshold value, depending on whether a signal is above or below that threshold. Typically there is an upper threshold value and a lower threshold value that is lower than the upper threshold value. For a sound to be detected, the signal must first exceed the upper threshold value. But as soon as a sound is detected, the routine immediately switches to the lower threshold value for the duration of the sound. The sound interval ends when the signal finally passes below the lower threshold value, at which time the routine switches back to the upper threshold value to detect any subsequent sound intervals. By selecting the threshold level according to the presence or absence of ongoing sound, signal-hysteresis improves background rejection and discounts minor fluctuations in the signal. Signal-hysteresis provides a convenient output signal that demarks a single time interval containing the sound, rather than a multitude of detection pulses or a sound-beginning pulse or other pulses.

To show the advantage of hysteresis, a command will first be analyzed without the hysteresis option (FIG. 12), which results in a segmented output signal. Then the same command will be analyzed with signal-hysteresis (FIG. 14), resulting in an improved output signal.

Figure 12:
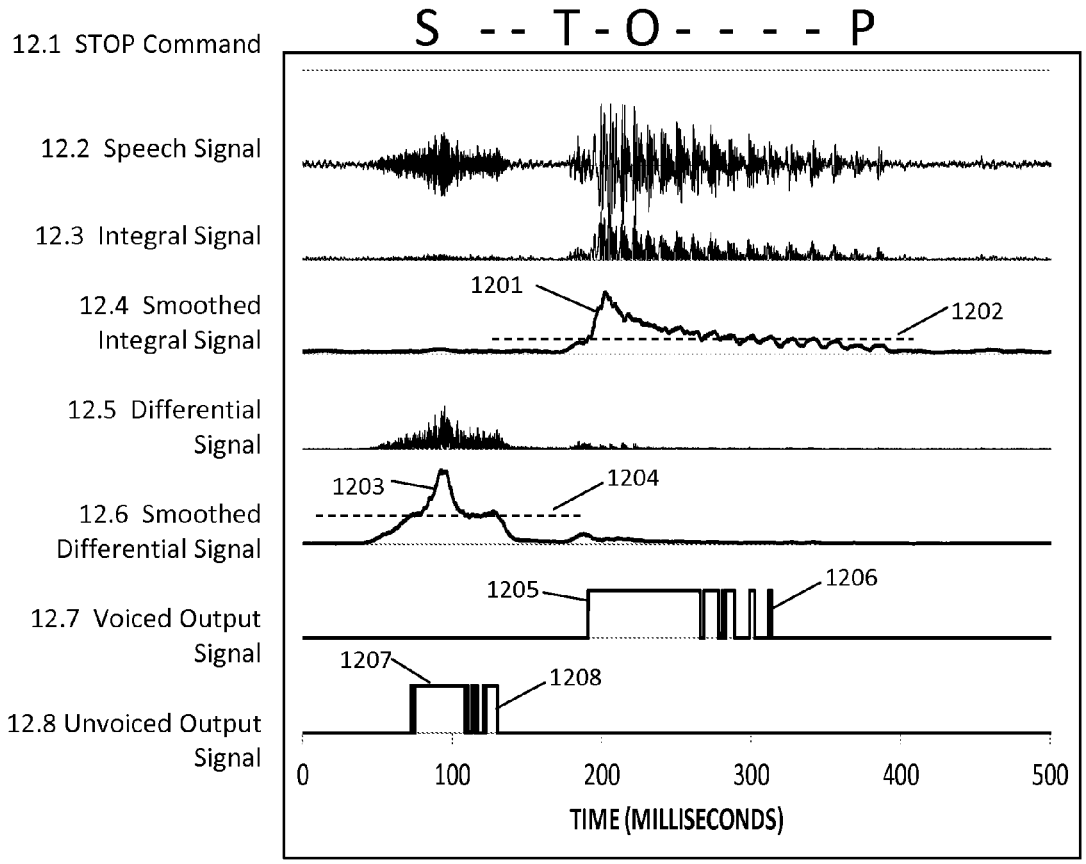
FIG. 12 is a series of graphs showing how the command "STOP" is analyzed according to the inventive method including smoothing of the integral and differential signals.

FIG. 12 shows the analysis of a "STOP" command, with signal smoothing but without the hysteresis option. The figure is a series of graphs showing how the "STOP" command is analyzed to generate output signals that indicate both sound presence and sound type. Because this example does not use the hysteresis option, the output signals will be seen to be fragmented, due to modulations of the command sounds. An output signal is fragmented if it indicates a plurality of small intervals during the sound, with gaps between.

Trace 12.1 shows the command "STOP" with the letters spread out. Trace 12.2 shows the corresponding speech signal. Trace 12.3 shows the rectified integral signal, obtained by incremental averaging of the speech signal, and then rectifying. Trace 12.4 shows the smoothed integral signal 1201 obtained by incremental averaging of the rectified integral signal with a smoothing span of 10 milliseconds. The wavelet structure and much of the modulation apparent in the integral signal of Trace 12.3 are removed in the smoothed integral signal 1201, as a result of the smoothing. Also shown is the integral-signal threshold 1202.

Trace 12.5 shows the rectified differential signal, obtained with a second-order Ndif=3 discrete differential on the speech signal, and then rectifying. Trace 12.6 shows the smoothed differential signal 1203, obtained by incrementally averaging the rectified differential signal with a 10-millisecond smoothing span. A differential-signal threshold 1204 is shown as a horizontal dashed line. (In Traces 12.4 and 12.6, the smoothed integral signal and differential signal, 1201 and 1203 respectively, are shown amplified by a factor of 2 for graphical clarity.)

Trace 12.7 shows the voiced output signal which is set high while the smoothed integral signal 1201 exceeds the integral-signal threshold 1202. The voiced output signal demarks a main interval 1205 plus a number of secondary segments 1206. Many sounds include modulation that causes the signal to fluctuate above and below a threshold, resulting in the segments 1206.

Trace 12.8 shows the unvoiced output signal which is set high while the smoothed differential signal 1203 exceeds the differential-signal threshold 1204. The unvoiced output signal demarks a main unvoiced interval 1207 and a number of secondary unvoiced segments 1208 corresponding to variations in the unvoiced sound intensity.

The example of FIG. 12 demonstrates that voiced and unvoiced sounds can be detected by comparing the smoothed integral and differential signals to thresholds, producing output signals that indicate when a sound is present, and that indicate which sound type has been detected. However, since hysteresis was not used in this analysis, the outputs also contain secondary intervals or segments due to sound fluctuations. Some applications require that each sound interval be indicated by a single time interval without segmentation; therefore the inventive method includes a signal-hysteresis option.

The signal-hysteresis protocol is a way to demark time intervals containing just the voiced or unvoiced sounds. First, the integral and differential signals are rectified and smoothed as described for FIG. 12. Then they are compared to four threshold values termed the upper integral-signal threshold, the lower integral-signal threshold, and the upper and lower differential-signal thresholds. The lower threshold is lower than the upper threshold for each sound type. The operative threshold at any time (that is, the threshold that the signal is compared to), is determined by the presence or absence of sound. The presence of sound is indicated by the output signals, which are the voiced-time-interval signal and the unvoiced-time-interval signal.

Initially, before any sound is spoken, both of the output signals are low, and both of the upper thresholds are operative, which means that the smoothed integral and differential signals are compared to the upper threshold values. As soon as the smoothed integral signal exceeds its upper threshold, a voiced sound is recognized; then the output signal changes to the high state, indicating that the sound is present; then the lower threshold is used thereafter. When the smoothed integral signal drops below the lower threshold, the output signal is again changed to the low state, indicating that no voiced sound is present; then the upper threshold then becomes operative. Likewise, the unvoiced thresholds are alternated according to the presence or absence of unvoiced sound. Changing between threshold values in this way ensures that minor fluctuations in the sound do not affect the output signals. Consequently the output signals demark just a single interval containing the sound, without segmentation.

Figure 13:
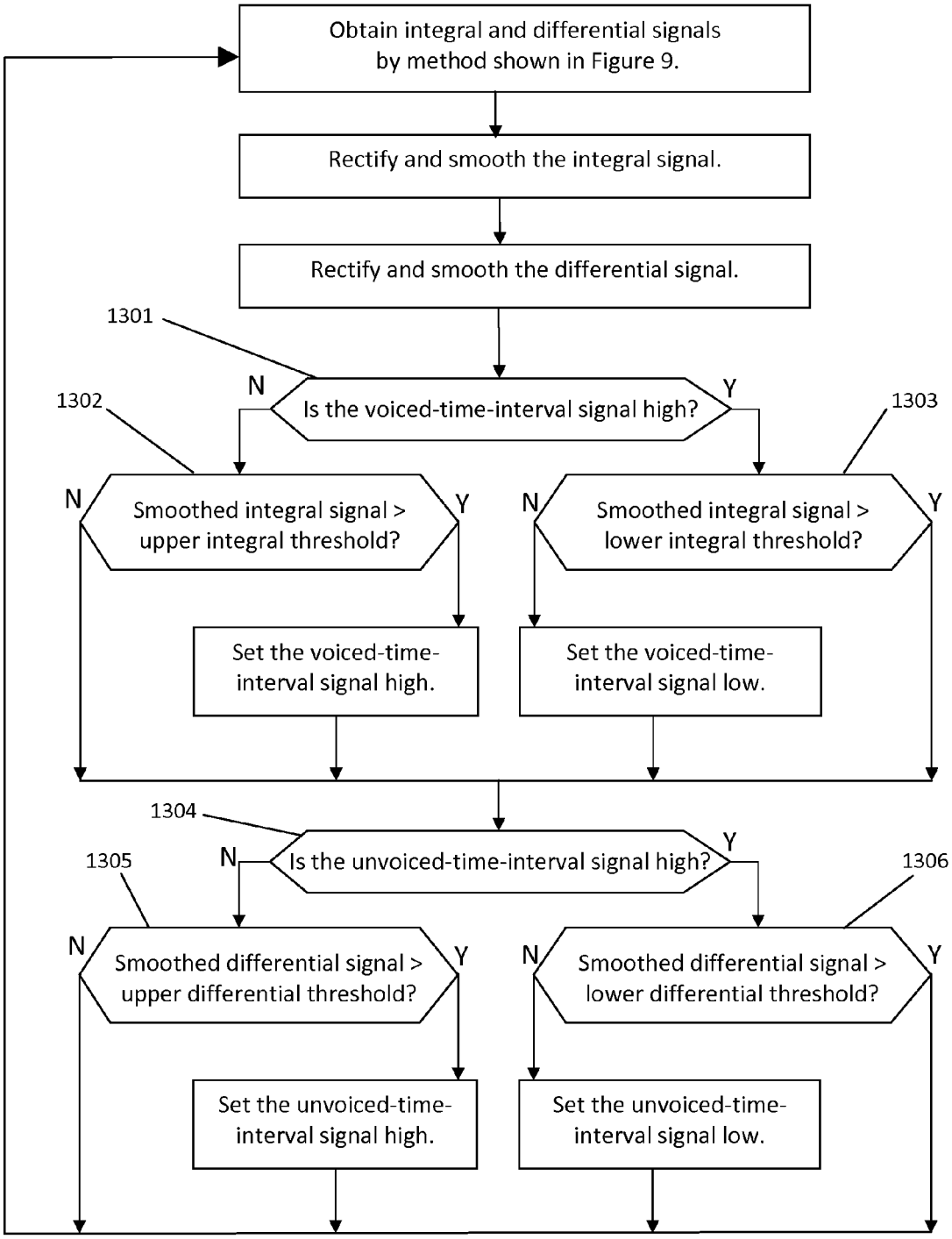
FIG. 13 is a flowchart showing the steps of the inventive signal-hysteresis protocol.

FIG. 13 is a flowchart that shows the signal-hysteresis protocol in more detail. First, the integral and differential signals are obtained by a method such as that of FIG. 9. Then the integral signal is rectified and smoothed, preferably using incremental averaging, thereby obtaining the smoothed integral signal. Then the differential signal is rectified and smoothed, preferably using incremental averaging, thereby obtaining the smoothed differential signal.

Then, in the interrogator 1301 labeled "Is the voiced-time-interval signal high?", the presence of voiced sound is checked. If that output signal is not high (the N branch), meaning that no voiced sound has yet been detected, then the process flows to the interrogator 1302 labeled "Smoothed integral signal>upper integral threshold?". If the smoothed integral signal exceeds the upper integral-signal threshold, the voiced-time-interval signal is set high, indicating that a voiced sound has begun.

Returning to interrogator 1301, if the voiced-time-interval signal is high (the Y branch), then a voiced sound is already in progress. This leads to the interrogator 1303 labeled "Smoothed integral signal>lower integral threshold?". If the smoothed integral signal has fallen below the lower integral-signal threshold (the N branch), the output voiced-time-interval signal is then set low.

Then all flows converge on the interrogator 1304 labeled "Is the unvoiced-time-interval signal high?". If an unvoiced sound has not yet been detected, the unvoiced-time-interval signal will be low, which is the N branch. This leads to the interrogator 1305 labeled "Smoothed differential signal>upper differential threshold?". If the smoothed differential signal exceeds the upper differential-signal threshold, the output unvoiced-time-interval signal is set high, thereby indicating that an unvoiced sound has started.

Returning to interrogator 1304, if there is already an unvoiced sound in progress, then the unvoiced-time-interval signal will be high (the Y branch). This leads to the interrogator 1306 labeled "Smoothed differential signal>lower differential threshold?". If the smoothed differential signal has dropped below the lower differential-signal threshold, the output unvoiced-time-interval signal is set low, ending the demarked interval.

Then all flows return to the beginning to process more sound. To summarize the signal-hysteresis protocol: the smoothed integral signal is compared to an upper integral-signal threshold if there is silence, or to a lower integral-signal threshold during a voiced sound, and a voiced sound interval is demarked thereby; likewise the smoothed differential signal is compared to an upper differential-signal threshold in silence, or to a lower differential-signal threshold during an unvoiced sound, and an unvoiced sound interval is demarked thereby.

Figure 14:
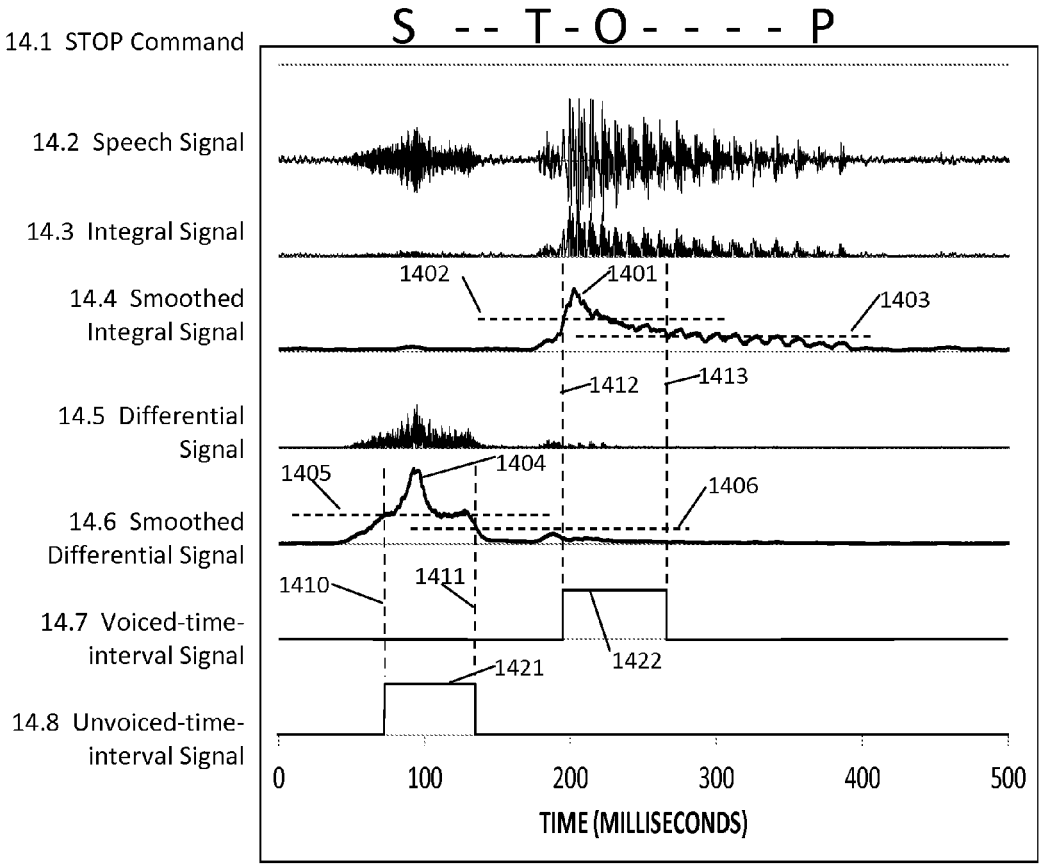
FIG. 14 is a series of graphs showing how the command "STOP" is analyzed according to the inventive signal-hysteresis protocol.

FIG. 14 illustrates the signal-hysteresis protocol in processing a command. The command "STOP" is again displayed as Trace 14.1, with the speech signal shown in Trace 14.2. The rectified integral signal and rectified differential signal, shown in Trace 14.3 and 14.5 respectively, were obtained as described with FIG. 12. The smoothed integral signal 1401 and the smoothed differential signal 1404, shown in Trace 14.4 and 14.6 respectively, were obtained as described with FIG. 12. The output signals are the voiced-time-interval signal shown in Trace 14.7 with a single voiced interval 1422, and the unvoiced-time-interval signal shown in Trace 14.8 with a single unvoiced interval 1421. Also shown are the upper integral-signal threshold 1402, the lower integral-signal threshold 1403, the upper differential-signal threshold 1405, and the lower differential-signal threshold 1406. Four times 1410 through 1413 are indicated by vertical dashed lines.

Initially, no sound is present; accordingly, both the voiced-time-interval signal and unvoiced-time-interval signal are low initially. The upper integral-signal threshold 1402 and upper differential-signal threshold 1405 are therefore the operative thresholds initially. Then, at time 1410, the smoothed differential signal 1404 exceeds the upper differential-signal threshold 1405, indicating that an unvoiced sound has begun. This causes the unvoiced-time-interval signal to be raised, which demarks the start of the unvoiced interval 1421. Thereafter, while the unvoiced-time-interval signal is high, the lower differential-signal threshold 1406 continues to be operative. Then, at time 1411, the smoothed differential signal 1404 drops below the lower differential-signal threshold 1406, whereupon the unvoiced interval 1421 is ended and the unvoiced-time-interval signal is set low. After time 1411, the upper differential-signal threshold 1405 is again operative since the output unvoiced-time-interval signal is low.

During the unvoiced sound, between time 1410 and time 1411, the smoothed differential signal 1404 drops below the upper differential-signal threshold 1405 repeatedly; however this has no effect since the lower differential-signal threshold 1406 is operative while the unvoiced-time-interval signal remains high. By switching to the lower threshold after the unvoiced sound is recognized, the protocol ensures that minor fluctuations are ignored and a single sound interval 1421 is demarked rather than a series of short segments.

In a similar fashion, the smoothed integral signal 1401 passes above the upper integral-signal threshold 1402 at time 1412, thereby recognizing the voiced sound of the "O". The voiced-time-interval is accordingly set high at that time, forming the start of the voiced interval 1422. Also, the operative threshold is changed to the lower integral-signal threshold 1403, since the voiced-time-interval signal is high after time 1412. Then, at time 1413, the smoothed integral signal 1401 drops below the lower integral-signal threshold 1403, which ends the voiced interval 1422, which causes the operative threshold to be switched back to the upper integral-signal threshold 1402. The smoothed integral signal 1401 then passes above and below the lower integral-signal threshold 1403 several more times; however this has no effect because the voiced-time-interval signal is low at that time, and so the upper integral-signal threshold 1402 is operative. The smoothed integral signal did not exceed the upper integral-signal threshold 1402 after time 1413; therefore no further segments are generated in the voiced-time-interval signal.

The analysis of FIG. 14 shows that the signal-hysteresis protocol can produce a single unsegmented output interval encompassing each sound in the command.

Retriggerable-Timer Protocol

The invention includes another output protocol, the retriggerable-timer protocol, for demarking time intervals containing command sounds. A retriggerable timer is a monostable timer that starts timing when it is triggered, and stops timing after a predetermined time interval termed the expiration time or Texp. If the timer is triggered again, before the expiration time has passed, then the elapsed time is reset to zero, and the timer continues timing thereafter for the full Texp. The timer finally stops timing when the full expiration time elapses with no further triggers received. The timer also generates an output signal that is set to a high state when the timer is timing, and to a low state when the timer is stopped. Such an output signal indicates when the sound interval begins and ends. In an embodiment, the inventive method includes a voiced retriggerable timer and an unvoiced retriggerable timer. The voiced retriggerable timer is triggered by each pulse of the V-detection signal, and generates, as output, the voiced-time-interval signal. The first V-detection pulse triggers the voiced retriggerable timer to start timing, which causes the voiced-time-interval signal to be set high. The voiced-time-interval signal remains high as long as the V-detection signal continues to trigger the voiced retriggerable timer, and finally is set low when the voiced retriggerable timer expires with no further triggers.

In a similar fashion, the unvoiced retriggerable timer is triggered by each pulse of the U-detection signal. The unvoiced retriggerable timer produces the unvoiced-time-interval signal as output, being set high while the unvoiced retriggerable timer is timing, and low otherwise. The unvoiced-time-interval signal demarks an unvoiced interval that encloses all the U-detection pulses, plus an additional period Texp during which the unvoiced retriggerable timer expires without further U-pulses.

The voiced-time-interval signal demarks a voiced interval whose duration encloses the V-detection pulses, plus Texp. The rising edge of the voiced-time-interval signal is triggered when the integral signal exceeds the integral-signal threshold, thereby indicating that a voiced sound has begun. The falling edge of the voiced-time-interval signal occurs when the voiced retriggerable timer expires, which is when the integral signal remains below the integral-signal threshold for a full Texp, thereby indicating that the voiced sound has ended. Likewise the rising edge of the unvoiced-time-interval signal occurs when the differential signal exceeds the differential-signal threshold. This indicates that an unvoiced sound has begun. The falling edge of the unvoiced-time-interval signal occurs when the differential signal remains below the differential-signal threshold for a full Texp, thereby indicating that the unvoiced sound has ended.

The voiced and unvoiced time-interval signals indicate single, unsegmented time intervals enclosing each sound in the command. These output signals support applications that need to know when voiced and unvoiced sounds are present, and when there is silence. The time intervals demarked by the output signals include the entire sound interval of each V or U command sound, without including silence or the opposite sound type (except possibly for a small overflow during the final Texp period). Preferably Texp is longer than the normal modulation time of voiced or unvoiced speech, but not so long that subsequent sound intervals are missed. Typically Texp is in the range of 10 to 30 milliseconds. The retriggerable timer protocol thus produces the voiced-time-interval and unvoiced-time-interval output signals, which indicate voiced and unvoiced sound intervals enclosing the entire sound, without secondary segments.

As an alternative, the retriggerable timers could be triggered when the integral and differential signals exceed their thresholds, instead of being triggered by the V-detection and U-detection signals. But since the V-detection and U-detection pulses are completely correlated with the integral and differential signals, it is immaterial whether the retriggerable timers are triggered by the sound signals directly, or using the detection signals as intermediaries. Depending on the implementation, one version may be computationally more efficient.

Figure 15:
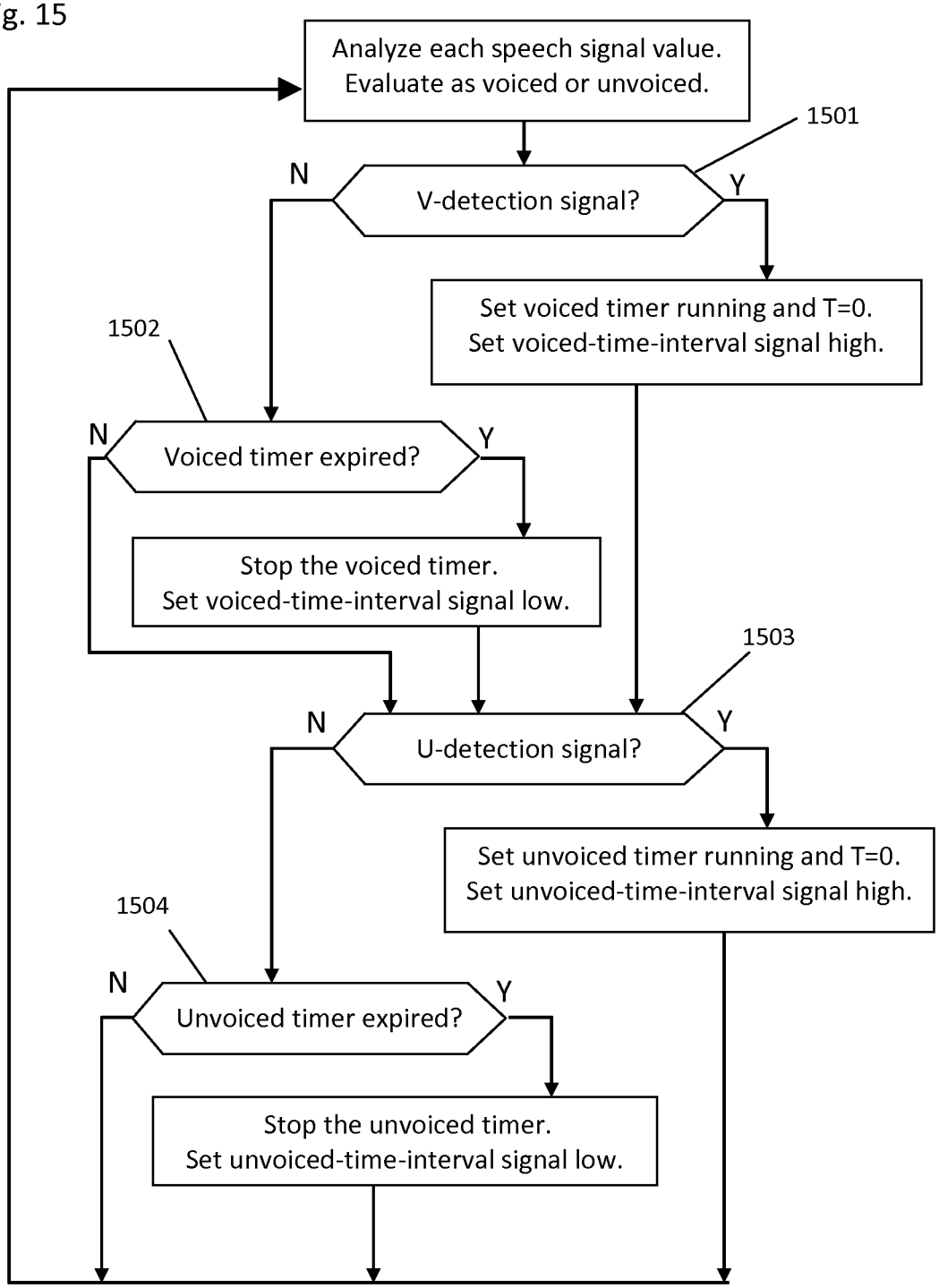
FIG. 15 is a flowchart showing the steps for applying the inventive retriggerable-timer protocol, and for generating output signals that indicate time intervals containing only one sound type.

FIG. 15 is a flowchart showing the inventive retriggerable timer protocol. Voiced intervals containing just voiced sound, and unvoiced intervals containing just unvoiced sound, are derived from the V-detection signal and the U-detection signal. Although the V-detection and U-detection signals comprise a multitude of brief pulses that reflect the highly fluctuating wavelet structure, the retriggerable timer protocol produces output signals that indicate each voiced or unvoiced sound as an unsegmented time interval.

In FIG. 15, a series of interrogators control the voiced and unvoiced retriggerable timers, thereby determining the duration of the voiced-time-interval signal and unvoiced-time-interval signal which are the outputs of the routine. First, each value of the speech signal is analyzed (for example according to the flowchart of FIG. 9) to determine if the sound is voiced or unvoiced, and to produce the V-detection and U-detection signals. Then, in the interrogator 1501 labeled "V-detection signal?", the state of the V-detection signal is checked. If voiced sound is detected (the Y branch) then the voiced retriggerable timer is triggered. Whenever the voiced retriggerable timer is triggered, the elapsed time of the timer is set to zero, and the timer is caused to begin timing or continue timing. The voiced retriggerable timer also produces an output, the voiced-time-interval signal, which is set high whenever the voiced retriggerable timer is timing.

If however the sound is not voiced (the N branch of interrogator 1501), then the flow proceeds to the interrogator 1502 labeled "Voiced timer expired?" where the state of the voiced retriggerable timer is checked. If the voiced retriggerable timer has expired, that timer is stopped and the voiced-time-interval signal is set low. Thus the output signal demarks a voiced interval that begins when the voiced retriggerable timer first starts timing, continues while the timer is repeatedly triggered by the V-detection signal pulses, and ends when the timer expires without being retriggered.

Then, all paths converge on the interrogator 1503 labeled "U-detection signal?" which checks if an unvoiced sound is detected. If unvoiced sound is detected (the Y branch), then the unvoiced retriggerable timer is started and is set to zero elapsed time, and the unvoiced-time-interval signal is set high.

If however the sound is not unvoiced sound (the N branch of interrogator 1503), then the unvoiced retriggerable timer is checked in the interrogator 1504 labeled "Unvoiced timer expired?". If the unvoiced retriggerable timer has expired, it is stopped and the unvoiced-time-interval signal is set low. Thus the unvoiced interval begins and is demarked when the unvoiced retriggerable timer first starts, and continues while the timer is repeatedly triggered by the U-detection signal, and ends when the timer expires without being retriggered.

The outputs of the retriggerable timers are the voiced-time-interval signal and the unvoiced-time-interval signal, which demark time intervals that contain voiced or unvoiced sound. All paths then return to the beginning to analyze the next value of the speech signal.

The logic of FIG. 15 could equally well be implemented without using the V-detection and U-detection signals. At each point where the V-detection signal is checked in the flowchart, one could check instead whether the integral signal exceeds the integral-signal threshold. Likewise the differential signal could be checked instead of the U-detection signal. These two versions produce identical output signals. Both versions are included in the inventive method.

Figure 16:
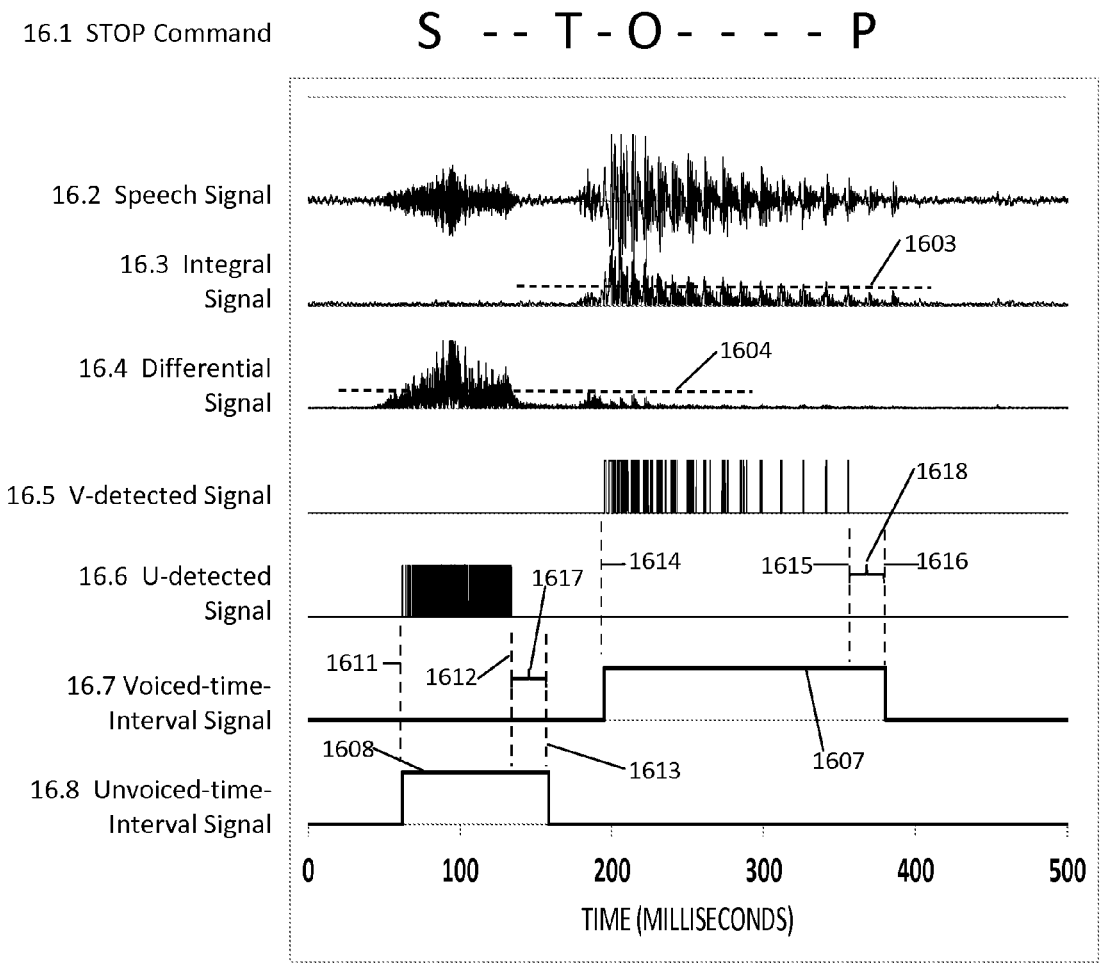
FIG. 16 is a series of graphs showing how the command "STOP" is analyzed according to the inventive retriggerable-timer protocol.

FIG. 16 demonstrates the inventive retriggerable-timer protocol to analyze a command "STOP". According to the inventive retriggerable-timer protocol, an output signal is generated that encloses only the command sounds and does not enclose the silent intervals. Many applications need to receive signals indicating when command sounds are present, and also the sound type of each sound interval.

Trace 16.1 shows the "STOP" command with the letters spread out, and Trace 16.2 shows the corresponding speech signal. Trace 16.3 shows the rectified integral signal, obtained by integrating the speech signal with incremental averaging, and then rectifying. Trace 16.4 shows the rectified differential signal, obtained by differentiating the speech signal with a discrete differential formula, and rectifying. Also shown are the integral-signal threshold 1603 and the differential-signal threshold 1604, shown as horizontal dashed lines.

Trace 16.5 shows the V-detection signal which is set high when the integral signal exceeds the integral-signal threshold 1603, and low otherwise. Trace 16.6 shows the U-detection signal which is set high when the differential signal exceeds the differential-signal threshold 1604, and low otherwise. Also shown are several times 1611 to 1616, and two time intervals 1617 and 1618. The first V-detection pulse occurs at time 1614, the last V-detection pulse occurs at time 1615, the first U-detection pulse occurs at time 1611, and the last U-detection pulse occurs at time 1612.

Trace 16.7 shows the voiced-time-interval signal, which is set high while the voiced retriggerable timer is timing, and returns low when the voiced retriggerable timer expires. The voiced retriggerable timer begins timing at time 1614 on the first V-detection pulse, and continues timing while being repeatedly retriggered by the V-detection pulses, and expires at time 1616 after no further V-detection pulses have occurred for an expiration time Texp. Texp in this case is 22 milliseconds. Thus the voiced-time-interval signal demarks a voiced interval 1607 extending from time 1614 to 1616, which includes the "O" sound plus an additional Texp period 1618.

Similarly, Trace 16.8 shows the unvoiced-time-interval signal which is set high while the unvoiced retriggerable timer is timing, and returns low when the unvoiced retriggerable timer expires. The unvoiced retriggerable timer is triggered or retriggered by each pulse of the U-detection signal, and expires when no further U-detection pulses occur for an entire Texp. The unvoiced time-interval signal demarks an unvoiced interval 1608 that extends from the first U-detection pulse at time 1611, to time 1613 which is Texp beyond the last U-detection pulse. The unvoiced time interval 1608 thus encloses the sound of the "S" in the command, plus an additional Texp period 1617.

As an option, the retriggerable timers could be triggered only after some number, Nv or Nu, of the V-detection or U-detection pulses had been received, rather than upon the first such pulse. Requiring multiple detection pulses of the same sound type would increase reliability and reduce false triggering on noise. The resulting time-interval signals would be slightly delayed relative to those shown in the figure, due to the time required to detect the number of pulses, but would reject any brief noise events that produce only a single V-detection or U-detection pulse.

The example of FIG. 16 shows that the inventive method with the retriggerable-timer protocol can correctly demark the sound intervals in a command, indicating voiced and unvoiced intervals separately, and distinct from silence.

Some systems include microcontrollers that have dual built-in timers implemented in hardware, and for these systems it takes very little computational resources to retrigger a running timer. In other systems, the timers are "assembled" from software instructions, in which case there is a significant computational load each time the retriggerable timers are checked. Therefore the inventive method includes an option, termed the delayed-trigger option, wherein the timers are checked less often. For example the timers may be checked and retriggered only once in a time interval Tupdate, such as once per millisecond, rather than on every data period. Tupdate could be the same as the delayed-offset updating period, or the updating periods could be different. As an alternative, the timers could be checked once every M data periods, using a counter to count the digitization cycles, with M=Tupdate/Tdigitizer. Preferably the offset signal, the voiced tally counter, and the unvoiced tally counter are each updated on different data periods, so as not to overload the processor.

In an embodiment of the delayed-trigger option, two memory bits are provided, termed the V-bit and U-bit, that can each be set to a 1 or 0 state. The V-bit is set to a 1 whenever the integral signal exceeds the integral-signal threshold, and the U-bit is set to a 1 whenever the differential signal exceeds the differential-signal threshold. After being set to a 1, the V-bit and U-bit remain set until they are read out. Then, at the end of the Tupdate interval, the voiced retriggerable timer is retriggered at that time if the V-bit has been set. Likewise the unvoiced retriggerable timer would be retriggered at the end of the Tupdate period if the U-bit has been set during that Tupdate interval. Then, both bits would be reset to 0. Thus the computational burden of checking and retriggering the timers would occur only once per Tupdate rather than once per Tdata period, thereby reducing the computational burden by a factor of Tupdate/Tdata. As a further option, the timers could be implemented as down-counters rather than up-counters, and the bits could be implemented as software booleans.

The Tally Protocol

The invention includes a third output protocol, termed the tally protocol, for generating the voiced-time-interval and unvoiced-time-interval output signals. A tally counter is a memory element or a register that can be incremented and decremented. The invention includes a voiced tally counter and an unvoiced tally counter to process voiced and unvoiced sounds separately. The voiced tally counter is incremented upon each pulse of the V-detection signal, and is decremented periodically (but never below zero). The voiced tally counter value thus rises rapidly during a voiced sound interval, and then declines after the sound is finished. Similarly the unvoiced tally counter is incremented upon each U-detection signal pulse, and is decremented periodically. The unvoiced tally counter value thus grows during the unvoiced sound and declines thereafter.

The tally counters generate the time-interval output signals. Whenever the voiced tally counter exceeds a voiced-tally threshold, the voiced-time-interval signal is set high, and is set low otherwise. Likewise the unvoiced-time-interval signal is set high when the unvoiced tally counter exceeds an unvoiced-tally threshold.

An advantage of the tally protocol is high reliability at discriminating voiced and unvoiced sounds. Typically the tally thresholds are set so that several (typically 5 to 100) of the V-detection or U-detection pulses are needed to raise the tally counter values above their thresholds. Hence any brief noise or computer "glitches" are usually insufficient to register as a sound interval.

Another big advantage of the tally protocol is that it reduces the importance of the signal amplitudes, in deciding whether a sound is voiced or unvoiced. The amplitude of a spoken command can vary substantially when a loud talker is close to the microphone, versus a soft talker farther from the microphone. But the user expects the application to respond the same way to their commands, no matter how loud or soft the sound is. Most prior-art methods for V-U discrimination rely on the sound amplitude as the primary fitted parameter, although empirically the amplitude itself provides little or no useful information for V-U discrimination. In contrast, the tally protocol discriminates the V-U sound type, not by the amplitude of the sound, but rather by measuring the rate of V-detection and U-detection pulses. Loud and soft commands are treated equally. When the rate of V-detection pulses is high enough and for a long enough time, the voiced tally counter rises above its threshold and a voiced sound is recognized. And similarly for unvoiced sounds which are recognized only when the U-detection pulses continue at a sufficient rate for a sufficient time. This valuable feature—devaluing the sound amplitude as a sound-type discrimination parameter—is one of the most important features of the inventive tally protocol. Most prior art methods have no corresponding ability.

The tally protocol still has one amplitude requirement: the integral and differential signals must actually rise above their thresholds to generate the V-detection and U-detection signals. But this is a minimal requirement for the tally protocol because the signal detection thresholds can be safely set very low, just above the background noise level, without causing spurious output signals. This is another advantage of the tally protocol since the low signal thresholds also improve the detection of faint sounds.

Another advantage of the tally protocol is that one or two pulses of the wrong sound type are insufficient to register as a sound interval. In this way the tally protocol reliably detects sounds even if they are weak, while rejecting brief noise even if it has a very high amplitude.

Figure 17:
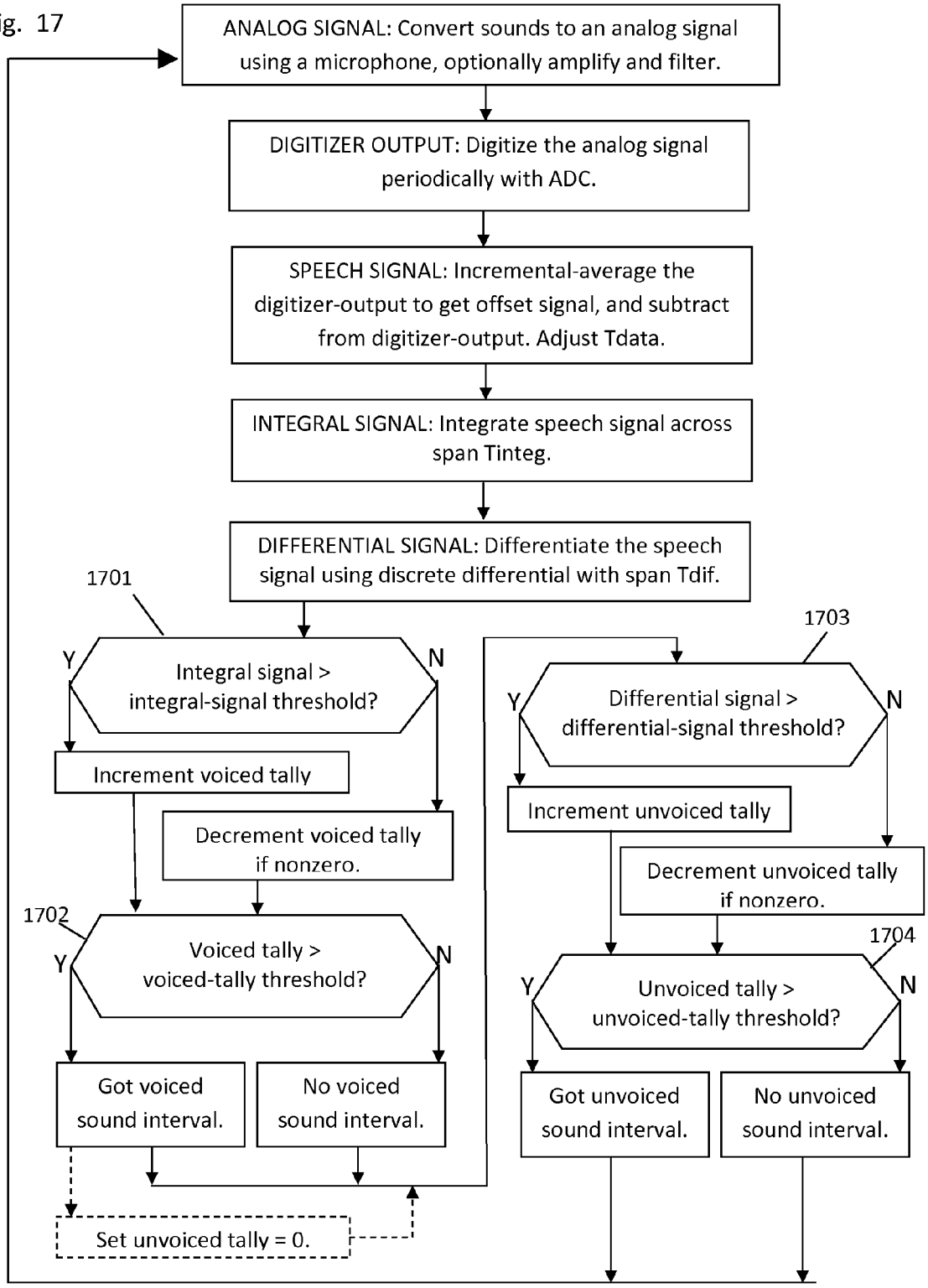
FIG. 17 is a flowchart showing how the voiced and unvoiced sound intervals of a command are identified and indicated in output signals, according to the inventive tally protocol.

FIG. 17 is a flowchart showing the steps of the inventive method including the tally protocol. The first five boxes are the same as the first five boxes in FIG. 9. First the sound is detected, amplified, and possibly filtered; then digitized; then averaged to obtain an offset signal which is subtracted from the digitizer-output signal to obtain the speech signal; then the speech signal is integrated to obtain an integral signal emphasizing voiced sounds; then the speech signal is differentiated to obtain a differential signal emphasizing unvoiced sounds. Further details are provided with FIG. 9.

Then, in the interrogator 1701 labeled "Integral signal>integral-signal threshold?" the integral signal is compared to an integral-signal threshold, and a voiced tally counter is incremented if the integral signal exceeds that threshold, or decremented otherwise (but never below zero).

Then, in the interrogator 1702 labeled "Voiced tally>voiced-tally threshold?" the voiced tally counter is compared to a voiced-tally threshold. If the voiced tally counter exceeds the threshold, a voiced sound is recognized.

Then, in the interrogator 1703 labeled "Differential signal>differential-signal threshold?" the differential signal is compared to a differential-signal threshold, and an unvoiced tally counter is incremented if the differential signal exceeds that threshold, or decremented otherwise.

Then, in the interrogator 1704 labeled "Unvoiced tally>unvoiced-tally threshold?" the unvoiced tally counter is compared to an unvoiced-tally threshold. If the unvoiced tally counter exceeds the threshold, an unvoiced sound is recognized.

All branches then return to the beginning to convert more sound.

As an option, the tally protocol may be modified to prevent unvoiced sounds from intruding when a voiced sound is already present, and to prevent voiced sounds from intruding when an unvoiced sound is already present. This option is termed intrusion suppression. The suppression may be symmetric, wherein both sound types prevent the other sound type from intruding, or it may be asymmetric wherein one sound type prevents the other sound type from intruding but not vice-versa. As an example of asymmetric intrusion suppression, a voiced sound could be recognized whenever it occurs even if an unvoiced sound has already started, but an unvoiced sound would not be allowed to intrude on a voiced sound.

The dashed lines in FIG. 17 indicate how asymmetric intrusion suppression may be implemented with voiced sound being dominant. Whenever the voiced tally counter exceeds the voiced-tally threshold, the unvoiced tally counter is set to zero, thereby inhibiting detection of unvoiced sounds while a voiced sound is present. In this case the suppression is asymmetric, in that voiced sounds can intrude on unvoiced sounds, but unvoiced sounds cannot intrude on voiced sounds. If on the other hand the intrusion suppression were symmetric, each ongoing sound of either type would keep the opposing tally counter zero, until the pre-existing sound had finished.

As a further alternative, intrusion suppression may be applied at the wavelet level instead of the tally level. For example the differential-signal threshold could be raised whenever the voiced-time-interval signal is high, thereby making it more difficult for an intruding unvoiced sound to be recognized.

The tally protocol includes a wide range of options regarding incrementation and decrementation and thresholding. Decrementation of each tally counter is typically either subtractive or multiplicative. Subtractive decrementation comprises subtracting 1, or some other fixed number, from the tally count periodically. Subtractive decrementation causes a linear decline in the tally after the sound is finished. Multiplicative decrementation involves multiplying the tally count by a number slightly less than 1 (such as 0.99) so that the tally count will decline gradually as an exponential curve after the sound is done. With either subtractive or multiplicative decrementation, the rate of decrementation is preferably adjusted so that the tally counter subsides in a time shorter than the length of most voiced or unvoiced sound intervals, thereby ensuring that subsequent sounds are not missed. Typically the decrementation time, or the time for the tally to decline below the tally threshold after the sound is finished, is in the range of 5 to 50 milliseconds.

In the flowchart of FIG. 17, the voiced tally is decremented only if there is no increment. In other embodiments, the decrementation occurs on every data period, whether there is a sound or not. For example, the increment may be a large number (such as 10) and the decrement can be a smaller number (such as 1) so that the tally count builds quickly when a sound is present and then declines more gradually. In other embodiments, the decrementation could be applied less often than every data period, such as once per millisecond, thereby reducing the computation burden.

As a further alternative, the tally counters could be incremented directly when the integral and differential signals exceed their thresholds, rather than using the U-detection and V-detection signals as intermediates. It is immaterial whether the tally is triggered by the V-detection and U-detection signals, or by the integral and differential signals exceeding their thresholds.

As a further alternative, each tally counter may be limited to a maximum value. The tally counter would not be incremented above this limit despite ongoing sound. For example, the tally counter could be limited to a maximum equal to twice the tally threshold. Limiting the tally count to an absolute maximum ensures that the tally counter will subside rapidly when the sound is done. If the maximum count of the tally were not limited in this way, a prolonged sound could cause the tally to build up to such a large value that it would take a long time to recover, and the next sound may be missed. Typically the maximum tally count is set so that the maximum recovery time is 5 to 50 milliseconds.

As a further option, the tally counter could be incremented by different amounts depending on the value of the tally counter. This may be termed the dual-slope incrementation option. For example, if the tally counter is below the tally-counter threshold, the tally counter could be incremented by a large value, such as 10; and while the tally is above that threshold, the tally would be incremented by a smaller value such as 1. Dual-slope incrementation is useful to produce a fast initial rise of the tally counter, thus ensuring fast responsiveness, but it then prevents the tally from rising so far that the recovery time becomes too long.

Decrementation could also be varied, for example subtracting 10 per data period if the tally counter is above a tally-counter threshold, and subtracting 1 per data period if the tally counter is below that threshold. Or, both incrementation and decrementation could both be varied, and the variable incrementation and decrementation could both use the same threshold, or they could have different thresholds.

Figure 18:
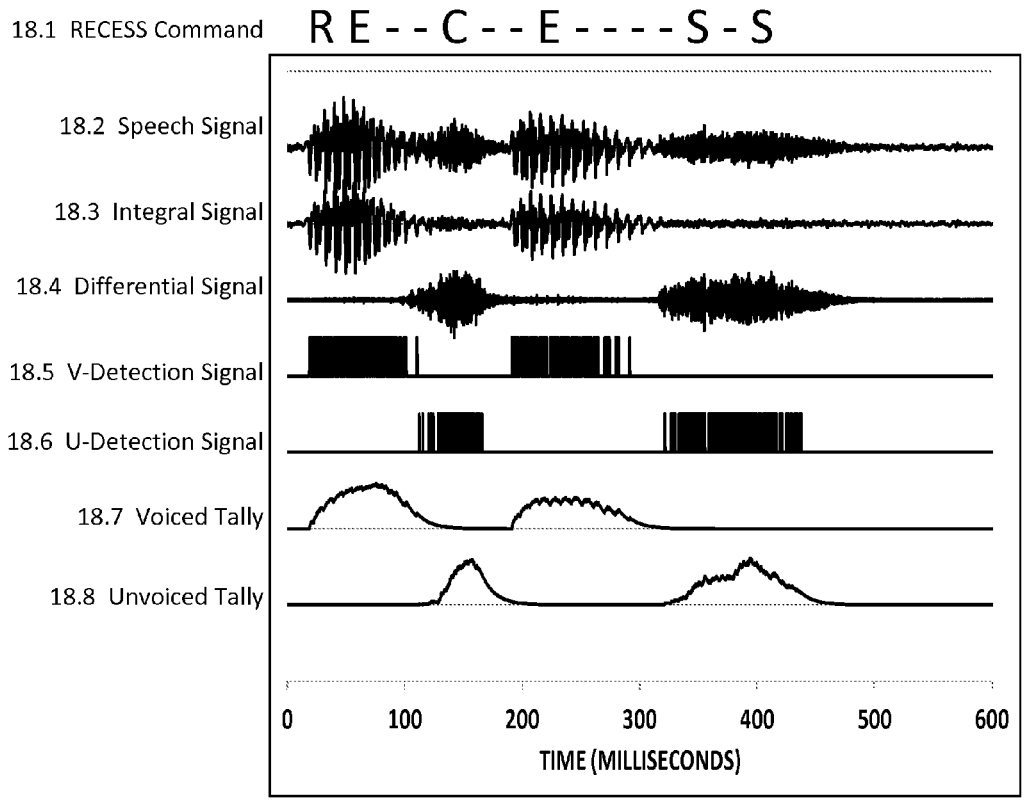
FIG. 18 is a set of graphs showing how the command "RECESS" is analyzed according to the inventive tally protocol, including correction of the sound digitization period.
Figure 19:
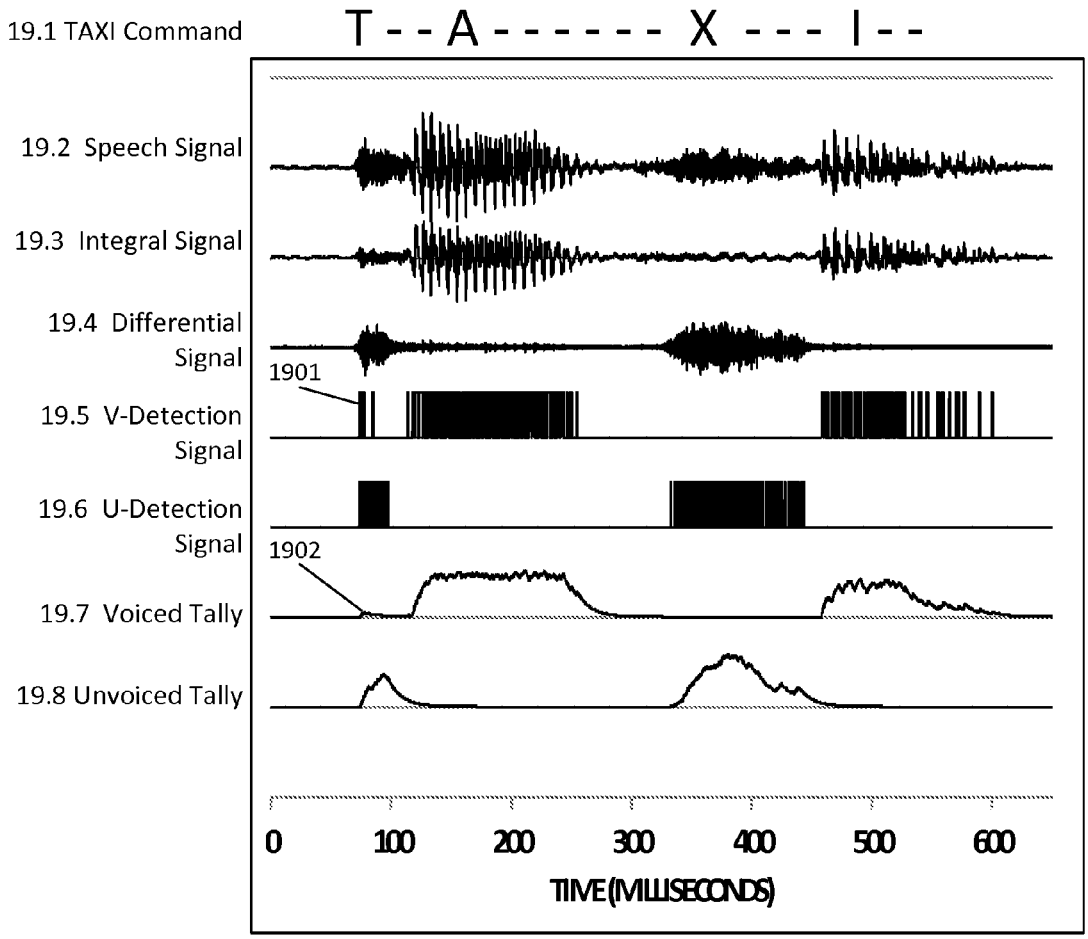
FIG. 19 is a set of graphs showing how the command "TAXI" is analyzed according to the inventive tally protocol.

Turning now to FIGS. 18 and 19, the tally protocol is demonstrated with two commands having alternating sound intervals. FIG. 18 analyzes the command "RECESS", and FIG. 19 shows a similar analysis for the command "TAXI". These command words were chosen not for any great utility, but to demonstrate reliable discrimination of commands with alternating voiced and unvoiced sounds. In FIGS. 18 and 19, the incrementation is responsive to the V-detection and U-detection pulses, and the decrementation is multiplicative, and the decrementation time is 11 milliseconds. The command for FIG. 18 was recorded with a fast digitizer (Tdigitizer=0.023 milliseconds), which is outside the preferred Tdata range of 0.04-0.06 milliseconds. Therefore, according to the adjustment plan of FIG. 7, the speech signal was obtained by skipping half the values of the digitizer-output signal in alternation (skip 1, keep 1), thereby producing a speech signal with Tdata=0.045 milliseconds. The command for FIG. 19, on the other hand, was recorded directly with Tdigitizer=0.045 milliseconds, so no such adjustment was needed in that case.

Trace 18.1 shows the command "RECESS" with the letters spread out. The command comprises a voiced interval for the "RE" portion, an unvoiced interval for the soft-"C", then a voiced interval for the second "E", then a final unvoiced interval for the "SS". Trace 18.2 shows the speech signal which was digitized using a mobile phone at 44100 Hz with 16-bit resolution, and then converted to a 22050 Hz speech signal by discarding half the values, as mentioned. Trace 18.3 shows the integral signal which selects the voiced sounds by integrating the speech signal using incremental averaging with an averaging span of 0.25 milliseconds. Trace 18.4 shows the differential signal which selects the unvoiced sounds using a second-order discrete differential function on the speech signal. Trace 18.5 shows the V-detected signal, which is set high whenever the rectified integral signal exceeds an integral-signal threshold (not shown). The corresponding V-pulses occur during the two voiced sounds only. Trace 18.6 shows the U-detected signal, which is set high whenever the rectified differential signal exceeds a differential-signal threshold (not shown). The corresponding U-pulses occur during the two unvoiced sounds only.

Trace 18.7 shows the voiced tally signal which is incremented on each data period if the V-detected signal is high, and is decremented multiplicatively on each data period by multiplying the tally by 0.996. Also, the voiced tally incrementation used a dual-slope algorithm wherein the voiced tally was incremented by 3 when the tally was below a voiced-tally threshold (not shown), and incremented by 1 when the tally was above this threshold. The dual-slope algorithm provides rapid initial response to a sound type, and rapid recovery after the sound is finished by preventing the accumulation of excessive tally totals. The resulting voiced tally signal in Trace 18.7 shows the two voiced intervals in the command.

Trace 18.8 shows the unvoiced tally signal, incremented upon each U-signal pulse and multiplicatively decremented in the same way as the voiced tally. The trace shows the two unvoiced sound intervals in the command, as expected. The inventive analysis correctly determines the sound-type sequence as voiced-unvoiced-voiced-unvoiced, consistent with the sound-type sequence of the predetermined "RECESS" command.

FIG. 19 shows a similar analysis for the command "TAXI" comprising unvoiced-voiced-unvoiced-voiced sound intervals. The sound in this case was recorded at Tdigitizer=0.045 milliseconds, which is within the preferred range. Therefore in this case it was not necessary to discard any of the digitizer-output values, to form the speech signal. The speech signal values thus comprise the digitizer-output values minus the offset signal (not shown).

The command is shown with the letters spread out in Trace 19.1, the speech signal in Trace 19.2, the integral signal in Trace 19.3, and the differential signal in Trace 19.4 with conditions as described for FIG. 18. The V-detection signal is shown in Trace 19.5 and the U-detection signal in Trace 19.6. Traces 19.7 and 19.8 show the voiced and unvoiced tally counters respectively, which indicate the voiced and unvoiced intervals in the command.

An advantage of the tally protocol is that it is not fooled by occasional brief pulses of sound of either type. The tally protocol correctly discerns the user's spoken sound intervals from the speech signal with high reliability. For example, Trace 19.5 includes a few V-pulses 1901 during the unvoiced "T" sound. A protocol that responded to each pulse 1901 individually might conclude that a voiced sound interval had been started at that time. The tally protocol, however, is based on the rate of occurrence of the sound pulses, so that a few extraneous pulses would not be enough to raise the tally count above its tally threshold. Accordingly, in Trace 19.7 the voiced tally signal exhibits only a very slight rise 1902 responsive to the V-detection pulses 1901 during the "T" sound. In this way the tally protocol responds to the dominant and continuing sound of a spoken sound interval, while rejecting extraneous noise or other effects that could otherwise result in the sound being mis-categorized.

The voiced and unvoiced tally results of FIG. 18 and FIG. 19 demonstrate that the inventive method can reliably indicate the voiced and unvoiced sounds in commands having multiple sound intervals with different types and durations, while rejecting transient noise.

Figure 20:
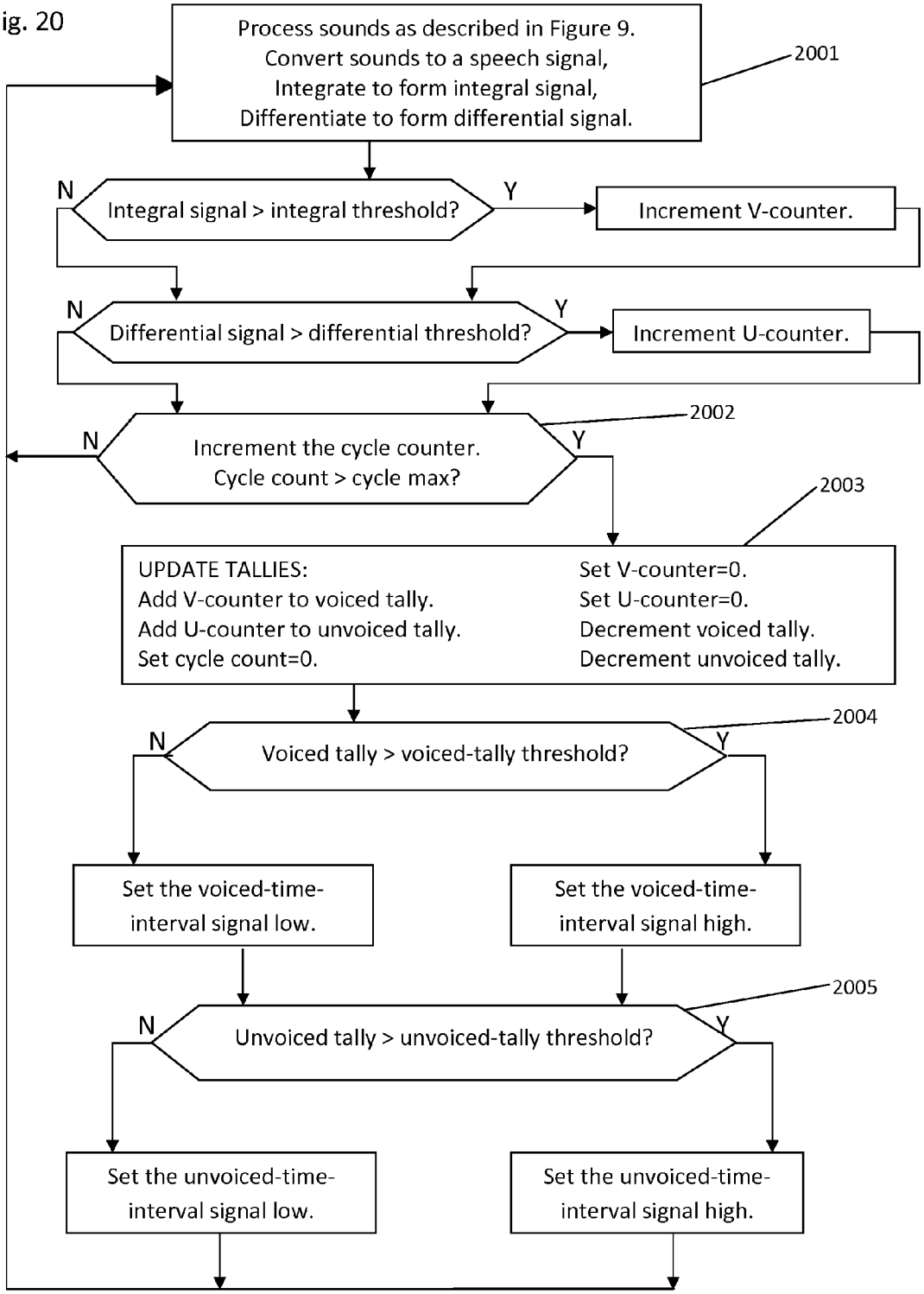
FIG. 20 is a flowchart showing how the inventive delayed-tally protocol is implemented.

FIG. 20 is a flowchart showing how the inventive delayed-tally protocol is implemented. The delayed-tally protocol includes the voiced and unvoiced tally counters as described, but it updates the tally counters less often, rather than on every data period. This reduces demands on the processor. For example the tally counters could be updated once in each time period Tupdate. The tally update could be the same interval as the offset update, or they could use different updating periods. Alternatively, the tallies could be updated once every M data periods, where M=Tupdate/Tdata. To implement the delayed-tally protocol, the integral and differential signals are first calculated from the speech signal, and compared to their respective thresholds, on each data period as usual. Then, instead of processing the voiced and unvoiced tally counters, a pair of registers termed the V-counter and U-counter are incremented, depending on which type of sound is detected. After M such cycles, then the tallies are updated and processed. The accumulated counts in the V-counter are added to the voiced tally counter, and the U-counter is added to the unvoiced tally counter. Then (once per Tupdate interval) the tallies are decremented, and are compared to tally thresholds, and the voiced and unvoiced sound intervals are thereby identified.

To summarize the delayed-tally protocol: it counts the number of times that the integral and differential signals exceed their thresholds during the Tupdate period, and then at the end of Tupdate these totals are added to the respective tally counters. The timing could be controlled by a timer which is set to indicated the Tupdate time, or by a cycle counter set for M cycles. Although the delayed-tally method involves incrementing the V-counter or the U-counter on each data period that has sound, this is actually a very minor computational burden because (a) on most cycles the counters would both be zero, so nothing would have to be done, and (b) when there is a sound, usually only one of the tallies would need to be updated, and (c) the V-counter and U-counter could be implemented as a single-byte register in the processor, which involves minimal processor attention. The cycle counter, if used, could also comprise a register. Unity incrementation of registers is a trivial operation for most processors. Thus using the delayed-tally option, the tally operations that occur on every data period are trivial, and the non-trivial tally counter maintenance occurs only once per Tupdate, so that the computation burden is reduced by a factor of M.

Returning to FIG. 20, the first box 2001 shows how the raw sound is processed by converting sounds to a speech signal, then integrating and differentiating to generate the integral and differential signals, as described in FIG. 9. Then, in the interrogator labeled "Integral signal>integral threshold?", if a slow wavelet is detected (the Y branch), the V-counter is incremented by 1. Similarly in the interrogator labeled "Differential signal>differential threshold?", if a rapid wavelet is detected, the U-counter is incremented by 1.

Then, in the third interrogator 2002, the cycle counter is incremented and checked to see if it has reached the cycle maximum M. If not, the flow goes back to the beginning. If the cycle count has reached the maximum (Y branch), then the flow proceeds to the box 2003 labeled "UPDATE TALLIES", where the full tally computation takes place. This includes adding the V-counter to the voiced tally, adding the U-counter to the unvoiced tally, zeroing the V-counter and the U-counter, and decrementing both tallies. Also the cycle counter is started over. These steps occur only once per Tupdate.

Then, in the interrogator 2004 labeled "Voiced tally>voiced-tally threshold?", the voiced tally counter is compared to the voiced-tally threshold. If the voiced tally counter exceeds its threshold, the voiced-time-interval signal is set high, and is set low otherwise. Then in the interrogator 2005 the unvoiced tally counter is compared to the unvoiced-tally threshold. If the unvoiced tally counter exceeds its threshold, the unvoiced-time-interval signal is set high, and is set low otherwise.

Then, all paths return to the beginning to process more sound.

The delayed-tally protocol uses less computational resources than the regular (non-delayed) tally protocol because the tally incrementation and decrementation and other tally operations are carried out only once per Tupdate instead of every Tdata period. For example, if the data period is 0.05 milliseconds (a 20 kHz digitization frequency), and Tupdate=1 millisecond, there are M=20 data cycles per update, resulting in a 20-fold reduction in tally-oriented computations per data period. For M=100, the updating interval is 5 milliseconds and the savings is even greater.

The flowchart of FIG. 20 demonstrates that the inventive method, with the delayed-tally protocol, can save processor steps and reduce the computational burden, with the addition of three register counters.

A tally updating time Tupdate of 5 milliseconds is sufficient for almost all applications because all common voiced and unvoiced sound intervals are longer than 5 milliseconds. If an application requires better time resolution than 5 milliseconds, it could use the non-delayed tally protocol and update on every data period. If an application requires the ultimate in voice-activated time resolution, and with instantaneous sound-type identification, then the only choice is the detection-output protocol since the V-detection and U-detection signals provide both sound triggering and sound-type identification with sub-millisecond latency.

Figure 21:
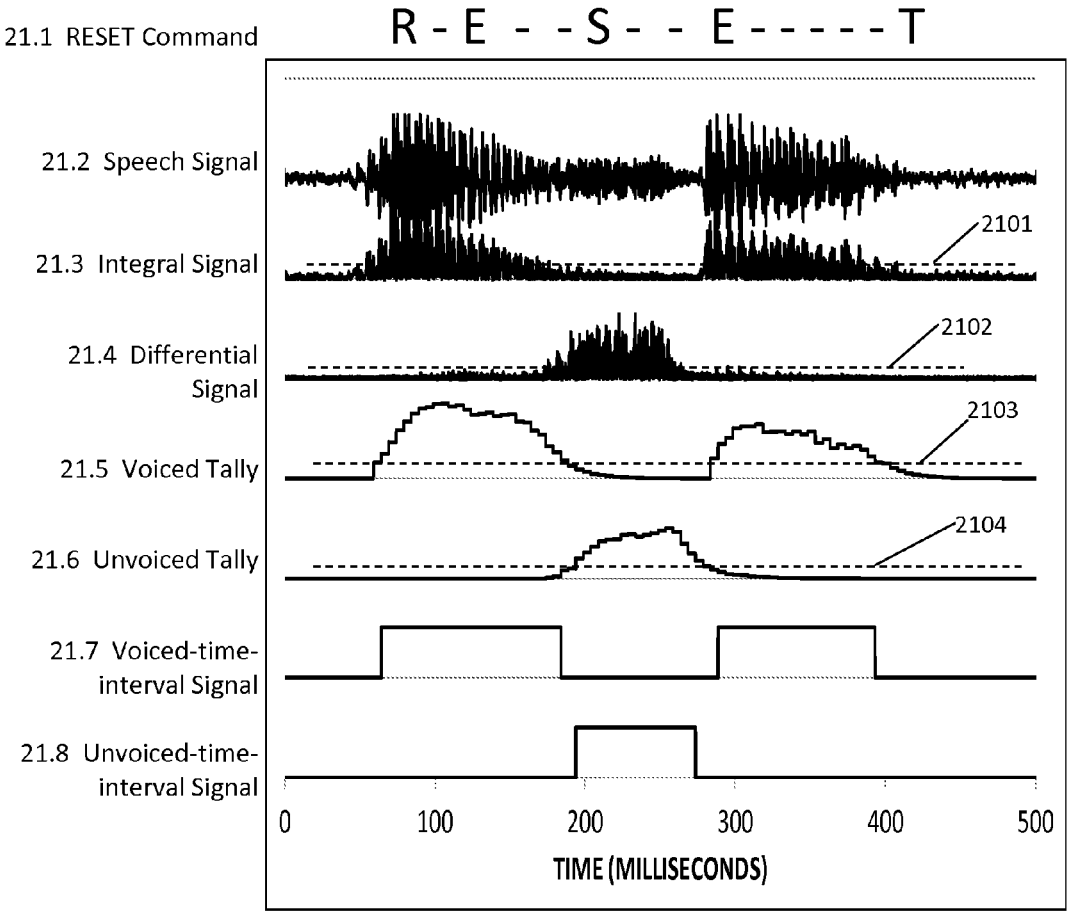
FIG. 21 is a series of graphs showing how the command "RESET" is analyzed according to the inventive delayed-tally protocol.

FIG. 21 illustrates the inventive delayed-tally protocol. The figure includes graphs for the analysis of the command "RESET", using the delayed tally protocol with Tupdate=5 milliseconds, wherein the tally counters are incremented and decremented only once per 5 milliseconds, and at that time they are incremented according to the number of times the integral and differential signals exceeded their thresholds during the Tupdate period.

The "RESET" command comprises a voiced "RE" portion, an unvoiced "S", a voiced second "E", and an optional unvoiced "T" which in this case is not sounded. Trace 21.1 shows the command with the letters spread out. Trace 21.2 shows the speech signal. Trace 21.3 shows the integral signal, obtained as a rectangular average of speech signal values spanning 0.25 milliseconds, and then rectified. The integral-signal threshold 2101 is shown as a dashed line. Trace 21.4 shows the rectified differential signal, obtained by calculating a second-order discrete differential on the speech signal, and also the differential-signal threshold 2102.

Traces 21.5 and 21.6 show the voiced and unvoiced tally counters, calculated using the delayed-tally protocol, with Tupdate=5 milliseconds. The rectified integral and differential signals are compared to their respective thresholds on each data period, and a V-counter (not shown) is incremented by 1 if the rectified integral signal exceeds the integral-signal threshold 2101. Likewise a U-counter (not shown) counts the number of times the rectified differential signal exceeds the differential-signal threshold 2102. Then after M=110 data periods (corresponding to Tupdate=5 milliseconds with Tdata=0.045 milliseconds), the tally counters are processed. At that time the V-counter is added to the voiced tally counter, and the U-counter is added to the unvoiced tally counter. Then both tallies are decremented, once per Tupdate, by multiplying each tally counter by 0.7, which results in a decrementation span of about 15 milliseconds. The voiced and unvoiced tally counter traces appear stepwise jagged in the figure because they are updated only once per 5 milliseconds.

The tally counters are then compared to thresholds to identify sound intervals of each sound type. The voiced tally counter is compared to a voiced-tally threshold 2103, and the voiced time-interval signal, shown in Trace 21.7, is set high whenever the voiced tally counter exceeds the voiced-tally threshold 2103. Likewise the unvoiced-time-interval signal shown in Trace 21.8 is set high whenever the unvoiced tally counter exceeds the unvoiced-tally threshold 2104. These comparisons are also performed only once per Tupdate, to reduce the computational demands. With this procedure, the voiced- and unvoiced-time-interval signals demark two voiced intervals and one unvoiced interval, in the order of (voiced-unvoiced-voiced). The observed sound-type sequence matches one of the predetermined patterns of the "RESET" command. Hence the inventive method has successfully identified the command using the delayed-tally protocol.

The tally protocol provides output signals demarking voiced and unvoiced time intervals, by comparing the tally counters to thresholds and setting the output signals accordingly. Although the tally protocol automatically produces a smoothing effect, some sounds nevertheless produce a segmented output signal due to sound modulation. Therefore the invention includes a tally-hysteresis option similar to the signal-hysteresis option discussed with FIG. 14. First the invention will be illustrated in FIG. 22 without tally-hysteresis, and then in FIG. 23 with tally-hysteresis.

Figure 22:
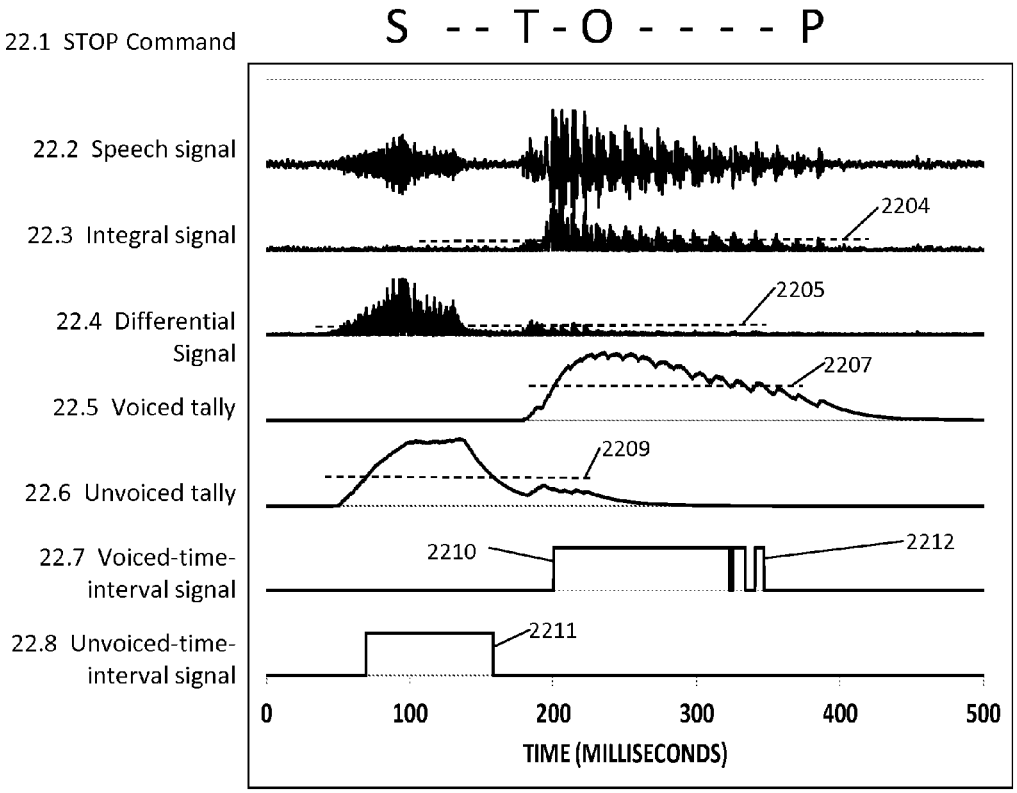
FIG. 22 is a set of graphs showing how the command "STOP" is analyzed according to the inventive tally protocol, but without tally-hysteresis.

FIG. 22 shows an example of the tally protocol using the "STOP" command. FIG. 22 does not use the delayed-tally protocol nor tally-hysteresis; it uses the regular tally protocol with full tally updating on every data period, and demarks output intervals according to the simple voiced-tally threshold and unvoiced-tally threshold.

Trace 22.1 shows the command letters, Trace 22.2 shows the speech signal, Trace 22.3 shows the rectified integral signal, and Trace 22.4 shows the rectified differential signal, obtained as described with FIGS. 18 and 19.

Trace 22.5 shows the voiced tally counter, which was incremented whenever the integral signal exceeded an integral-signal threshold 2204. Trace 22.6 shows the unvoiced tally counter, which was incremented whenever the differential signal exceeded a differential-signal threshold 2205. Then both tally counters were decremented periodically.

Trace 22.7 shows the voiced-time-interval output signal which was set high when the voiced tally exceeded a voiced-tally threshold 2207. A voiced interval 2210 is demarked by the voiced-time-interval signal going high during the "O" sound. In addition, a few brief extra segments 2212 are demarked at the end of the voiced sound. The segments 2212 are due to fluctuations of the voiced tally counter, which in turn are due to fluctuations of the integral signal.

Trace 22.8 shows the unvoiced-time-interval output signal which was set high when the unvoiced tally exceeded the unvoiced-tally threshold 2209, thereby demarking a single unvoiced interval 2211. However, if the unvoiced-tally threshold 2209 had been slightly lower, the unvoiced-time-interval signal would also have had extra segments.

The results of FIG. 22 demonstrate that time-interval signals demarking the primary sound intervals in the command can be identified, and their sound type indicated, using the inventive tally protocol; however, some extra segments may appear in the output signals due to fluctuations in the sounds. It is quite common for each tally counter to pass above and below its threshold repeatedly before subsiding. The output signal would then be set high and low repeatedly, thus generating a series of smaller interval segments rather than one single interval that encloses all the sound. While some applications would accommodate the extra segments, many other applications need to receive a simpler signal that encloses all the voiced or unvoiced sound as a single time interval. Therefore the inventive method includes a tally-hysteresis option, analogous to the signal-hysteresis option discussed with FIGS. 13 and 14.

In the tally-hysteresis option, there are four tally thresholds. To detect voiced sound, the voiced tally counter is compared to an upper voiced-tally threshold or a lower voiced-tally threshold which is lower than the upper voiced-tally threshold. To detect unvoiced sound, the unvoiced tally counter is compared to an upper unvoiced-tally threshold or a lower unvoiced-tally threshold which is lower than the upper unvoiced-tally threshold. Initially, a voiced sound is recognized only when the voiced tally counter rises above the upper voiced-tally threshold. Then, after the voiced tally counter exceeds the upper voiced-tally threshold and a voiced sound is recognized, the protocol switches to the lower voiced-tally threshold for the remainder of the voiced sound. The voiced sound interval then ends when the voiced tally counter finally drops below the lower voiced-tally threshold. After that, the protocol switches back to the upper voiced-tally threshold, so that any further voiced sound is recognized only if the voiced tally counter again rises above the upper voiced-tally threshold. To summarize, the voiced-time-interval signal is set high when the voiced tally counter first exceeds the upper voiced-tally threshold, and remains high until the voiced tally counter drops below the lower voiced-tally threshold. In this way the voiced-time-interval signal encloses all the voiced sound, with no additional segments or pulses thereafter.

The unvoiced tally counter with hysteresis works in a similar fashion. The unvoiced-time-interval signal is set high when the unvoiced tally counter rises above the upper unvoiced-tally threshold, and remains high until the unvoiced tally counter drops below the lower unvoiced-tally threshold. An advantage of the hysteresis protocol is that transient noise rejection is improved since a noise pulse is unlikely to exceed the higher threshold. Hysteresis also eliminates the segmentation of the time-interval output due to sound modulation, such as that of FIG. 22. With the tally-hysteresis option, the output signal demarks all of the sound in a single time interval, as desired.

In the event that the tally counter happens to fluctuate above the upper tally threshold after a sound ends (a rarity), then an additional segment would appear following the main sound time interval. But such an event is usually not a fluctuation at all—more likely it is due to a command with two sound intervals of the same sound type separated by a brief silence. In that case the output time-interval signal would correctly demark two separate intervals of sound with an intervening silence.

Figure 23:
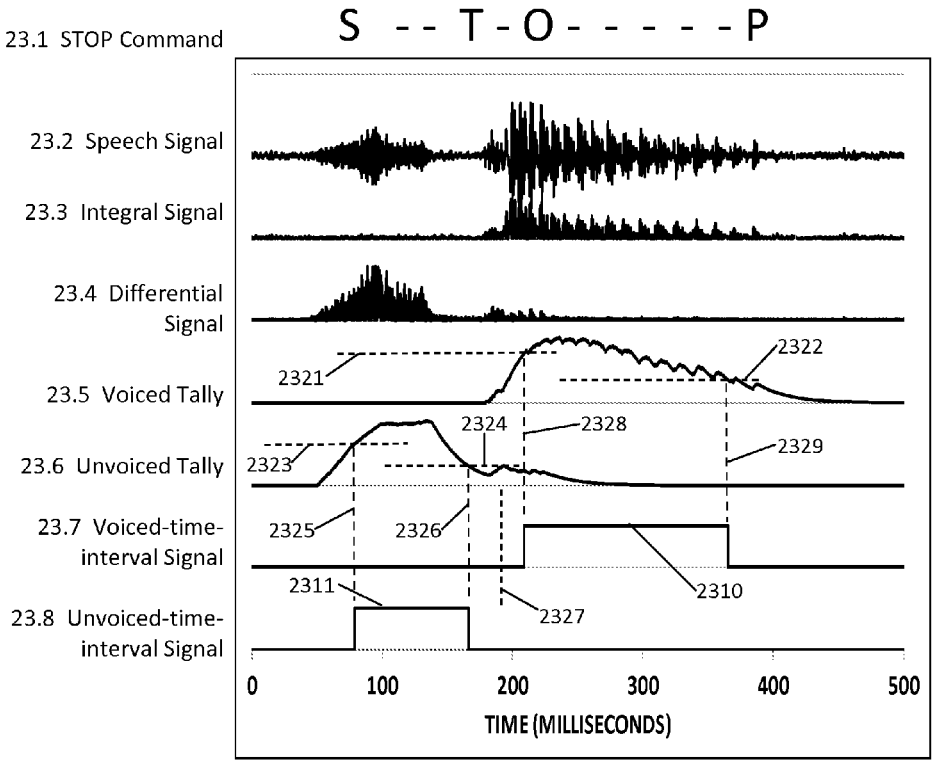
FIG. 23 is a series of graphs showing how the command "STOP" is analyzed according to the inventive tally protocol, including tally-hysteresis.

FIG. 23 illustrates command analysis using the tally protocol with the tally-hysteresis option. The command in FIG. 23 is again "STOP" as shown in Trace 23.1, with the speech signal shown in Trace 23. The integral signal is shown in Trace 23.3, and the differential signal is shown in Trace 23. The voiced tally counter shown in Trace 23.5, and the unvoiced tally counter shown in Trace 23.6, are derived as discussed with FIG. 22.

The voiced and unvoiced tally counters are then analyzed using the hysteresis option. The hysteresis option includes an upper voiced-tally threshold 2321 and a lower voiced-tally threshold 2322 and an upper unvoiced-tally threshold 2323 and a lower unvoiced-tally threshold 2324. Five specific times 2325 through 2329 are shown as vertical dashed lines. Traces 23.7 and 23.8 show a voiced-time-interval signal and an unvoiced-time-interval signal which are the output signals in this example. The voiced-time-interval and unvoiced-time-interval signals are produced by comparing the voiced and unvoiced tally counters to the various thresholds.

First, the unvoiced "S" sound is processed. Initially there is no sound and therefore the voiced-time-interval and unvoiced-time-interval signals are both low, and therefore the upper thresholds are operative. At time 2325, due to the "S" sound, the unvoiced tally counter exceeds the upper unvoiced-tally threshold 2323, thereby indicating that an unvoiced sound has begun. Accordingly, the unvoiced-time-interval signal is set high, thereby forming the leading edge of an unvoiced time interval 2311 that corresponds to the "S" sound. Thereafter, for the duration of the "S" sound, the protocol uses the lower unvoiced-tally threshold 2324; that is, it compares the unvoiced tally counter to the lower unvoiced-tally threshold 2324 as long as the unvoiced-time-interval signal remains high.

Then, at time 2326, the unvoiced tally counter drops below the lower unvoiced-tally threshold 2324, whereupon the unvoiced-time-interval signal in Trace 23.8 is set low, thereby ending the demarked unvoiced interval 2311. Since the unvoiced-time-interval signal is low after time 2326, the protocol switches back to using the upper unvoiced-tally threshold 2323 for unvoiced sounds thereafter.

Then, at time 2327, the unvoiced tally counter again exceeds the lower unvoiced-tally threshold 2324 due to a fluctuation in the unvoiced tally counter. However, at that time the unvoiced-time-interval signal is low, and therefore the upper unvoiced-tally threshold 2323 is operative. The unvoiced tally counter does not exceed the upper unvoiced-tally threshold 2323 at time 2327, or at any time thereafter. Therefore no further unvoiced sound is recognized and no secondary unvoiced segments are produced. Only the single unvoiced interval 2311 of the "S" sound appears in the unvoiced-time-interval signal. In this way the tally-hysteresis option prevents minor fluctuations from causing segmentation of the output signal.

The voiced sound is analyzed in a similar fashion. The voiced tally counter rises above the upper voiced-tally threshold 2321 at time 2328, which causes the voiced-time-interval signal to be set high, which begins the demarked voiced interval 2310. The protocol then switches to the lower voiced-tally threshold 2322 as long as the voiced-time-interval signal remains high.

Then, at time 2329, the voiced tally counter drops below the lower voiced-tally threshold 2322, which causes the voiced-time-interval signal to be set low, thereby completing the voiced interval 2310. This also causes the protocol to switch back to the upper voiced-tally threshold 2321 for further voiced tally comparisons.

Then, after time 2329, the voiced tally counter again exceeds the lower voiced-tally threshold repeatedly; however this has no effect because the operative threshold is the upper voiced-tally threshold 2321 as long as the voiced-time-interval signal is low. Therefore, no secondary voiced intervals are generated. In this way the hysteresis option prevents segmentation of the output voiced and unvoiced intervals.

The example of FIG. 23 shows that the inventive method, with the tally protocol and the tally-hysteresis option, successfully demarks voiced and unvoiced time intervals enclosing the "O" and "S" sounds, and without segmentation or multiple output intervals being demarked, despite fluctuations in both tally counters. If the tally-hysteresis option were not used, these fluctuations would have resulted in secondary brief intervals being demarked in the output signals.

Another option of the tally protocol is intrusion suppression. As mentioned, intrusion suppression is an option wherein an ongoing sound interval of one sound type prevents an intruding sound of the opposite sound type. In embodiments, intrusion suppression prevents intrusion of the second sound type by raising the threshold that the second type must exceed, or by simply inhibiting the second type altogether, until the first sound is finished. Voiced and unvoiced sounds could be handled symmetrically, or one sound type could be dominant. Unvoiced-dominance is most useful when the ADC is relatively slow, enabling partial compensation for the reduced sensitivity to rapid unvoiced wavelets.

Figure 24:
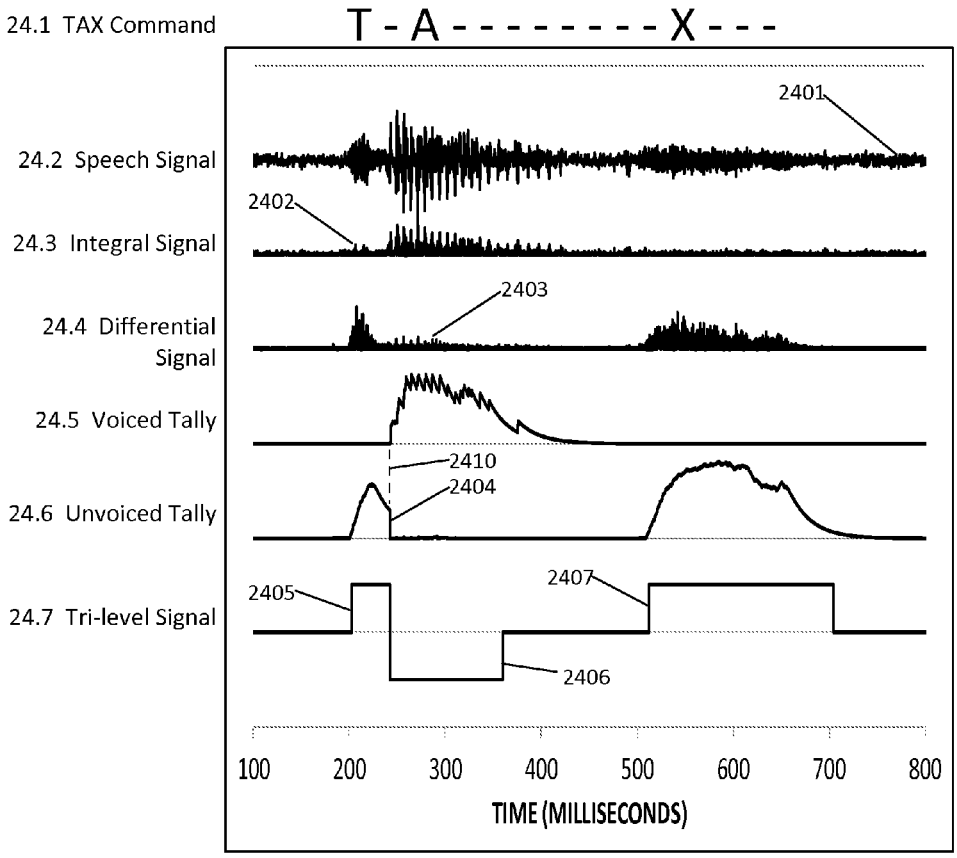
FIG. 24 is a series of graphs showing how the command "TAX" is analyzed according to the inventive tally protocol including intrusion suppression, and with tri-level output.

FIG. 24 illustrates asymmetric intrusion suppression in an analysis of the command "TAX". In the example of FIG. 24, unvoiced sounds are suppressed whenever a voiced sound is present, but voiced sounds are not suppressed; hence this is asymmetric intrusion suppression with voiced-dominance. Also in FIG. 24, a tri-level output signal is generated which is set positive during an unvoiced sound, negative during a voiced sound, and neutral during silence. The example employs the regular tally protocol that is updated upon each data period; it does not use the delayed tally protocol, and does not use hysteresis.

Trace 24.1 shows the command with the letters spread out. Trace 24.2 shows the speech signal, which includes rapid wavelets of the "T" and "X", and slow wavelets of the "A" sounds. The background noise 2401 is considerably higher than for the previous examples, but the inventive method will analyze the sound correctly nevertheless.

Trace 24.3 shows the rectified integral signal obtained by integrating the speech signal, and Trace 24.4 shows the rectified differential signal obtained by differentiating the speech signal, as described in FIG. 9. Trace 24.5 shows the voiced tally counter and Trace 24.6 shows the unvoiced tally counter, which are obtained as described with FIG. 17. Trace 24.7 shows a tri-level output signal that indicates both voiced and unvoiced sounds as well as silence on a single line, with positive indicating unvoiced sound, negative indicating voiced sound, and ground being silence.

The integral signal of Trace 24.3 shows a few errant wavelets 2402 during the "T" sound and at other places outside the voiced "A" sound. A sound detection method that is based solely on the amplitude of the sound could be triggered by the errant wavelets 2402, and could mistakenly register them as another voiced interval. The voiced tally counter of Trace 24.5, on the other hand, is not fooled. The errant wavelets 2402 cause only a very slight effect on the voiced tally counter, since the rate of occurrence of the errant wavelets 2402 is low. This is one of the advantages of the inventive tally protocol, that the method successfully rejects occasional brief noise or interference because the tally protocol is based on the rate of occurrence of signals rather than their overall amplitude.

The unvoiced tally counter is shown in Trace 24.6. It may be noted that the unvoiced tally counter signal for the "T" sound has a peculiar shape 2404, dropping suddenly to zero at time 2410 rather than tapering gradually as with the preceding examples. This abrupt tally termination is a result of intrusion suppression with voiced-dominance. At time 2410, the voiced tally counter exceeds the voiced-tally threshold (not shown), hence a voiced sound is recognized, and according to the voiced-dominant intrusion suppression, the unvoiced tally counter is set to zero immediately. Thus, in accordance with asymmetric intrusion suppression with voiced-dominance, the unvoiced "T" signal was suppressed as soon as the voiced "A" was recognized, causing the abrupt termination 2404 of the unvoiced tally signal at time 2410. In contrast, the subsequent unvoiced "X" signal shows no such truncation, since there are no competing voiced sounds at that time.

The output signal, shown in Trace 24.7, is a tri-level signal that is set positive while the unvoiced tally counter exceeds the unvoiced-tally threshold (not shown), or negative while the voiced tally counter exceeds the voiced-tally threshold (not shown), or zero otherwise. A positive interval 2405 is demarked during the "T" sound since it is unvoiced.

But then, at the time 2410, the positive interval 2405 is abruptly ended and the negative interval 2406 is started. The interval 2406 corresponds to the voiced "A" sound. The unvoiced interval 2405 is truncated because, in accordance with the voiced-dominance aspect of the protocol, voiced sounds can interrupt pre-existing unvoiced intervals, hence the "A" intruded upon the "T" sound. A second positive interval 2407 corresponding to the unvoiced "X" sound is allowed to proceed uninterrupted since no voiced sounds occur during the unvoiced interval 2407. The example of FIG. 24 follows the method illustrated in FIG. 17 including the option shown as dashed lines in FIG. 17. The unvoiced (positive) interval 2405 is abruptly cut off when the voiced "A" is recognized.

In the example of FIG. 24, the intrusion suppression was implemented by setting the unvoiced tally counter to zero. As an alternative, the intrusion suppression could be implemented by raising a threshold, such as the differential-signal threshold or the unvoiced-tally threshold, when the voiced sound begins. In that case the unvoiced tally counter would have decreased gradually due to the usual decrementation, rather than dropping to zero abruptly as shown in the figure. For applications that cannot accept mixed sound types (sounds that have both voiced and unvoiced intervals demarked at the same time), it is preferred that intrusion suppression be implemented by setting the competing tally to zero abruptly, since this prevents mixed signal output. But for applications that can deal with mixed sound types, the suppression can be implemented by raising the competing thresholds instead, and allowing the suppressed tally to decline gradually by decrementation.

Intrusion suppression reduces misidentification of sounds due to noise pulses or other non-command interference. For example, the differential signal of Trace 24.4 includes some errant rapid wavelets 2403, probably due to continuing turbulence and rapid wavelets from the opening "T" sound. Unlike the errant wavelets 2402 in the integral signal, the errant rapid wavelets 2403 are sufficiently numerous to raise the unvoiced tally counter and would register as an unvoiced sound interval. However, with intrusion suppression, the method successfully prevents the errant rapid wavelets 2403 from affecting the unvoiced tally counter, since the errant rapid wavelets 2403 occur during the voiced interval 2406. According to the inventive method with intrusion suppression and voiced-dominance, all rapid wavelets occurring during voiced sounds are ignored. Hence the errant rapid wavelets 2403 are inhibited.

The example of FIG. 24 demonstrates that the tally protocol with intrusion suppression can prevent noise and occasional wavelets from being erroneously interpreted as an interval of sound.

Figure 25:
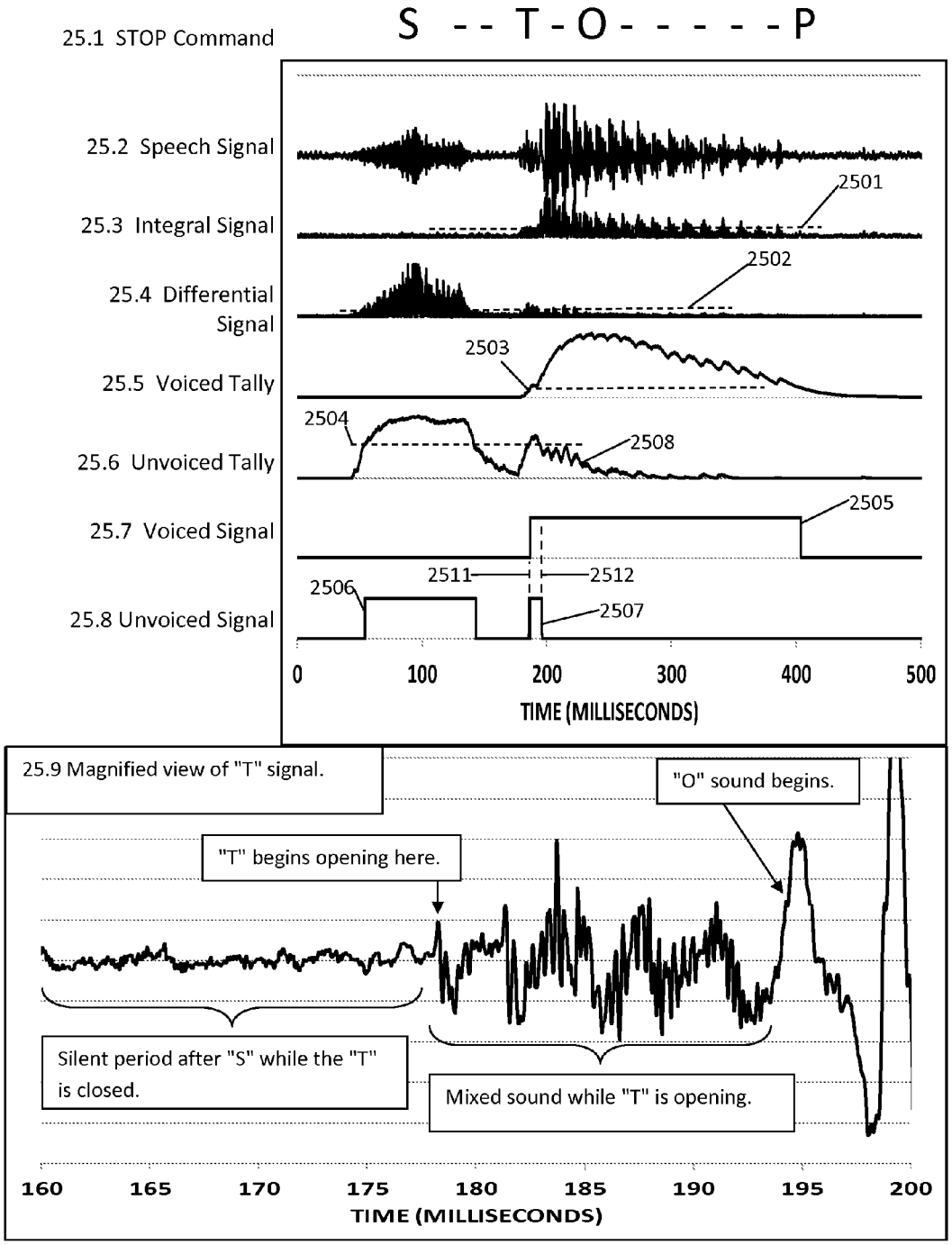
FIG. 25 is a series of graphs showing how the command "STOP" is analyzed with thresholds adjusted for detection of weak and mixed-type sounds.

Turning now to FIG. 25, an example shows how the tally protocol can detect transient mixed sounds having both voiced and unvoiced components, even when the total sound amplitude is very low and the sound is brief. In this case, the "T" in "STOP" is a mixed sound because both rapid and slow wavelets are present simultaneously. The slow wavelets may be due to labile motion of the tongue as it lifts off the roof of the mouth, or to fluid effects during the brief opening "T" sound. The method also reveals certain rapid wavelets occurring during a voiced interval, which may be due to turbulence continuing after a prior unvoiced sound. In this way the inventive method can probe deeply into the speech sounds, revealing valuable details about the production and dynamics of the speech sounds at the single-wavelet level.

Trace 25.1 again shows the command, and Trace 25.2 the sound signal obtained at 22 kHz. Trace 25.3 shows the rectified integral signal obtained by incremental averaging with Tinteg=0.25 milliseconds. The integral-signal threshold 2501 is placed very low, just above noise level, to pick up weak sounds. Trace 25.4 shows the rectified differential signal, obtained using Eq. 11, and the differential-signal threshold 2502. Trace 25.5 shows the voiced tally counter and the voiced-tally threshold 2503. Trace 25.6 shows the unvoiced tally counter which includes dual-slope incrementation, and has a very short 5 millisecond decrementation time for fast recovery. Also shown is the unvoiced-tally threshold 2504. Trace 25.7 shows the voiced signal output including a voiced interval 2505 corresponding mainly to the "O" sound. Trace 25.8 shows the unvoiced signal output including an unvoiced interval 2506 corresponding to the "S" sound, and a second unvoiced interval 2507 corresponding to the "T" sound. The unvoiced intervals 2506 and 2507 show when the unvoiced tally counter exceeds the unvoiced-tally threshold 2504.

Trace 25.9 shows a greatly magnified view of the speech signal during the "T" sound. Unvoiced plosives generally include a silent interval during which the airway is blocked, in this case by the tip of the tongue pressing against the roof of the mouth. The trace accordingly shows a prolonged silence between the "S" sound and the beginning of the "T". Then, at about 177 milliseconds, the tongue lifts away from the roof of the mouth and the unvoiced opening-"T" sound begins. The unvoiced sound is produced by turbulence as the escaping air produces vortexes that generate the rapid wavelets of the "T". The turbulence is simultaneously modulated by the flexible tongue motion, and possibly by fluids in the interface between the tongue and the roof of the mouth as well. The resulting modulation is visible as a slower variation superposed on the rapid wavelets. In this case the "T" interval is quite short, 16 milliseconds. During that time the speech signal exhibits both rapid wavelets and slow wavelets, notwithstanding that the vocal cords are not yet involved. If the "T" had been aspirated slightly longer, this modulation (and the slow wavelets) would have faded, and only the rapid wavelets would have continued during the remainder of the "T" sound. But in this case the "T" is so brief, that the entire "T" sound exhibits both rapid and slow wavelets due to the modulation, and thus may be considered a mixed-type sound.

At about 193 milliseconds, the vocal cords begin building resonance and the voiced wavelets of the "O" sound rapidly increase in amplitude. A small amplitude of rapid wavelets persist during the growing "O" sound. Probably these rapid wavelets continuing after about 193 milliseconds are due to continuing turbulence as air flows past the opening tongue even while the voiced sound is produced, although the possibility that they are high overtones during the "O" sound cannot be ruled out without further analysis.

Returning to Trace 25.5, the voiced tally counter registers the slow-wavelet modulation of the "T" interval, and simultaneously the unvoiced tally counter in Trace 25.6 reveals the rapid wavelets of the "T". The unvoiced tally also reveals a lingering rapid-wavelet signal 2508 extending well into the "O" sound. This unvoiced signal 2508 is maximum just after the "T" sound and decays much more rapidly than the voiced "O" sound; therefore it is almost certainly due to lingering unvoiced turbulence from the opening "T", and not from overtones or some other source connected to the voiced sound. Thus the inventive wavelet analysis identifies the source of rapid wavelets persisting into the voiced "O" sound, and also clarifies the mechanisms of sound production in speech.

Traces 25.7 and 25.8 show that both the voiced and unvoiced signals are high between times 2511 and 2512, thereby indicating that the sound is mixed type during the "T". This example shows that the inventive method can detect and identify a transient complex sound, even if faint, in addition to demarking pure voiced and unvoiced intervals. The example also demonstrates two situations where rapid or slow wavelets are present during the opposite sound type, due to various turbulent dynamics as the sounds are formed. Although the inventive method is normally used to detect the main, dominant sound intervals, the example of FIG. 25 shows that the method can also analyze mixed, faint, and complex sounds in much more detail when needed.

Second Discrimination Experiment

Figure 26:
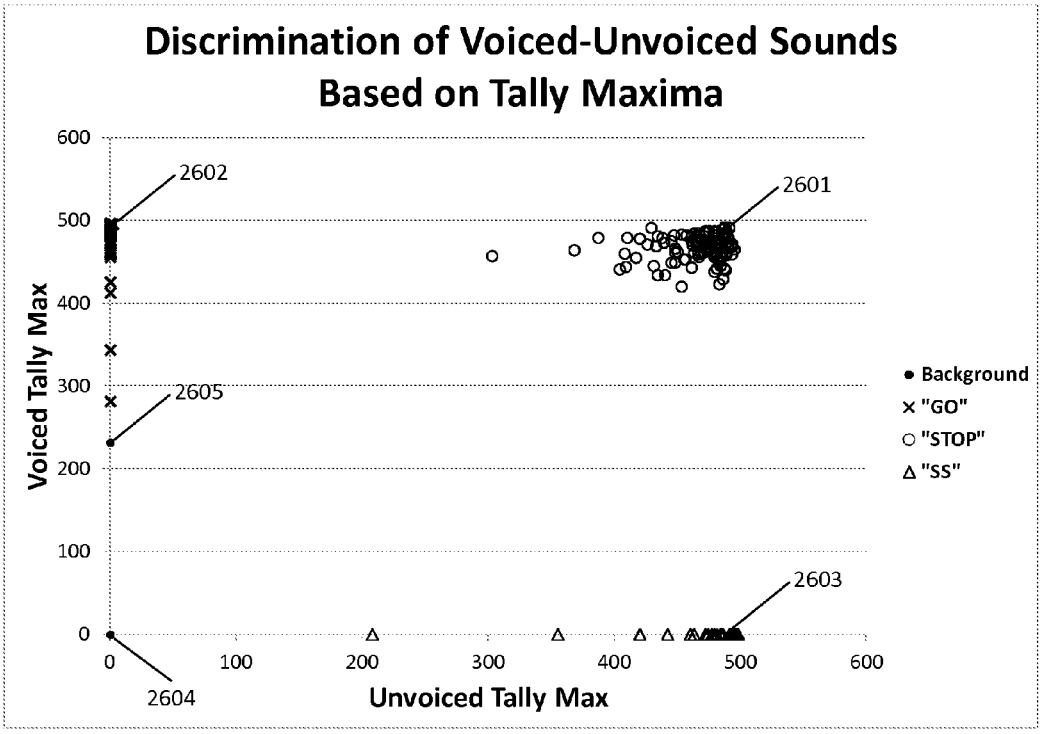
FIG. 26 is a graph showing experimental results that demonstrate excellent discrimination of command sounds using the inventive tally protocol.

A second experiment was carried out, similar to that of FIG. 8, to test the inventive method, but this time using the tally protocol to discriminate voiced and unvoiced sounds. The procedure was the same as that for the experiment of FIG. 8, but here the measured parameters were the maximum values of the voiced and unvoiced tally counters, instead of the maximum values of the integral and differential signals. The command sounds again comprised a voiced command "GO", an unvoiced sound "SS", a "STOP" command with both voiced and unvoiced sound, and a Background condition comprising a 10-second period of ordinary office noise but with no command spoken. The background noise included fans, a ventilator, external traffic noises, civilized music, and occasional speech in an adjacent room, as described previously. Each trial condition was repeated about 100 times. The graph of FIG. 26 shows the maximum value of the voiced and unvoiced tally counters recorded during the test sounds. Both tally counters were limited to a maximum value of 500, to ensure rapid recovery after each sound. The difference between the experiment of FIG. 26 and that of FIG. 8 is the parameter being measured. In FIG. 8 the points were plotted according to the maximum values of the integral and differential signals, whereas in FIG. 26 the points are plotted according to the maximum tally counter values. The maximum of the voiced tally counter is plotted along the horizontal axis and the maximum of the unvoiced tally counter along the vertical axis.

As is apparent in FIG. 26, the data points are highly segregated into separate groupings. This shows that the sound types can be identified with very high reliability. The open circles 2601 in the upper right of the graph represent the tally maxima for the "STOP" commands. Since this command includes both voiced and unvoiced sounds, both the voiced tally counter and the unvoiced tally counter registered strong signals for "STOP".

The X's 2602 on the left side of the graph represent the tally maxima observed for the "GO" commands, comprising voiced sound but no significant unvoiced sound. Accordingly, the X's 2602 are clustered at or near a maximum voiced tally value, but with little or no unvoiced tally counts observed. The triangles 2603 along the bottom of the graph represent the unvoiced "SS" commands, which exhibited an intense unvoiced signature with little or no voiced component. Finally, the "Background" tests are plotted as solid black dots 2604 and 2605. Ninety-nine of the Background trials had a tally count of 0 or 1 in both the voiced and unvoiced tallies, and thus all of those data points are tightly clustered in the single black dot 2604 at the origin. In one of the noise trials, however, an extremely loud motorcycle suddenly roared by, just outside the lab, and this sound registered as a voiced sound type, thus causing a single Background point 2605 to appear close to the voiced "GO" sounds. Thus, 99 of the Background trials had 0 or 1 in both tally counters, and appear as the tight cluster 2604, while a single trial with unexpected noise appears as the single point 2605.

The chart of FIG. 26 shows that, absent errant motorcycles, the inventive method with the tally protocol identified the four sound cases with even better separation than the experiment of FIG. 8. Taking the experiments of FIGS. 8 and 26 together, the inventive method correctly identified the sound type, and correctly discriminated command sounds from background, in 799 out of 800 trials. Prior-art methods, with all their supercomputers, have yet to exceed that performance.

FIG. 27 shows a table, similar to FIG. 7, enumerating the variables and the arithmetic operations executed in each data period for the tally protocol with hysteresis (on the left side), and for the delayed-tally with the delayed-offset option (on the right). First, for the tally protocol with hysteresis, the variables in RAM are: the offset signal, the most recent three values of the speech signal, the integral and differential signals, the voiced and unvoiced tally counters, and the voiced and unvoiced time-interval signals, for a total of 10 variables. There are no V-detection or U-detection variables because the tallies are incremented by the integral and differential signals directly. The hysteresis is implemented according to the voiced- and unvoiced-time-interval signals being high or low, so no additional variables are needed for this option.

The computations needed for the tally method with hysteresis are: offset averaging (2 multiplications and 1 addition), the offset subtraction from the digitizer-output (1 subtraction), integrating the integral signal (2 multiplications and 1 add, assuming incremental averaging), differentiating the differential signal (1 addition, 1 subtraction, 1 division (by 4), 1 multiplication (by 2)), rectification and threshold comparisons for the integral and differential signals (2 magnitudes and 2 comparisons), tally increments and decrements (at most 2 adds and 2 multiplications), then hysteresis implemented as 2 conditional operations per tally (4 conditionals total) thereby producing the output time-interval signals. The divide-by-4, multiply-by-2, rectification, and comparison operations are trivial. With these assumptions, the total is 23 operations of which 10 are trivial and 13 are nontrivial.

Also shown on the right in FIG. 27 are the variables and operations needed for the delayed-tally protocol, with the delayed-offset option. The variables are the same as with the tally protocol with hysteresis, plus 3 registers for the V-counter, U-counter, and cycle counter, for a total of 10 RAM variables plus 3 single-byte registers.

The operations for the delayed-tally case are simpler than the regular tally because the offset calculation and the tally calculations are not included in the per-data-period burden—they are performed only once per 100 data periods, and hence produce negligible processor loading on average. The remaining operations that need to be carried out on every data period are: subtract the offset signal to obtain the speech signal (1 subtraction), integrate the integral signal (2 multiplications and 1 add), differentiate the differential signal (multiply, add, subtract, divide), rectify and threshold the integral and differential signals (2 magnitudes, 2 comparisons), increment the V-counter or the U-counter (2 comparisons and 1 increment, usually), and increment and test the cycle counter (1 increment and 1 comparison). All of the other operations occur on a 5-millisecond scale and thus are not included. Register increments are trivial, as are the magnitude and comparison operations. The total operations, then, are 17 operations of which 11 are trivial and 6 are nontrivial.

Comparing FIG. 7 with FIG. 27, the fastest protocols computationally are the delayed-tally protocol and the detection-output protocol. These protocols are tied for speed, at 6 nontrivial operations per data period. The smallest memory requirement is definitely the detection-output protocol with only 8 variables in RAM. All of the protocols and options listed in the figures employ at most 13 variables in RAM and at most 13 non-trivial operations per data period.

The small amount of memory space required for the inventive method is quite unlike prior-art methods involving spectral analysis or autocorrelation or the other compute-intensive methods. Likewise the computational operations of the inventive method are extremely minimal, comprising mainly trivial rectifications plus a small number of arithmetic operations per data period. Reducing the computation burden is important for stretching battery life in many future applications such as wearable devices, embedded controllers, and implanted devices that rely on harvested energy. Prior-art methods involve thousands or millions of calculations to invert matrices and minimize error vectors and whatever else they do. The inventive method has no need for frames, the arbitrary time segmentation of the sound signal, which almost all prior art depends on. The inventive method does not use the frequency domain in any way, since all of the information needed to perform V-U discrimination is already present in the time domain. The inventive method is deterministic, as opposed to prior-art probabilistic methods and generator methods. The inventive method has no need for cascaded parameter testing or least-error fitting. And the inventive method is extremely fast, providing V-U results in one millisecond or less for the V-detection and U-detection signals, and in a few milliseconds for the time-interval signals based on the tally protocol. The inventive method provides a highly reliable V-U sound-type discrimination, matching or exceeding the performance of the elaborate prior-art methods, but at a fraction the cost.

The inventive method is particularly suitable for applications that recognize just a few predetermined commands on the basis of the sound-type sequence. The method is also suitable for pre-processing speech to enhance the efficiency of downstream processors, including freeform speech interpretation and speech encoding for transmission. The method also detects intervals of silence within commands, and silent pauses between commands, as intervals when both the voiced and unvoiced time-interval signals are low. All of these results are obtained without complex analysis. Indeed, the inventive method has been implemented on a simple 8-bit microcontroller that costs mere pennies, has no external memory, and has no link to a remote server. With prior-art speech technology, none of that would be possible.

With the foregoing examples, the inventive method has been demonstrated to provide almost perfect discrimination of spoken command sounds into voiced and unvoiced sound types (799 correct in 800 trials, one trial ruined by a force of nature), using minimal system memory (only 8 to 13 variables) and minimal processor resources (only 6 to 13 nontrivial arithmetic operations per data period). In addition, the method has been shown to provide rapid and reliable command identification, by decoding the sequence of voiced and unvoiced intervals in the command. This performance compares well with prior-art methods that involve huge computational loads and huge memories and communication links to supercomputer clusters. The inventive method can serve as the standard for future sound-type discrimination in sparse-command applications such as wearable devices and embedded controllers, particularly those wherein battery life is an important factor since computational efficiency results in power savings.

The embodiments and examples provided herein illustrate the principles of the invention and its practical application, thereby enabling one of ordinary skill in the art to best utilize the invention. Many other variations and modifications and other uses will become apparent to those skilled in the art, without departing from the scope of the invention, which is to be defined by the appended claims.

The invention claimed is:

1. A method for indicating when voiced sounds or unvoiced sounds are present in speech sounds, said method comprising:

converting, with an analog-to-digital converter, the speech sounds to a speech signal comprising sequential digitized values;

integrating the speech signal, thereby generating an integral signal;

differentiating the speech signal, thereby generating a differential signal;

subtracting the integral signal from the speech signal, thereby producing a speech-minus-integral signal;

subtracting the differential signal from the speech signal, thereby producing a speech-minus-differential signal;

differentiating the speech-minus-integral signal, thereby producing a refined differential signal;

integrating the speech-minus-differential signal, thereby producing a refined integral signal;

when the refined integral signal exceeds a refined-integral-signal threshold, generating a first output signal, thereby indicating that a voiced sound is present;

and when the refined differential signal exceeds a refined-differential-signal threshold, generating a second output signal, thereby indicating that an unvoiced sound is present.

2. A method for indicating when voiced sounds or unvoiced sounds are present in speech sounds, said method comprising:

converting, with an analog-to-digital converter, the speech sounds to a speech signal comprising sequential digitized values;

integrating the speech signal, thereby generating an integral signal;

differentiating the speech signal, thereby generating a differential signal;

subtracting the integral signal from the speech signal, thereby producing a speech-minus-integral signal;

subtracting the differential signal from the speech signal, thereby producing a speech-minus-differential signal;

differentiating the speech-minus-integral signal, thereby producing a refined differential signal;

integrating the speech-minus-differential signal, thereby producing a refined integral signal;

when the refined integral signal exceeds an integral-signal threshold, incrementing a voiced tally counter, wherein the voiced tally counter comprises an incrementable and decrementable counter;

and when the refined differential signal exceeds a differential-signal threshold, incrementing an unvoiced tally counter, wherein the unvoiced tally counter comprises a second incrementable and decrementable counter;

decrementing the voiced tally counter and decrementing the unvoiced tally counter;

when the voiced tally counter exceeds a voiced-tally threshold, generating an output signal, thereby indicating that a voiced sound is present;

and when the unvoiced tally counter exceeds an unvoiced-tally threshold, generating an additional output signal, thereby indicating that an unvoiced sound is present.

3. A method for indicating when voiced sounds or unvoiced sounds are present in speech sounds, said method comprising:

converting, with an analog-to-digital converter, the speech sounds to a speech signal comprising sequential digitized values;

integrating the speech signal, thereby generating an integral signal;

differentiating the speech signal, thereby generating a differential signal;

incrementing a voiced tally counter, wherein the voiced tally counter comprises an incrementable and decrementable counter;

incrementing an unvoiced tally counter, wherein the unvoiced tally counter comprises a second incrementable and decrementable counter;

decrementing the voiced tally counter and decrementing the unvoiced tally counter;

while the voiced tally counter exceeds the voiced-tally threshold, setting a tri-state output signal to a first state;

while the voiced tally counter remains below the voiced-tally threshold and the unvoiced tally counter remains below the unvoiced-tally threshold, setting the tri-state output signal to a second state;

and while the unvoiced tally counter exceeds the unvoiced-tally threshold, setting the tri-state output signal to a third state.

* * * * *